US007156556B2

(12) United States Patent
Takahashi et al.

(10) Patent No.: US 7,156,556 B2
(45) Date of Patent: Jan. 2, 2007

(54) STAND-UP PACKAGING POUCH, PACKAGE BODY AND FEED ROLL, AND MANUFACTURING METHODS THEREFOR

(75) Inventors: Sakaru Takahashi, Tokyo (JP); Hiromichi Inagaki, Inuyama (JP)

(73) Assignee: Plast Corporation, Tokyo (JP)

( * ) Notice: Subject to any disclaimer, the term of this patent is extended or adjusted under 35 U.S.C. 154(b) by 87 days.

(21) Appl. No.: 10/493,156

(22) PCT Filed: Dec. 25, 2002

(86) PCT No.: PCT/JP02/13487

§ 371 (c)(1),
(2), (4) Date: Apr. 15, 2004

(87) PCT Pub. No.: WO03/055760

PCT Pub. Date: Jul. 10, 2003

(65) Prior Publication Data

US 2005/0069230 A1 Mar. 31, 2005

(30) Foreign Application Priority Data

| | | |
|---|---|---|
| Dec. 25, 2001 | (JP) | 2001-392280 |
| Jan. 25, 2002 | (JP) | 2002-017259 |
| Feb. 12, 2002 | (JP) | 2002-034407 |
| Mar. 4, 2002 | (JP) | 2002-057941 |

(51) Int. Cl.

| | |
|---|---|
| ***B65D 30/16*** | (2006.01) |
| ***B65D 33/00*** | (2006.01) |
| ***B65D 30/20*** | (2006.01) |
| ***B65D 30/10*** | (2006.01) |

(52) U.S. Cl. ..... 383/104; 383/32; 383/120; 383/121

(58) Field of Classification Search ..... 383/120, 383/121, 104, 32, 2

See application file for complete search history.

(56) References Cited

U.S. PATENT DOCUMENTS

| | | | | |
|---|---|---|---|---|
| 1,414,236 | A * | 4/1922 | Walmsley | 229/104 |
| 2,063,645 | A * | 12/1936 | Maclean | 229/115 |
| 2,070,747 | A * | 2/1937 | Orstrom | 229/104 |
| 2,996,233 | A * | 8/1961 | Craig et al. | 229/104 |
| 3,935,993 | A * | 2/1976 | Doyen et al. | 383/94 |
| 5,437,406 | A * | 8/1995 | Gordon et al. | 229/193 |
| 6,126,315 | A * | 10/2000 | Ichikawa et al. | 383/43 |

FOREIGN PATENT DOCUMENTS

| | | |
|---|---|---|
| JP | 47-37879 | 11/1972 |
| JP | 56-59506 | 5/1981 |
| JP | 6-286758 | 10/1994 |
| JP | 11-70947 | 3/1999 |
| JP | 11-227801 | 8/1999 |
| JP | 11-310248 | 11/1999 |

(Continued)

*Primary Examiner*—Jes F. Pascua
(74) *Attorney, Agent, or Firm*—Flynn, Thiel, Boutell & Tanis, P.C.

(57) ABSTRACT

A stand-up packaging pouch manufactured in three-dimensional form or flattened form and provided with at least front face portion and rear face portion sides formed from packaging material having a pleat which is formed by folding a part of the packaging material in a three-fold strip form and adhering the inner faces of this folded part is constituted such that when the pouch is opened out into three dimensions, the pleat, formed in the same plane as the peripheral face portion, is positioned at a substantial right angle to a bottom face portion, thereby concealing the bottom face portion.

7 Claims, 28 Drawing Sheets

FOREIGN PATENT DOCUMENTS

| | | |
|---|---|---|
| JP | 11-310276 | 11/1999 |
| JP | 11-349013 | 12/1999 |
| JP | 2000-153852 | 6/2000 |
| JP | 2000-185740 | 7/2000 |
| JP | 2000-229646 | 8/2000 |
| JP | 2000-272634 | 10/2000 |
| JP | 2000-309345 | 11/2000 |
| JP | 2001-31110 | 2/2001 |
| JP | 2001-206385 | 7/2001 |

* cited by examiner

STAND-UP PACKAGING POUCH, PACKAGE BODY AND FEED ROLL, AND MANUFACTURING METHODS THEREFOR

TECHNICAL FIELD

The present invention relates to a stand-up (or self-standing)pouch provided with a pleat on the lower edge of at least a front face portion and rear face portion or the lower edge of an entire peripheral face portion, which is formed by folding a part of packaging material in a three-ply strip-form and adhering the inner surfaces of the folded part, and which conceals a bottom face portion to give the impression of a tightly sealed package, and also relates to a package body, a feed roll of packaging material having a pleat, and manufacturing methods therefor.

BACKGROUND ART

A stand-up packaging pouch disclosed in Japanese Patent Application Publication No. 11-070947, Japanese Patent Application Publication No. 11-227801, Japanese Patent Application Publication No. 11-310248, Japanese Patent Application Publication No. 11-310276, and Japanese Patent Application Publication No. 11-349013 is a so-called "Doyen Pak" type packaging pouch having a form in which a side heat seal is applied to the two side edges of the front face portion and the two side edges of the rear face portion to form a seam, in which, when the pouch is opened out three-dimensionally, a twofold bottom gusset opens out laterally to produce a bottom face portion shaped like a ship's bottom, and in which pleats are formed at the edge of the front face portion and bottom face portion and at the edge of the rear face portion and bottom face portion to thereby conceal the bottom face portion. A "Doyen Pak" type packaging pouch, however, has a particular ship's bottom form with side seals on both sides and no side face portions, and is therefore clearly different in form to a packaging pouch having an rectangular bottom.

Stand-up packaging pouches disclosed in Japanese Patent Application Publication No. 6-286758, Japanese Patent Application Publication No. 2000-153852, and Japanese Patent Application Publication No. 2000-272634 also have an identical bottom portion to a Doyen Pak form.

Stand-up packaging pouches described in Japanese Patent Application Publication No. 2000-185740, Japanese Patent Application Publication No. 2000-229646, and Japanese Patent Application Publication No. 2000-309345 are manufactured in a flattened pouch form, having a front face portion, a rear face portion, side face portions, and a bottom face portion, and having side heat-seals applied in a pinch form to the edges of the front face portion and the edges of the side face portions or side heat seals applied in a pinch form to the edges of the rear face portion and the edges of the side face portions. When opened out into three dimensions, the lower portions of the side heat seals reach the side edges of the bottom face portion, extending in a horizontal direction. This stand-up packaging pouch is not provided with hems (creased edges) or pleats on the edge between the front face portion and bottom face portion or the edge between the rear face portion and bottom face portion, and as a result, the bottom face portion is poorly defined, the outward appearance is unpleasant, and the stand-up quality is poor.

An indefinite outer shape container disclosed in Japanese Patent Application Publication No. 2001-031110 is a packaging pouch formed by inserting a rectangular mandrel into a flattened pouch to form a prismatic (prism-shaped) tube, forming a rectangular bottom face, applying a bottom seal to triangular ears formed on both sides, and severing the ear portions, whereby a heat seal portion extending horizontally outward at the lower end of the side face portions can be formed. This heat seal portion extends horizontally outward in a flange form, thereby inhibiting the attainment of a design having a clear-cut outline and causing an obstruction between adjacent pleats which disturb one another when the pouches are packed and displayed.

A side-gusseted flat-bottomed pouch disclosed in Japanese Patent Application Publication No. 2001-206385 is manufactured into a flattened pouch having a front face portion, a rear face portion, and side gussets. A regular mandrel is inserted to form a prismatic tube and a rectangular bottom face is formed, whereupon a heat seal is applied to the two side edges of the bottom face with the prismatic tube flattened into a T shape so as to close the side gussets. In so doing, a packaging pouch having pleats formed on the edge between the front face portion and bottom face portion and the edge between the rear face portion and bottom face portion is manufactured with a heat seal portion extending horizontally outward from the lower end of the side face portions. This heat seal portion extends horizontally outward in a flange form, thereby inhibiting the attainment of a design of a clearly defined shape and causing an obstruction between adjacent pleats which disturb one another when the pouches are packed and displayed.

An example of a side-gusseted flat-bottomed pouch shown in FIG. 11 disclosed in Japanese Patent Application Publication No. 2001-206385 is manufactured in a form having a pleat on the lower end of the peripheral face portion and having a bottom face portion which is folded using a separate sheet of paper, inserted into the lower portion of a flattened tube having a front face portion, rear face portion, and side gussets, and heat sealed.

This pleat is not folded into a pinch form, and therefore the edge of the flattened tube and the edge of the inserted bottom face portion rarely match perfectly. Further, when heat sealing is performed creases occur in various locations, giving a pleat with an unpleasant appearance and an incomplete peripheral heat seal such that the pouch is totally inappropriate for use as a liquid container.

According to a conventional vertical form-fill-seal method, a packaging material is issued from a packaging material feed roll, hooked onto a former, and folded into a tubular form so as to be wrapped substantially once around a packaged product filling tube which extends through the inside of the former. The two edges of the packaging material are then overlapped into a pinch pleat form or heat sealed into an envelope seal to form a packaging tube and the packaging tube is lowered under the packaged product filling tube, whereupon a product to be packaged is filled into the packaging tube downward through the packaged product filling tube and a bottom heat seal and top heat seal are applied to the packaging tube below and above the packaged product.

The packaging tube is manufactured into a vertical pillow package body with a rectangular bottom by abutting the packaging tube at the top and bottom in the side face direction with butting rods to thereby form a bottom gusset and a top gusset while a double heat seal comprising a bottom heat seal and a top heat seal is applied. The two edges of the packaging material which is wrapped substantially once around the packaged product filling tube are heat sealed to form a packaging tube and ribs are formed at four sides of the tube.

However, the vertical pillow package body with a rectangular bottom which is manufactured by this conventional form-fill-seal method cannot have a pleasing appearance.

In a horizontal form-fill-seal method, a packaging material is issued from a packaging material feed roll and hooked onto a former to be folded into a prismatic tunnel tubular form, whereupon the two edges of the packaging material are overlapped into a pinch form or heat sealed with the front and rear surfaces overlapped to form a packaging tube. Products to be packaged which are transported by an import conveyor are dispatched into the former at predetermined intervals, whereupon a double end seal is applied to the packaging tube between packaged product and packaged product and the packaging tube is cut between the double heat seal.

Prior to the sealing operation of the end sealers during the application of the double heat seal, the butting rods abut the packaging tube in the center of height on the two sides of the end sealers in the direction of packaging material motion to thereby form gussets, and thus the packaging tube is manufactured into a gusseted horizontal pillow package body.

Thanks to the gussets of the gusseted horizontal pillow package body manufactured by this conventional horizontal form-fill-seal method, the width of the packaging tube is not extended when the packaged product is a lens-attached camera, for example.

However, in this gusseted horizontal pillow package body, the gusset-inserted end seal is usually in pinch pleat form and therefore the package body is not placed on a shelf by inclining the end seal horizontally and rotating the package body 90 degrees such that the horizontally inclined end seal forms a bottom face portion. If the packaged body is placed thus, the bottom face portion having a horizontally inclined end seal causes the front face side and rear face side to become rounded. As a result, the package body lacks a stable stand-up quality and does not give the impression of a tightly sealed package.

DISCLOSURE OF THE INVENTION

The present invention has been invented in consideration of the aforementioned points, and it is an object thereof to provide a stand-up packaging pouch and a package body provided with a pleat which is formed by folding a part of a packaging material in a three-ply strip-form and adhering the inner surfaces of this folded part and which is provided on at least the lower end of the front face portion and rear face portion or the lower end of the peripheral face portion of the packaging pouch or the package body to conceal a bottom face portion of them, in which the pleat is unlikely to crease and has a pleasing appearance, and particularly in which the pleat is formed in the same plane as the front face portion and rear face portion, or the peripheral face portion, thereby giving the impression of a tight package (i.e., a package having a clear-cut outline), in which the pleat does not appear to be independent, and which may be used as a liquid container due to the complete sealing property of the pleat portion. The present invention comprises the following.

(1) A stand-up packaging pouch which is manufactured in a three dimensional form by hermetically connecting the two edges of a packaging material having a pleat, which extends in an orthogonal direction to the longitudinal direction of the pouch and is formed by folding a portion of the packaging material in a three-ply strip form and adhering the inner surfaces of this folded portion, to thereby form a prismatic tube with angular corners or a prismatic tube with rounded corners having a front face portion, right and left side face portions, and a rear face portion, and by constructing a bottom face portion by folding the lower portion of the tube, wherein the pleat is positioned in the same plane as the front face portion, right and left side face portions, and rear face portion, and extends towards the lower end of the tube such that the bottom face portion and rear face portion of the pleat form a substantial right angle at the upper end of the rear face portion of the pleat, whereby the pleat conceals the bottom face portion.

(2) The stand-up packaging pouch according to the above (1), wherein heat seals are applied in a pinch form to the edge between the front face portion and the side face portions and the edge between the rear face portion and the side face portions to form ribs.

(3) A stand-up packaging pouch provided in a flattened state in which at least a front face portion and a rear face portion are constituted by a packaging material having a pleat which extends in an orthogonal direction to the longitudinal direction of the pouch and is formed by folding a portion of the packaging material in a three-ply strip form and adhering the inner surfaces of this folded portion, and which is provided with side gussets at both sides or one side thereof to form side face portions and has been subjected to a bottom heat seal or a top heat seal, wherein when the stand-up packaging pouch is opened out into a three dimensional state, filled with a product to be packaged, and the opening thereof is sealed, the pleat is provided at least at the edge between the front face portion and a bottom face portion and at the edge between the rear face portion and the bottom face portion in the same plane as the front face portion and rear face portion such that the bottom face portion and rear face portion of the pleat form a substantial right angle at the upper end of the rear face portion of the pleat, thereby concealing the bottom face portion when seen from the direction of the front face portion or rear face portion.

(4) The stand-up packaging pouch according to the above (3), wherein ribs are formed on the two side edges of the front face portion and the two side edges of the rear face portion.

(5) The stand-up packaging pouch according to any one of the above (1) through (4), wherein the pouch is manufactured from a packaging material having the two pleats, the two pleats being positioned on the lower end and upper end of at least the front face portion and rear face portion.

(6) The stand-up packaging pouch according to any one of the above (1) through (4), wherein the pouch is manufactured from a packaging material having the three pleats, the three pleats being positioned on the lower end, upper end, and in an intermediate position of at least the front face portion and rear face portion.

(7) A package body which is formed by filling the stand-up packaging pouch according to any one of the above (1) through (4) with a product to be packaged and sealing the stand-up packaging pouch.

(8) A stand-up packaging pouch which is manufactured in a flattened state from a packaging material having a pleat which extends in an orthogonal direction to the longitudinal direction of the pouch and which is formed by folding a portion of the packaging material in a three-ply strip form and adhering the inner surfaces of this folded portion, and is formed by bending this packaging material such that a horizontal cross section of the bent packaging material forms a loop, closing the two edges of the rear face portion by applying a heat seal thereto to form a flattened tubular form, and applying a top heat seal or a bottom heat seal, wherein when the stand-up packaging pouch is opened into a three dimensional form, filled with a product to be packaged, and the opening thereof is sealed, the pleat is formed in the same curved plane as the peripheral face portion such that the bottom face portion and the rear face portion of the pleat form a substantial right angle at the upper end of the rear face portion of the pleat, whereby the pleat conceals the bottom face portion.

(9) A package body which is constituted by a packaging material having a pleat which extends in an orthogonal direction to the longitudinal direction of a packaging pouch and which is formed by folding a portion of the packaging material in a three-ply strip form and adhering the inner faces of this folded portion, and is formed by bending this packaging material into a loop such that the horizontal cross section forms a flattened circle, closing the two edges in the direction of width by applying a heat seal thereto to form a tubular pouch, filling the tubular pouch with a product to be packaged, and applying a bottom heat seal on the lower end and a top heat seal on the upper end such that the pleat is provided on at least the peripheral edge of the bottom face portion to thereby form a face which extends from the peripheral face portion such that the bottom face portion and rear face portion of the pleat form a substantial right angle at the upper end of the rear face portion of the pleat, whereby the pleat conceals the bottom face portion.

A further object of the present invention is to provide a pleated packaging material feed roll and a manufacturing method for a pleated packaging material feed roll, this feed roll being hooked onto a pouch forming machine or a form-fill-seal machine to continuously mass-produce a pleated flattened pouch or a pleated pillow package body.

(10) A feed roll of packaging material having a pleat which is constituted by a packaging material having a heat sealing property on at least an inner face thereof and on which pleats are formed at a predetermined pitch, extending in a strip form in an orthogonal direction to the direction in which the packaging material is issued, wherein each pleat is formed by folding a portion of the packaging material in a pinch form and heat sealing the inner faces of the folded portion, and is provided in a position spaced by a predetermined distance required to form a pouch bottom face portion in the direction of issuance of the packaging material apart from a predetermined cutting position at which the packaging material is cut in an orthogonal direction to the direction of issuance during pouch manufacture.

(11) A manufacturing method for a pleated packaging material feed roll, comprising:

issuing from a feed roll a packaging material having a heat sealing property on at least the inner face thereof intermittently or continuously;

sliding the outer face of the packaging material onto gap forming plates disposed to form a predetermined gap between the upstream side and downstream side;

piercing the gap between the gap forming plates with a pleat forming plate during a stoppage period in the intermittent motion of the packaging material or during a relative stoppage period in the continuous motion thereof to fold the packaging material such that the inner faces of the folded portion of the packaging material are brought together to form a pleat extending in an orthogonal direction to the direction in which the packaging material is issued;

heat sealing the folded pleat portion and repeating the above steps to form pleat's at a predetermined pitch; and forming a pleated packaging material feed roll by rewinding the wound packaging material with the pleats inclined upstream, or forming a pleated packaging material feed roll by directly winding the packaging material with the pleats inclined downstream.

A further object of the present invention is to provide a manufacturing method for a pleated vertical pillow package body using a vertical form-fill-seal method in which a pleat is suspended around the periphery of the bottom face portion to conceal the bottom face portion such that pleated packaging bodies which can stably stand up and which give the impression of tight packaging can be continuously mass-produced.

(12) A method for manufacturing a pleated vertical pillow package body, comprising:

issuing a packaging material from a packaging material feed roll and heat sealing the inner faces thereof into a pinch form to form pleats in an arrangement pitch of a predetermined dimension, inclined upstream and extending in the direction of width of the packaging material;

hooking the pleated packaging material onto a former and bending the pleated packaging material into a tubular form so as to be wound substantially once around a packaged product filling tube which extends through the inside of the former;

sealing the two edges of the packaging material to form a packaging tube and lowering this packaging tube below the packaged product filling tube;

applying a double heat seal using a double heat sealer to a position on the packaging tube, which is suspended below the packaged product filling tube, apart from the pleat by a predetermined distance;

filling the packaging tube with a product to be packaged by dropping the product to be packaged downward through the packaged product filling tube; and severing the packaging tube between the double heat seal to form a stand-up vertical pillow package body.

(13) A method for continuously manufacturing a stand-up pleated vertical pillow package body, comprising:

issuing a pleated packaging material from a pleated packaging material feed roll;

hooking the pleated packaging material onto a former and bending the pleated packaging material into a tubular form so as to be wound substantially once around a packaged product filling tube which extends through the inside of the former;

sealing the two edges of the packaging material to form a packaging tube and lowering this packaging tube below the packaged product filling tube;

applying a double heat seal using a double heat sealer to a position on the packaging tube, which is suspended below the packaged product filling tube, apart from the pleat by a predetermined distance;

filling the packaging tube with a product to be packaged by dropping the product downward through the packaged product filling tube; and severing the packaging tube between the double heat seal.

(14) The manufacturing method for a pleated vertical pillow package body according to the above (12) or (13), comprising:

bringing the outer face of the feed roll into close contact with the upstream and downstream gap forming plates;

fixing the packaging material between the downstream side gap forming plate and a packaging material pressing plate which corresponds thereto when the intermittent motion of the packaging material is stopped;

causing the pleat folding plate to pierce the gap between the upstream and downstream gap forming plates such that the upstream side of the packaging material is pulled and a pleat is formed;

returning the pleat folding plate to the original position thereof after fixing the upstream side of the folded pleat in the packaging material between the upstream gap forming plate and a packaging material pressing plate which corresponds thereto;

closing a pair of pleat forming heat sealers provided in correspondence with the upstream and downstream gap forming plates to apply a pleat forming heat seal to the portion in which the pleat is formed;

opening the pair of pleat forming heat sealers and returning the upstream and downstream packaging material pressing plates to the original positions thereof; and performing the next intermittent motion of the feed roll.

A further object of the present invention is to provide a manufacturing method for a pleated horizontal pillow package body according to which, by producing a horizontal pillow package body and rotating the completed and severed package body 90 degrees such that the pleat is suspended around the periphery of the bottom face portion to thereby conceal the bottom face portion, a pleated package body having a stable self-standing quality and giving an impression of tight packaging can be obtained.

(15) A manufacturing method for a horizontal pillow package body, comprising:

hooking onto a former a pleated packaging material having pleats each of which extends in an orthogonal direction to the direction in which the packaging material is issued and is formed by sealing the inner faces of each folded portion in the packaging material and inclining the folded portion horizontally, and bending the packaging material into a prismatic tube form;

applying a direct heat seal onto the two edges of the packaging material or applying a heat seal onto strip-form sealing tape which is applied along the inside of the two edges of the packaging material to form a packaging tube in a prismatic tube form;

while transporting the packaging tube continuously, feeding a product to be packaged into the interior of the packaging tube, which is formed inside the former side, so as to be positioned between the adjacent pleats, using an import conveyor;

applying a double heat seal using a double heat sealer to the position of the packaging tube at the position between the products on the downstream side of the former; and severing the packaging tube between the double heat seal.

BRIEF DESCRIPTION OF THE DRAWINGS

FIG. 1(*b*) is a perspective view of the stand-up packaging pouch rotated upside-down and seen from above the rear face. FIG. 1(*c*) is a front view of the outer face side of a packaging material used to manufacture the stand-up packaging pouch. FIG. 1(*d*) is a side view of the packaging material. FIG. 1(*e*) is a perspective view showing the packaging material formed into a prismatic tube. FIG. 1(*f*) is a longitudinal section traversing the center of the left and right side face portions of the stand-up packaging pouch. FIG. 1(*g*) is a perspective view showing the stand-up packaging pouch in which a product is packaged.

FIG. 3(*a*) is a perspective view of the stand-up packaging pouch seen from above the rear face. FIG. 3(*b*) is a perspective view showing the stand-up packaging pouch in which a product to be packaged is packaged.

FIG. 4(*a*) shows a perspective view of the stand-up packaging pouch. FIG. 4(*b*) shows a cross-section along the b—b line in FIG. 4(*a*). FIG. 4(*c*) shows a perspective view of the stand-up packaging pouch opened out into three dimensions. FIG. 4(*d*) is a perspective view of a pleated packaging material, which is used for manufacturing the stand-up packaging pouch, seen from the inner face side. FIG. 4(*e*) is a perspective view of a flattened tube formed with a pair of folded-in side gussets used for manufacturing this stand-up packaging pouch.

FIG. 5(*a*) shows a perspective view of the stand-up packaging pouch, and FIG. 5(*b*) shows a perspective view of the stand-up packaging pouch opened out into three dimensions. FIG. 5(*c*) is a cross section along the c—c line in FIG. 5(*a*). FIG. 5(*d*) is a perspective view of a pleated packaging material which is used for manufacturing this stand-up packaging pouch. FIG. 5(*e*) is a perspective view of a flattened tube formed with a pair of folded-in side gussets used for manufacturing this stand-up packaging pouch.

FIG. 6(*a*) shows a perspective view of the stand-up packaging pouch, and FIG. 6(*b*) shows a perspective view of the stand-up packaging pouch opened out into three dimensions. FIG. 6(*c*) is a horizontal section of the stand-up packaging pouch when opened out into three dimensions.

FIG. 7(*a*) shows a perspective view of the stand-up packaging pouch, FIG. 7(*b*) shows a cross-section along the b—b line in FIG. 7(*a*), and FIG. 7(*c*) shows a perspective view of the stand-up packaging pouch opened out into three dimensions. FIG. 7(*d*) is a perspective view of a pleated packaging material which is used for manufacturing this stand-up packaging pouch. FIG. 7(*e*) is a perspective view of a flattened tube formed with a pair of folded-in side gussets used for manufacturing this stand-up packaging pouch.

FIG. 8(*a*) shows a perspective view of the stand-up packaging pouch. FIG. 8(*b*) shows a perspective view of the stand-up packaging pouch opened out into three dimensions. FIG. 8(*c*) is a cross section along the c—c line in FIG. 8(*a*). FIG. 8(*d*) is a perspective view of a pleated packaging material which is used for manufacturing the stand-up packaging pouch. FIG. 8(*e*) is a perspective view of a flattened tube formed with a pair of folded-in side gussets and ribs used for manufacturing the stand-up packaging pouch.

FIG. 9(*a*) shows a perspective view of the stand-up packaging pouch, and FIG. 9(*b*) shows a perspective view of the stand-up packaging pouch opened out into three dimensions. FIG. 9(*c*) is a perspective view of a pleated packaging material which is used for manufacturing the stand-up packaging pouch. FIG. 9(*d*) is a perspective view of a flattened tube formed with a pair of folded-in side gussets used for manufacturing the stand-up packaging pouch.

FIG. 10(*a*) shows a perspective view of the stand-up packaging pouch, and FIG. 10(*b*) shows a perspective view of the stand-up packaging pouch opened out into three dimensions. FIG. 10(*c*) is a horizontal section of the stand-up packaging pouch when opened out into three dimensions (a cross section along the c—c line in FIG. 10(*b*)). FIG. 10(*d*) is a perspective view showing an exploded state of the disposal of each of the webs constituting the stand-up packaging pouch. FIG. 10(*e*) is a perspective view showing a flattened tube having side gussets.

FIG. 11(*a*) shows a perspective view of the stand-up packaging pouch, and FIG. 11(*b*) shows a perspective view of the stand-up packaging pouch opened out into three dimensions. FIG. 11(*c*) is a horizontal section of the stand-up packaging pouch when opened out into three dimensions. FIG. 11(*d*) is a perspective view showing an exploded state of the disposal of each of the webs constituting the stand-up packaging pouch. FIG. 11(*e*) is a perspective view showing a flattened tube having side gussets.

FIG. 12(*a*) shows a perspective view of the stand-up packaging pouch, and FIG. 12(*b*) shows a perspective view of the stand-up packaging pouch opened out into three dimensions. FIG. 12(*c*) is a horizontal section of the stand-up packaging pouch when opened out into three dimensions. FIG. 12(*d*) is a perspective view showing an exploded state of the disposal of each of the webs constituting the stand-up packaging pouch. FIG. 12(*e*) is a perspective view showing a flattened tube having side gussets.

FIG. 13(*a*) shows a perspective view of the stand-up packaging pouch. FIG. 13(*b*) shows a perspective view of the stand-up packaging pouch opened out into three dimensions. FIG. 13(*c*) is a perspective view showing an exploded state of the disposal of each of the webs constituting the stand-up packaging pouch. FIG. 13(*d*) is a perspective view showing the stand-up packaging pouch opened out into three dimensions, filled with a product to be packaged, with the opening thereof closed, and thus formed into a package body. FIG. 13(*e*) is a perspective view showing six packaging bodies gathered together and displayed in a hexagonal prismatic form.

FIG. 14(*a*) shows a perspective view of the stand-up packaging pouch. FIG. 14(*b*) shows a perspective view of the stand-up packaging pouch opened out into three dimensions. FIG. 14(*c*) is a perspective view of the stand-up packaging pouch filled with a packaged product and with the opening thereof closed to form a package body. FIG. 14(*d*) is a perspective view of a packaging material provided with a pleat. FIG. 14(*e*) is a perspective view showing the packaging material with the two edges thereof connected with connecting tape to form a flattened tube.

FIG. 15(*a*) shows a perspective view of the stand-up packaging pouch. FIG. 15(*b*) shows a perspective view of the stand-up packaging pouch opened out into three dimensions. FIG. 15(*c*) is a perspective view of the stand-up packaging pouch filled with a packaged product and with the opening thereof closed to form a package body. FIG. 15(*d*) is a perspective view of a pleated packaging material. FIG. 15(*e*) is a perspective view showing the packaging material with the two edges thereof connected with connecting tape to form a flattened tube.

FIG. 16(*a*) shows a perspective view of the stand-up packaging pouch. FIG. 16(*b*) shows a perspective view of the stand-up packaging pouch opened out into three dimensions. FIG. 16(*c*) is a perspective view of the stand-up packaging pouch filled with a packaged product and with the opening thereof closed to form a package body. FIG. 16(*d*) is a perspective view of a pleated packaging material. FIG. 16(*e*) is a perspective view showing the packaging material with the two edges thereof connected with connecting tape to form a flattened tube.

FIG. 17(*a*) is a perspective view of a pleated packaging material. FIG. 17(*b*) is a perspective view showing the packaging material with the two edges thereof connected with connection tape to form an elliptical tube. FIG. 17(*c*) is a perspective view of the stand-up packaging pouch formed with the application of a top heat seal to the elliptical tube. FIG. 17(*d*) is a perspective view of the stand-up packaging pouch filled with a packaged product and with the opening thereof closed to form a package body. FIG. 17(*e*) is a perspective view showing the package body provided with a bottom gusset, and FIG. 17(*f*) is a perspective view showing the package body with a folded bottom face portion.

FIG. 21(*a*) is a perspective view of a pleated packaging material. FIG. 21(*b*) is a perspective view showing the packaging material formed into a flattened tube having a pleat. FIG. 21(*c*) is a perspective view showing the tube opened into a prismatic tubular form. FIG. 21(*d*) is a view seen from the tubular direction of side gussets being inserted. FIG. 21(*e*) is a perspective view showing the flattened tube inserted with side gussets. FIG. 21(*f*) is a perspective view showing the side-pleated flattened tube with side-gussets wherein ribs are formed on both edges of each side face portion. FIG. 21(*g*) is a cross section along the g—g line in FIG. 21(*f*). FIG. 21(*h*) is a perspective view of a pleated flattened pouch of a type having an upper end opening. FIG. 21(*i*) is a perspective view showing the pleated flattened pouch opened out into three dimensions. FIG. 21(*j*) is a perspective view showing the pouch filled with a packaged product and sealed at the opening.

FIG. 22(*a*) is a schematic overall plan view of a pouch manufacturing device which is capable of mass-producing the pleated flattened pouch shown in FIG. 21. FIG. 22(*b*) is a cross section along the A—A line in FIG. 22(*a*). FIG. 22(*c*) is a cross section along the C—C line in FIG. 22(*a*). FIG. 22(*d*) is across section along the E—E line in FIG. 22(*a*).

FIG. 23(*a*) is a perspective view of the pleated packaging material. FIG. 23(*b*) is a perspective view of the pleated packaging material formed into a flattened tube. FIG. 23(*c*) is a perspective view showing a pleated flattened pouch of a type having a bottom seal applied to form an upper end opening FIG. 23(*d*) is a perspective view showing a pleated flattened pouch with the upper portion opened. FIG. 23(*e*) is a perspective view showing a pleated flattened pouch filled with a packaged product, with the opening closed, and with a top heat seal applied.

FIG. 24(*a*) shows a perspective view of an upper end opening type pleated flattened pouch, and FIG. 24(*b*) shows a perspective view of the pleated flattened pouch opened out in three dimensions. FIG. 24(*c*) is a cross section along the c—c line of FIG. 24(*b*). FIG. 24(*d*) is a perspective view showing an exploded state of the disposal of the packaging material pieces which constitute the pleated flattened pouch. FIG. 24(*e*) is a perspective view showing a pleated flattened tube provided with side gussets.

BEST MODE FOR CARRYING OUT THE INVENTION

A stand-up packaging pouch and package body according to a first embodiment of the present invention will be described with reference to FIG. 1.

This embodiment comprises the stand-up packaging pouch described above in (1) and the package body described above in (7).

Figure 1:
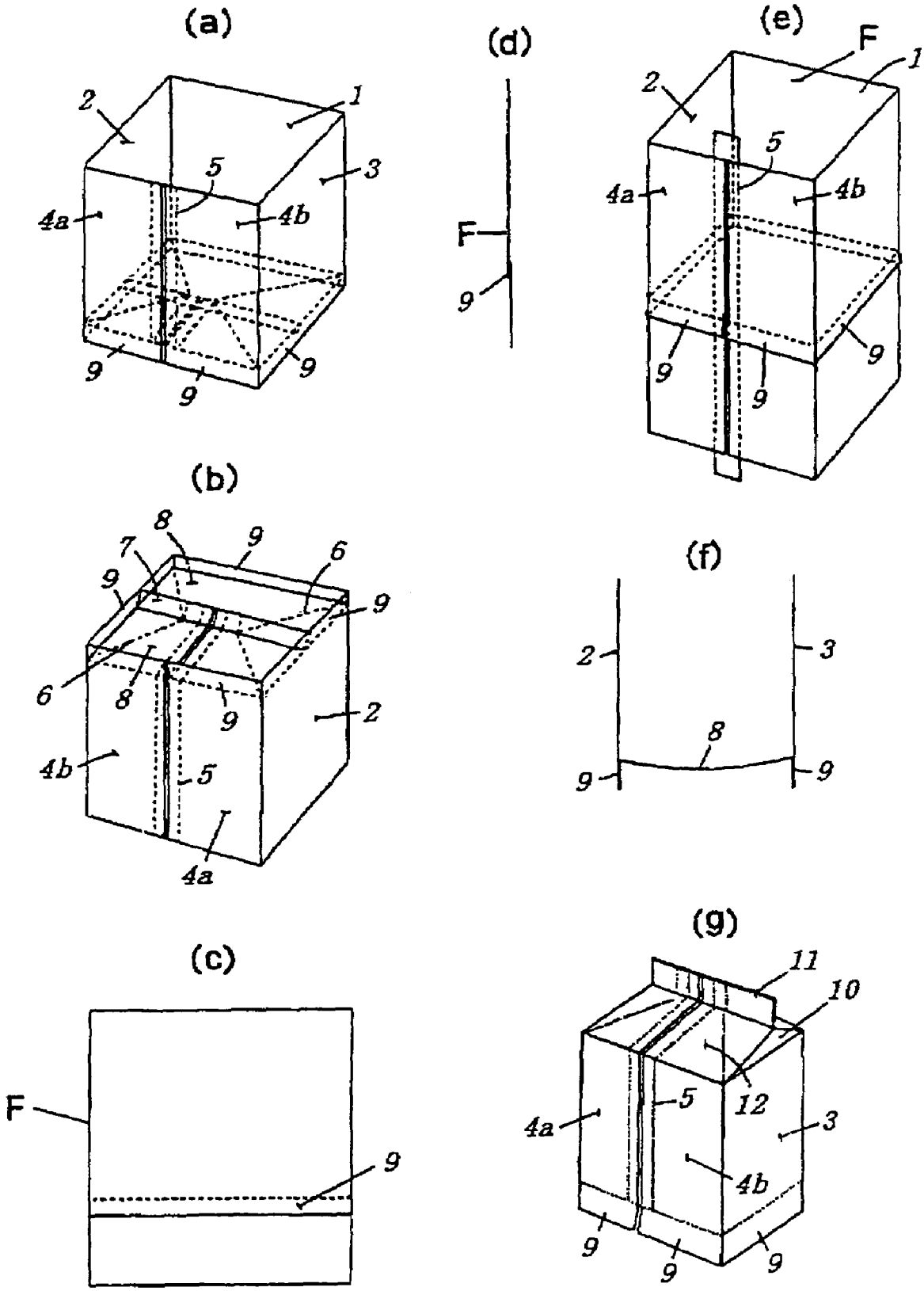
FIG. 1(*a*) is a perspective view of a stand-up packaging pouch seen from above the rear face.

FIG. 1(*a*) is a perspective view of a stand-up packaging pouch seen from above the rear face. FIG. 1(*b*) is a perspective view of the stand-up packaging pouch rotated upside-down and seen from above the rear face.

This stand-up packaging pouch is formed by folding a single sheet of packaging material to form a prismatic tube form having a front face portion 1, a right side face portion 2, a left side face portion 3, a rear face portion 4*a* extending from the right side face portion 2, and a rear face portion 4*b* extending from the left side face portion 3, abutting the edges of the rear face portions 4*a*, 4*b* so that no gap exists therebetween, sealing the inner side of the rear face portions 4*a*, 4*b* by applying a three-ply connecting tape 5 comprising a double-sided sealant film and performing heat sealing to connect the rear face portions 4*a*, 4*b* and form a prismatic tube, inserting a bottom gusset 6 in the lower portion of the two side faces of the prismatic tube to align the lower portions of the front and rear faces, and applying a bottom heat seal 7 such that the edges form a pinch pleat to thereby form a bottom face portion 8.

FIG. 1(*c*) is a front view of the outer face side of a packaging material used to manufacture the stand-up packaging pouch. FIG. 1(*d*) is a side view of the packaging material. FIG. 1(*e*) is a perspective view showing the packaging material formed into a prismatic tube. FIG. 1(*f*) is a longitudinal section traversing the center of the left and right side face portions of the stand-up packaging pouch.

As shown in FIGS. 1(*c*), (*d*), the characteristic constitution of this stand-up packaging pouch is in the fact that a pleat 9 is provided in the planar packaging material F extending in strip form in an orthogonal direction to the longitudinal direction of the pouch and folded back so as to form three layers, the inner surfaces of this folded back portion being adhered together to form a hem (a creased edge) when the packaging material F is formed into a prismatic tube as shown in FIG. 1(*e*). Then, when folds are made to form the bottom face portion 8, as shown in FIGS. 1(*a*), (*b*), the pleat 9 is suspended from the edges of the front face portion 1 and the bottom face portion 8, the right side face portion 2 and the bottom face portion 8, the left side face portion 3 and the bottom face portion 8, the rear face portion 4*a* and the bottom face portion 8, and the rear face portion 4*b* and the bottom face portion 8 to thereby conceal the bottom face portion 8.

In FIG. 1(*f*), the pleat 9 is suspended from the edges of the right side face portion 2 and the bottom face portion 8, and the left side face portion 3 and the bottom face portion 8.

Thus the pleat 9 can be formed easily and favorably to obtain a pleat 9 with a pleasing appearance and no likelihood of creasing. Since the pleat 9 is positioned on the lower edges of the front face portion 1, right side face portion 2, left side face portion 3, and rear face portions 4*a*, 4*b* and in the same plane as the front face portion 1, right side face portion 2, left side face portion 3, and rear face portions 4*a*, 4*b*, the pleat 9 does not appear to be independent therefrom and thus an impression of a tightly sealed package is obtained. Moreover, since the pleat 9 is not formed by heat sealing the edges of two sheets of film in a pinch form, but rather is formed by folding back the packaging material F and adhering the inner surfaces of the folded back part together, no seams exist, and thus complete hermetic sealing can be ensured, making the pouch suitable for use as a liquid container.

The packaging material F used for manufacturing the stand-up packaging pouch is constituted by the following laminated film, for example.

1. OPP 20 μm/adhesive/LLDPE 20 μm . . . (outer layer/inner layer: sealant)
2. OPP 20 μm/adhesive/uniaxial oriented or biaxial oriented HDPE/adhesive/LLDPE . . . (outer layer/intermediate layer/inner layer: sealant)
3. OPP 20 μm/adhesive/aluminum foil/adhesive/LLDPE 20 μm. (outer layer/intermediate layer/inner layer: sealant)

4. OPP (silica or alumina deposited layer)/adhesive/uniaxial oriented or biaxial oriented HDPE/adhesive/LLDPE 20 μm . . . (outer layer/intermediate layer/inner layer: sealant)
5. PET 20 μm/adhesive/aluminum foil/adhesive/OPP 20 μm/adhesive/LLDPE 20 μm. (outer layer/intermediate layer/intermediate layer/inner layer: sealant)
6. Paper/adhesive/LLDPE 50 μm . . . (outer layer/inner layer: sealant)
7. PET 12 μm/adhesive/LLDPE 20 μm . . . (outer layer/inner layer: sealant)
8. Al 9 μm/adhesive/LLDPE 70 μm . . . (outer layer/inner layer: sealant)
9. PET •SiOx 12 μm/adhesive/LLDPE . . . (outer layer/inner layer: sealant)
10. CPP 5 μm •OPP 30 μm co-extruded/adhesive/CPP 20 μm . . . (outer layer/inner layer; inner/outer face sealant)

OPP: Oriented polypropylene
LLDPE: Linear low density polyethylene
HDPE: High density polyethylene
PET: Polyethylene terephthalate
Al: Aluminum
CPP: Cast polypropylene LLDPE and CPP are used as a sealant.

In FIG. 1(*c*), the part of the packaging material F extending upward from the base portion of the pleat 9 corresponds to the peripheral face portion, i.e., the front face portion, the right and left side face portions, and the right and left rear face portions, of the pouch, whereas the part of the packaging material F extending downward from the base portion of the pleat 9 corresponds to the bottom face portion of the pouch.

The pleat 9 has a two-ply adhered part (two adhered layers), and the outer faces of the three-fold strip-form part are not adhered. The pleat 9 is inclined downward.

It is preferable that heat sealing be used as the adhesion method for making a two-ply adhere part in the packaging material F to form the pleat 9. However, an adhesion method using an adhesive may also be applied. In order to form the pleat 9 by heat sealing, at least the inner face of the packaging material F must be constituted by a sealant film. Note that the packaging material F may be constituted by a sealant film alone.

Next, a preferred example of a method for forming the pleat 9 will be described.

Packaging material is placed on a flat plane having a linear gap with the inner surface side of the packaging material facing upward. A thrusting plate, not shown, which is positioned directly above the linear gap, is thrust into the packaging material to form a valley fold of an appropriate depth. Once the upper surface of the packaging material on the two sides of the valley fold portion has been pressed onto the flat plane, the thrusting slope is raised upward to its original position and a pair of heat sealing bars provided on the lower side of the thrusting slope are closed to form the valley fold portion into a butt-seal. The butt-seal is then removed, as a pleat, from the gap in the flat plane and inclined sideways to form the strip-form three-ply part.

To form the prismatic tube in FIG. 1(*e*) from the packaging material F in FIG. 1(*c*), the packaging material F is wrapped once around a prismatic tube mandrel, not shown, for example, whereupon hems (a vertical fold lines) are formed on the four edges to thereby fold the packaging material F into a prismatic tube having a front face portion 1, a right side face portion 2, a left side face portion 3, a rear face portion 4*a* extending from the right side face portion 2, and a rear side portion 4*b* extending from the left side face portion 3. The two edges of the packaging material F are then abutted without leaving a gap and a three-ply connecting tape 5 constituted by double-sided sealant film is applied to seal the inner side thereof. A heat sealer is then pressed onto the prismatic tube mandrel from the outside of the prismatic tube mandrel in order to heat seal the two edges to the connecting tape 5, thus forming a prismatic tube form.

The reason for employing a three-layer film constituted by oriented film laminated on both sides with a sealant film as the connecting tape 5 is to insure the heat seal between the connecting tape 5 and the rear face portions 4*a* and 4*b* extending from the right side face portion 2 and the left side face portion 3 respectively, and to insure the bottom heat seal 7. Note that an identical material to the sealant film on the inner surface layer of the packaging material F is selected as the sealant film of the connecting tape 5.

When forming a polygonal bottom, the upper end (base end) of the pleat 9 is aligned with the lower end of the prismatic tubular mandrel such that the pleat 9 is suspended below the prismatic tubular mandrel. In so doing, the periphery of the polygonal bottom matches the lower end of the prismatic tubular mandrel and thus a slightly inclined hipped bottom face portion 8 inserted with a bottom gusset 6 can be formed. The pleat 9 is suspended therebelow all around the periphery. The length of the pleat 9 may be set freely at the design stage. If the pleat 9 is made long, then the bottom face portion 8 remains unseen on the inside of the pleat 9 even if the hipped bottom face portion 8 sags.

FIG. 1(*g*) is a perspective view showing the stand-up packaging pouch in sealed form.

By filling the stand-up packaging pouch shown in FIG. 1(*a*) with a product to be packaged (not shown) and, as shown in FIG. 1(*f*), inserting a top gusset 10 by folding the upper central portion of the two side faces 2, 3, abutting the upper edges of the front face portion 1 and the rear face portions 4*a*, 4*b*, and applying a top heat seal 11 to thereby form a hipped upper face portion 12 inserted with atop gusset, the stand-up packaging pouch in sealed from as shown in FIG. 1(*g*) is created.

Figure 3:
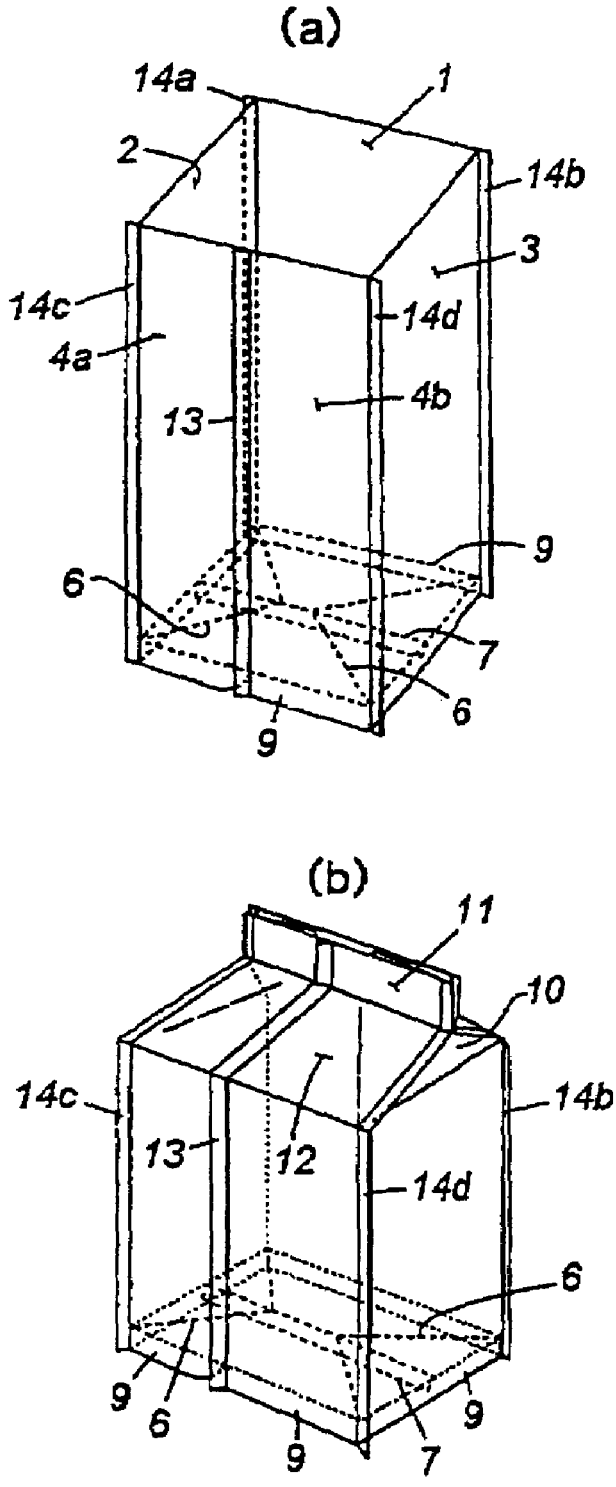
FIG. 3 shows a stand-up packaging pouch according to a second embodiment of the present invention.

The following modified examples may be applied to the stand-up packaging pouch of FIGS. 1 and 3.

The stand-up packaging pouch may be manufactured from packaging material with two pleats such that the two pleats are positioned on the lower edge and upper edge of at least the front face portion and rear face portion. Alternatively, the stand-up packaging pouch may be manufactured from packaging material with three pleats such that the three pleats are positioned on the lower edge, in an intermediate position, and on the upper edge of at least the front face portion and rear face portion.

Figure 2:
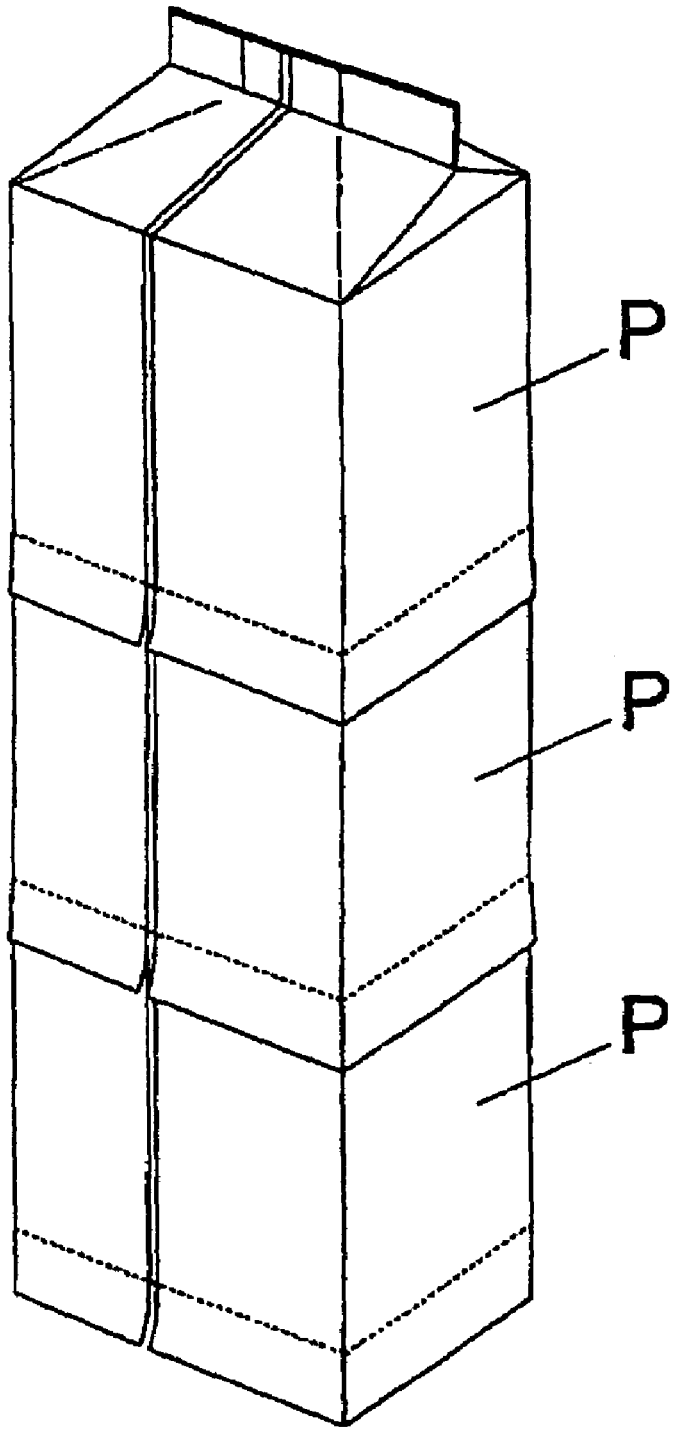
FIG. 2 is a perspective view showing a plurality of stand-up packaging pouches according to a first embodiment of the present invention in which they are displayed in a stacked form.

As shown in FIG. 2, when a plurality of the package bodies P are to be displayed in a stacked formation, the pleat length is increased. In so doing, the hipped upper face portion of the lower stand-up packaging pouch can be concealed with stability inside the pleat of the upper overlapping stand-up packaging pouch, and thus the pouches can be displayed in a multiple-level stacked formation.

A stand-up packaging pouch and package body according to a second embodiment of the present invention will now be described with reference to FIG. 3.

This embodiment comprises the stand-up packaging pouch described in above in (1) and (2) and the package body described above in (7).

FIG. 3(*a*) is a perspective view of the stand-up packaging pouch seen from above the rear face. FIG. 3(*b*) is a perspective view showing the stand-up packaging pouch in sealed form.

In contrast to the stand-up packaging pouch of FIG. 1, the connecting tape 5 is not used in this stand-up packaging pouch and the packaging material F is formed into a prismatic tube by forming a pinch-type vertical heat seal 13 between the rear face portions 4*a*, 4*b*. This stand-up packaging pouch also differs from the stand-up packaging pouch of FIG. 1(*c*) in that four ribs 14*a*, 14*b*, 14*c*, 14*d* having a similar sectional construction to the pleat 9 are formed on the four corners by adhering the inner surfaces and applying a heat seal. In all other parts, the constitution of this stand-up packaging pouch is identical to the stand-up packaging pouch of FIG. 1(*a*).

Accordingly, the pleat 9 is suspended around the entire periphery and conceals the bottom face portion 8.

Note that the pleat 9 is held on the inside of the inclined side of the vertical heat seal 13.

The stand-up packaging pouch shown in FIG. 3(*b*) is filled with a product to be packaged (not shown) and a hipped upper face portion with a top gusset is formed as shown in FIG. 3(*b*).

The stand-up packaging pouch of FIG. 1 and the stand-up packaging pouch of FIG. 3 are manufactured into three dimensions by forming a pleat 9 on a sheet-form packaging material, forming the material into a prismatic tube, and forming a bottom face portion with a bottom gusset. However, the two edges of the packaging material may be closed together by adhering the inner face of one of the edges to the outer face of the other edge to form a so-called "envelope seal". In this case, by cutting the outside part of the double edge of the inner side pleat 9 into the required form, cutting the inside part of the double edge of the outer side pleat 9 into the required form, and then overlapping and heat sealing these two parts, the two sides of the pleat 9 at the part where the packaging material is closed together is brought into the state like a single sheet. Further, the position at which the two edges of the packaging material in the horizontal direction are closed together may be in the vicinity of the edge between the right side face and the tear face portion, for example, rather than in the center of the rear face portion.

Since the stand-up packaging pouch of FIG. 1 and the stand-up packaging pouch of FIG. 3 are manufactured three-dimensionally, they cannot be stacked up. The stand-up packaging pouches are manufactured, filled with a product to be packaged, and formed with a hipped upper face portion having a top gusset using a form-fill-seal machine.

When a vertical-type form-fill-seal machine is used, pleats are made at equal intervals in a continuous supply of packaging material, whereupon the packaging material is led between a former and a drop-down type product filling tube and folded into a prismatic tubular from. The prismatic tube is then completed by center sealing the edges, whereupon the prismatic tube is suspended below the product filling tube, the top face portion having a bottom gusset is formed, and the prismatic tube is filled from above with a product to be packaged. Then, the bottom face portion having a top gusset is formed, the top heat seal is applied and cut, and thus the packaged form as shown in FIG. 1(*g*) is obtained. If ribs are added, the packaged form as shown in FIG. 3(*b*) is obtained.

A stand-up packaging pouch and package body according to a third embodiment of the present invention will now be described with reference to FIG. 4.

This embodiment comprises the stand-up packaging pouch described above in (3) and the package body described above in (7).

Figure 4:
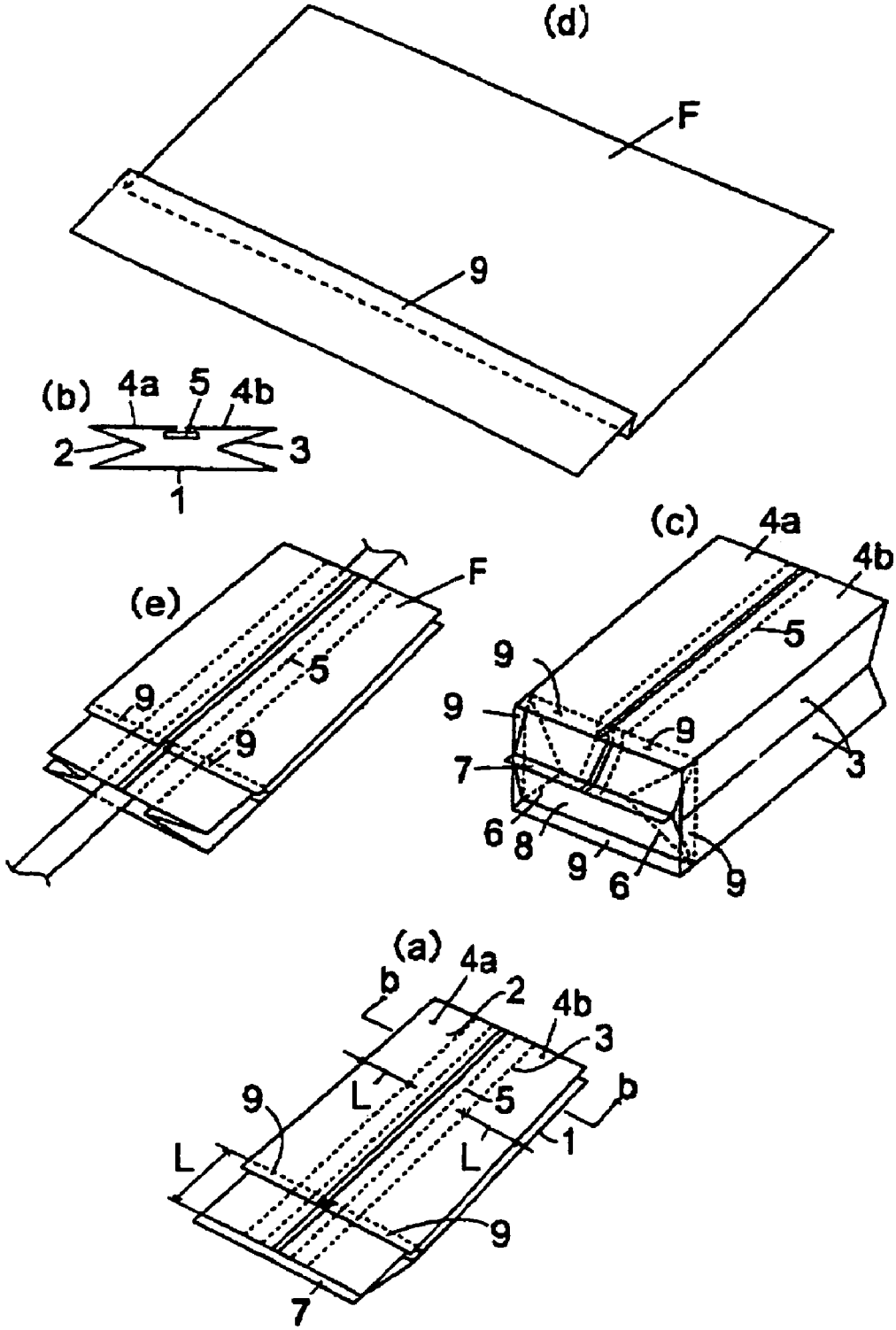
FIG. 4 shows a stand-up packaging pouch according to a third embodiment of the present invention.

FIG. 4(*a*) shows a perspective view of the stand-up packaging pouch. FIG. 4(*b*) shows a cross-section along the b—b line in FIG. 4(*a*). FIG. 4(*c*) shows a perspective view of the stand-up packaging pouch opened out into three dimensions.

The stand-up packaging pouch of this embodiment is manufactured as a flattened pouch and opened out into three dimensions when being filled.

As shown in FIG. 1(*c*), this stand-up packaging pouch is formed into a prismatic tube by wrapping the packaging material F formed with the pleat 9 once around a prismatic tubular mandrel, not shown, whereupon the front face portion 1, right side face portion 2, left side face portion 3, rear face portion 4*a* extending from the right side face portion 2, and rear side portion 4*b* extending from the left side face portion 3 are folded to provide a prism-like tubular form, the two edges of the packaging material F are abutted without leaving a gap, the three-ply connecting tape 5 constituted by double-sided sealant film is applied to seal the inner side the abutted edges, and a heat sealer is pressed onto the prismatic tube mandrel from the outside in order to heat seal the two edges to the connecting tape. After folding the packaging material with the pleat 9 into a prismatic tube form, abutting the edges, applying the connecting tape 5 to the inside thereof and closing the edges together by means of a heat seal, the right side face portion 2 and left side face portion 3 are folded inward in two so as to be inserted between the front face portion 1 and rear face portions 4*a*, 4*b*, thus serving as a pair of side gussets, whereupon the bottom heat seal 7 is applied to the lower end and the upper end becomes a pouch opening.

This stand-up packaging pouch is characterized in that the side gussets formed by folding the right side face portion 2 and left side face portion 3 in two extend to the lower edge of the pouch in flattened form, in that the pleat 9 is provided in a position removed from the base end of the pouch in flattened form by a substantially equal distance to the width L of the fold in the side gussets, and in that when the pouch is opened out into three dimensions, ear-pocket shaped triangular bottom gussets 6 are formed on both sides of the part below the pleat 9, and thus this part opens out laterally to form the bottom face portion 8 with the pleat 9 suspended around the entire periphery to conceal the bottom face portion 8.

The noteworthy characteristics of this flat pouch with a pleat and side gussets are the provision of the pleat 9 and the novel three way gusset comprised in the pouch due to the provision of the pleat 9.

Conventionally, a gusset indicates an inward twofold folding.

For example, Japanese Patent Application Publication No. 59-74065 discloses a conventional flat pouch with a three way gusset. In this flattened pouch, a continuous flat tube having side gussets is formed, whereupon a bottom heat seal is applied and the periphery thereof is cut. The bottom portion of the pouch is then opened out into three dimensions and folded inward in two to form a bottom gusset. As a result, multiple folds are formed at the part where the bottom gusset interferes with the side gussets such that when the pouches are stacked, the bottom portion side becomes markedly bulky, creating an inconvenience in that the pouches cannot be stacked horizontally.

In the stand-up packaging pouch according to this embodiment, the pleat 9 is provided, and thus when the pouch is opened out in three dimensions, the part below the pleat 9 opens out laterally to form the bottom face portion 8. Hence the gusset in this case may be referred to as an outward-folding type bottom gusset in contrast to the conventional inward-folding type bottom gusset, and is advantageous in being concealed inside the pleat 9, in that the fold overlap between the bottom gusset and side gussets is not multiple, and in that the inconvenience caused by the marked bulkiness of the bottom portion side when the pouches are stacked, leading to the inability to stack the pouches horizontally, is absent.

FIG. 4(*d*) is a perspective view of pleated packaging material which is used for manufacturing the stand-up packaging pouch seen from the inner face side. FIG. 4(*e*) is a perspective view of a flattened tube formed with a pair of folded-in side gussets used for manufacturing the stand-up packaging pouch.

To manufacture this stand-up packaging pouch, the packaging material F (identical to the packaging material shown in FIG. 1(*c*)) formed with the pleat 9 as shown in FIG. 4(*d*) is used to form a prismatic tube as shown in FIG. 1(*e*). Folds are then inserted into the two side faces to form a pair of side gussets and to flatten the tube, and once the flattened tube shown in FIG. 4(*e*) has been formed, the bottom heat seal 7 is applied as shown in FIG. 4(*a*) to thereby form a flattened pouch.

To seal the pouch, the flattened pouch is opened out in three dimensions as shown in FIG. 4(*c*), the pouch is filled with a product to be packaged (not shown), and the hipped upper face portion 12 with a top gusset is formed as shown in FIG. 1(*g*).

As opposed to the stand-up packaging pouch of FIG. 1, the stand-up packaging pouch of FIG. 4 is manufactured as a flattened pouch having a three way gusset.

A stand-up packaging pouch and package body according to a fourth embodiment of the present invention will now be described with reference to FIG. 5.

This embodiment comprises the stand-up packaging pouch described above in (3) and (4) and the package body described above in (7).

Figure 5:
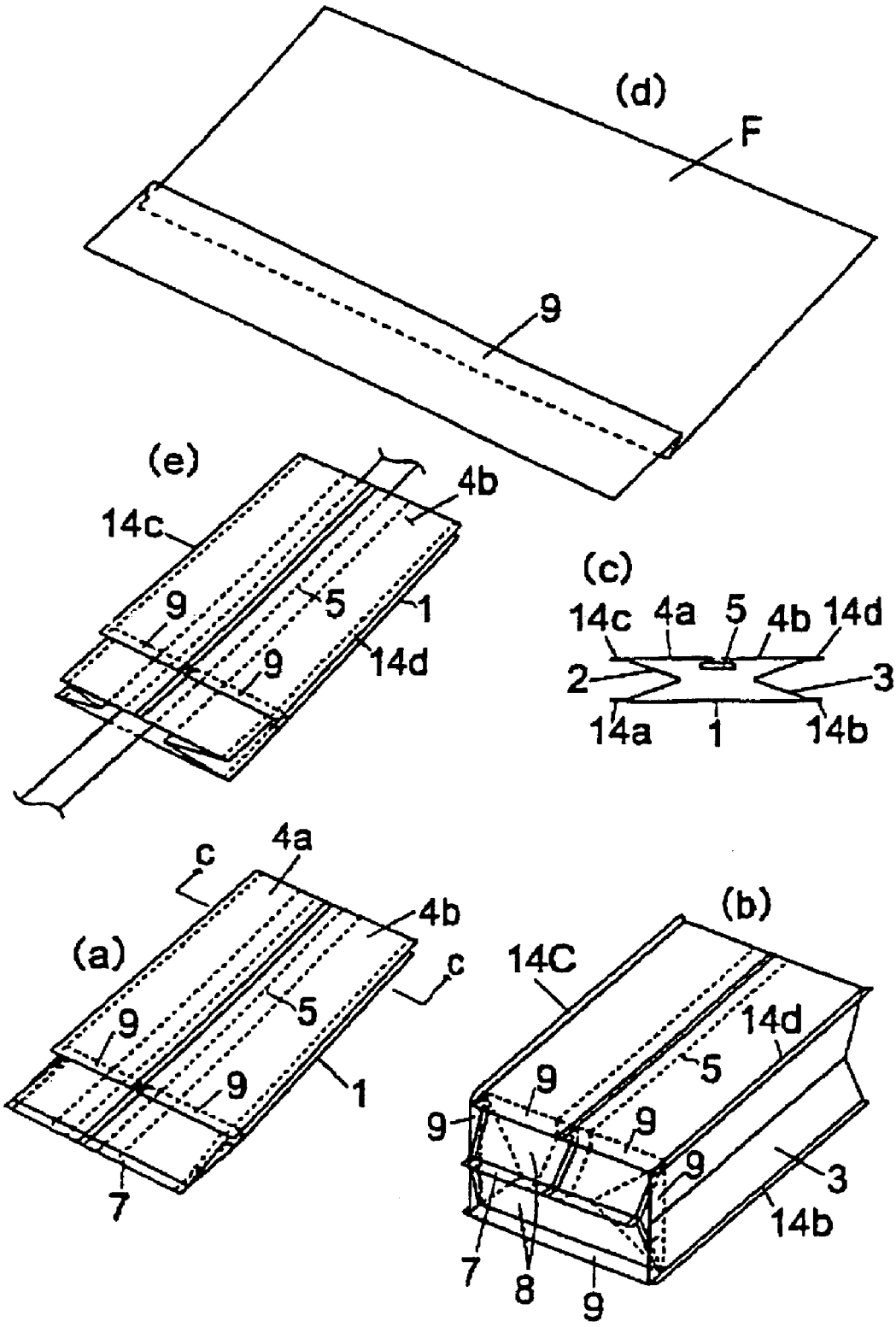
FIG. 5 shows a stand-up packaging pouch according to a fourth embodiment of the present invention.

FIG. 5(*a*) shows a perspective view of the stand-up packaging pouch, and FIG. 5(*b*) shows a perspective view of the stand-up packaging pouch opened out into three dimensions. FIG. 5(*c*) is a cross section along the c—c line in FIG. 5(*a*).

Similarly to the stand-up packaging pouch shown in FIG. 4(*a*), this stand-up packaging pouch is manufactured as a flattened pouch.

The constitution of this stand-up packaging pouch is characterized in comprising four ribs 14*a*, 14*b*, 14*c*, 14*d* as well as the pleat 9.

The difference between this stand-up packaging pouch and the stand-up packaging pouch shown in FIG. 4(*a*) lies in the presence of the four ribs 14*a*, 14*b*, 14*c*, 14*d*.

The difference between this stand-up packaging pouch and the stand-up packaging pouch shown in FIG. 3(*a*) lies in the fact that the former has side gussets and is manufactured as a flattened pouch, whereas the latter has no side gussets and is manufactured as a three-dimensional pouch.

This difference relates to the fact that the former are manufactured, stacked, and bundled by a package maker and then sold to a food manufacturing company to be opened out into three dimensions, filled with a product, and sealed at the opening by a form-fill-seal machine, whereas the latter are mechanically folded and formed from sheet-form packaging material by a form-fill-seal machine in a food manufacturing company and then filled with product and sealed at the opening there and then.

FIG. 5(*d*) is a perspective view of pleated packaging material which is used for manufacturing the stand-up packaging pouch. This packaging material is identical to the packaging material shown in FIG. 4(*d*). FIG. 5(*e*) is a perspective view of a flattened tube formed with a pair of folded-in side gussets used for manufacturing the stand-up packaging pouch.

To manufacture this stand-up packaging pouch, the packaging material F with the pleat 9 shown in FIG. 5(*d*) is used to form a prismatic tube as shown in FIG. 1(*e*). Folds are then inserted into the two side faces to form a pair of side gussets and to flatten the tube, whereupon a heat seal is applied to the two side edges of the flattened tube as shown in FIG. 5(*e*). The ribs 14*a*, 14*b*, 14*c*, 14*d* are then created and the bottom heat seal 7 is applied as shown in FIG. 5(*a*) to thereby form a flattened pouch.

To seal the pouch, the flattened pouch is opened out in three dimensions as shown in FIG. 5(*b*), the pouch is filled with a product to be packaged (not shown), and the hipped upper face portion 12 with a top gusset is formed as shown in FIG. 1(*g*). When the pouch is opened into three dimensions, the part below the pleat 9 opens out laterally to form the bottom face portion 8, and the pleat 9 is suspended around the entire periphery so as to conceal the bottom face portion 8. The pleat 9 is formed as an upper extending edge of the peripheral surface, and therefore clearly defines the bottom face portion from the peripheral surface, giving an impression of clear folding line.

As a modified example of the stand-up packaging pouches according to the embodiments as shown in FIGS. 4 and 5, a flattened pouch with side gussets may be formed by applying a top seal, rather than applying a bottom heat seal, at the opposite side following the formation of the flattened tube having inserted side gussets.

In this pouch, the tube is turned over such that the product to be packaged is filled into the opened bottom face. The part above the pleat is then closed and a bottom heat seal is applied to form a bottom face portion, whereupon the resultant package body is returned to its original position. This modified example is included in the stand-up packaging pouch described in the aforementioned (3) and (4) and the package body described in the aforementioned (7).

A stand-up packaging pouch and package body according to a fifth embodiment of the present invention will now be described with reference to FIG. 6.

This embodiment comprises the stand-up packaging pouch described above in (3) and (4) and the package body described above in (7).

Figure 6:
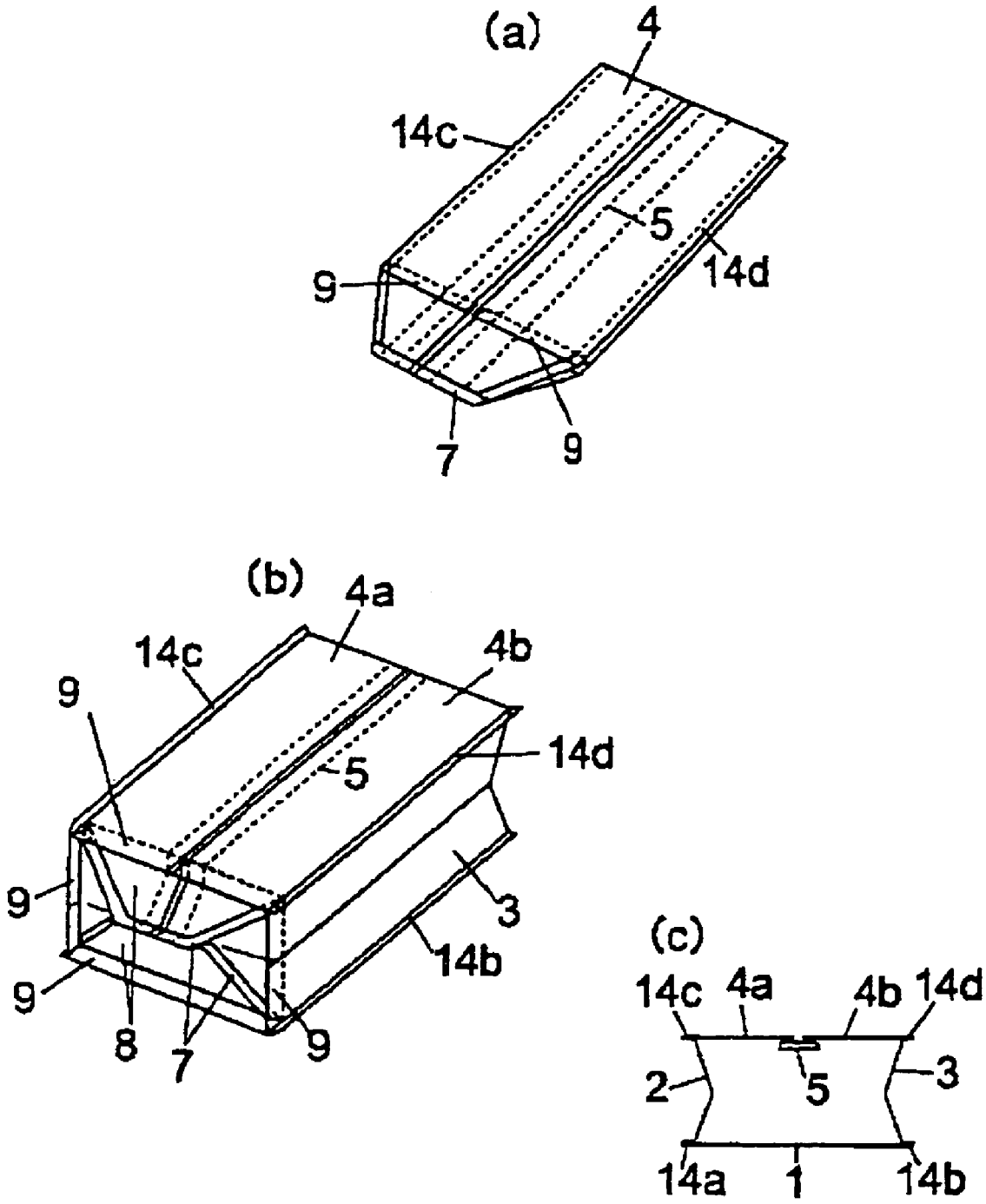
FIG. 6 shows a stand-up packaging pouch according to a fifth embodiment of the present invention.

FIG. 6(*a*) shows a perspective view of the stand-up packaging pouch. FIG. 6(*b*) shows a perspective view of the stand-up packaging pouch opened out into three dimensions. FIG. 6(*c*) is a horizontal section of the stand-up packaging pouch when opened out into three dimensions.

Similarly to the stand-up packaging pouch shown in FIG. 4(*a*), this stand-up packaging pouch is manufactured as a flattened pouch.

The constitution of this stand-up packaging pouch is characterized in comprising the pleat 9, in that the two corners of part below the pleat 9 are cut off at substantially 45 degrees, and in comprising the four ribs 14*a*, 14*b*, 14*c*, 14*d*.

This stand-up packaging pouch differs from the stand-up packaging pouch shown in FIG. 5(*a*) in that, in a flattened state, the two corners of the bottom face portion 8 of the pouch are heat sealed at substantially 45 degrees, whereupon triangular corner parts are cut out.

Since triangular corner parts are cut out on the lower portion of the flattened pouch, when this stand-up packaging pouch is opened out into three dimensions, no triangular pockets are formed on the bottom face portion 8, as shown in FIG. 6(*b*).

The pleat 9 is formed as an upper extending edge of the peripheral surface, and therefore clearly defines the bottom face portion from the peripheral surface, giving an impression of clear tight folding.

A stand-up packaging pouch according to a sixth embodiment of the present invention will now be described with reference to FIG. 7.

This embodiment comprises the stand-up packaging pouch described in (4) and (5) and the package body described in (7).

Figure 7:
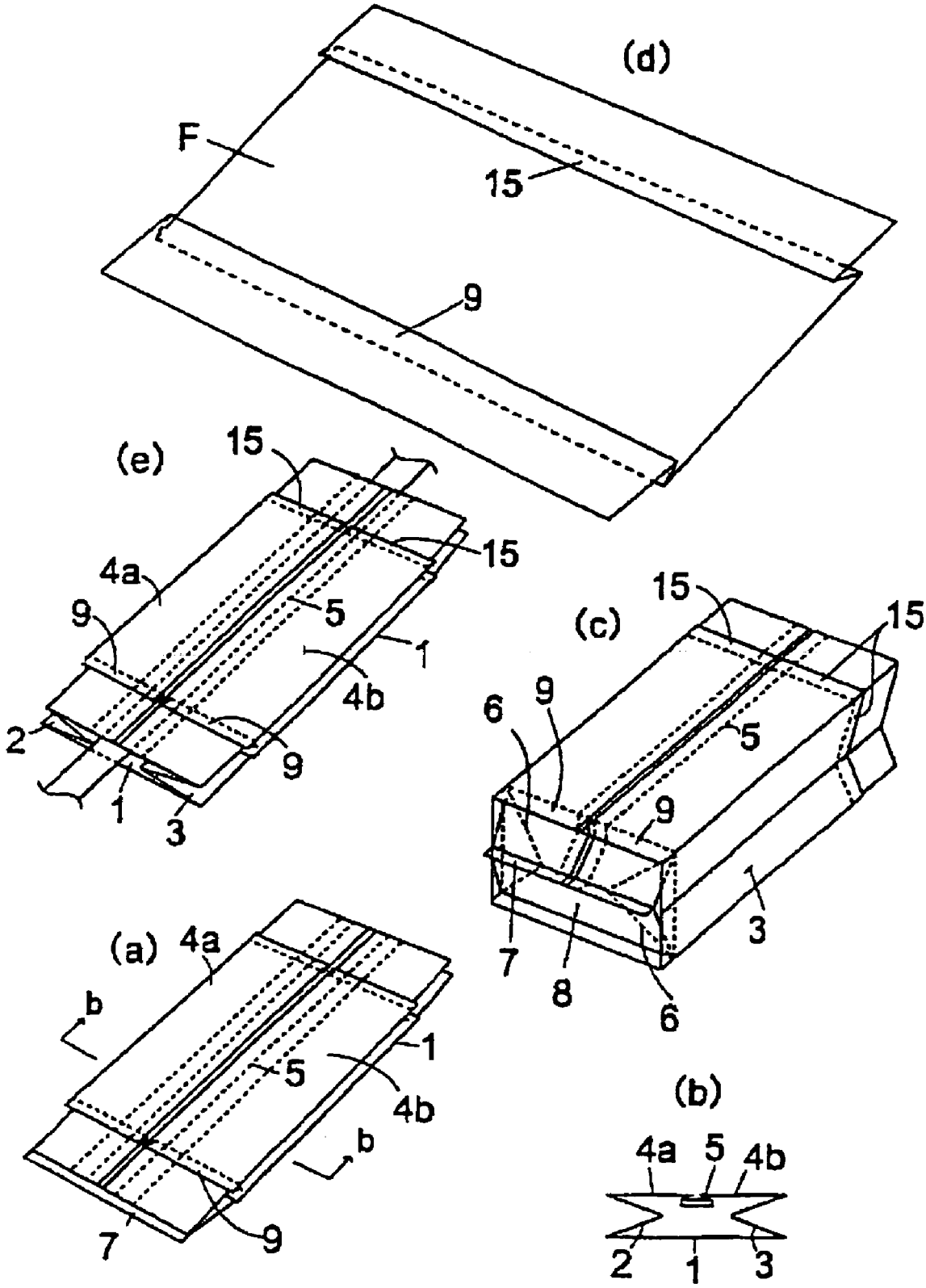
FIG. 7 shows a stand-up packaging pouch according to a sixth embodiment of the present invention.

FIG. 7(*a*) shows a perspective view of the stand-up packaging pouch, FIG. 7(*c*) shows a perspective view of the stand-up packaging pouch opened out into three dimensions, and FIG. 7(*b*) shows a cross-section along the b—b line in FIG. 7(*a*).

Similarly to the stand-up packaging pouch shown in FIG. 4(*a*), this stand-up packaging pouch is manufactured as a flattened pouch.

This stand-up packaging pouch differs from the stand-up packaging pouch shown in FIG. 4(*a*) in that a pleat 15 is also provided in the upper portion.

FIG. 7(*d*) is a perspective view of pleated packaging material which is used for manufacturing the stand-up packaging pouch. This packaging material is characterized in comprising the pleat 9 and the pleat 15. The pleat 9 and the pleat 15 are inclined in opposite directions. FIG. 7(*e*) is a perspective view of a flattened tube formed with a pair of folded-in side gussets used for manufacturing the stand-up packaging pouch.

To manufacture this stand-up packaging pouch, the packaging material F with the pleats 9 and 15 shown in FIG. 7(*d*) is used to form a prismatic tube as shown in FIG. 1(*e*). Folds are then inserted into the two side faces to form a pair of side gussets and to flatten the tube, thus forming the flattened tube shown in FIG. 7(*e*). The bottom heat seal 7 is then applied as shown in FIG. 7(*a*) to form a flattened pouch.

When packaging a product, the flattened pouch is opened out in three dimensions as shown in FIG. 7(*c*), the pouch is filled with the product (not shown), and the hipped upper face portion 12 with a top gusset is formed as shown in FIG. 1(*g*). The pleat 15 is formed as an upper extending edge of the peripheral surface, and therefore clearly defines the top face portion 12 from the peripheral surface, giving an impression of tight folding.

As a modified example of this stand-up packaging pouch, the ribs 14*a*, 14*b*, 14*c*, 14*d* may be provided as shown in the stand-up packaging pouch of FIG. 6, or the stand-up packaging pouch may be formed identically to the stand-up packaging pouch shown in FIG. 6(*b*) by heat sealing the two corners of the part below the pleat 9 at substantially 45 degrees and cutting out triangular corner edges. Further, the pleat 15 and the pleat 9 may be inclined in the same direction.

A stand-up packaging pouch according to a seventh embodiment of the present invention will now be described with reference to FIG. 8.

This embodiment comprises the stand-up packaging pouch described in (4) and (5) and the package body described in (7).

Figure 8:
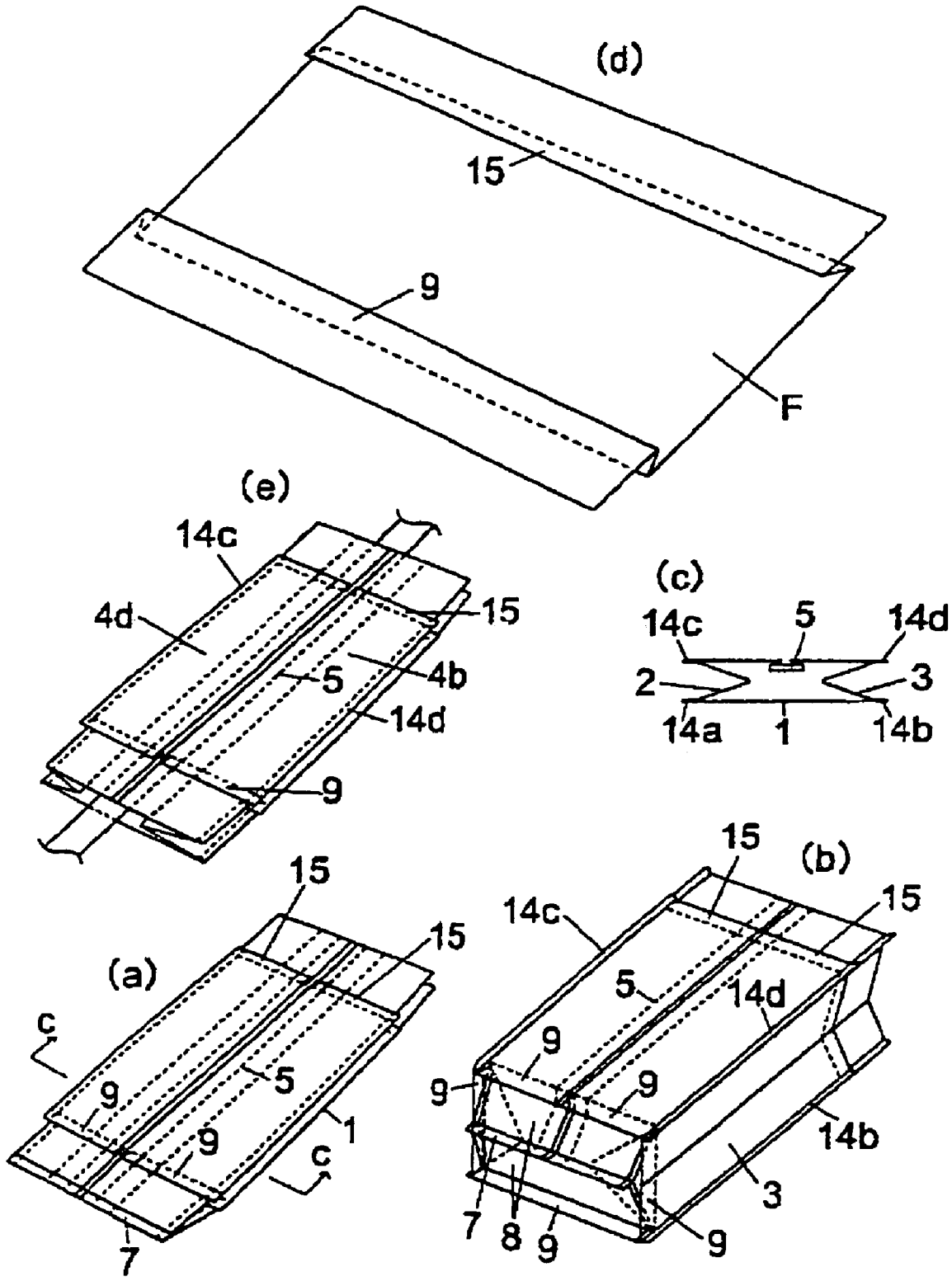
FIG. 8 shows a stand-up packaging pouch according to a seventh embodiment of the present invention.

FIG. 8(*a*) shows a perspective view of the stand-up packaging pouch. FIG. 8(*b*) shows a perspective view of the stand-up packaging pouch opened out into three dimensions. FIG. 8(*c*) is a cross section along the c—c line in FIG. 8(*a*). FIG. 8(*d*) is a perspective view of pleated packaging material which is used for manufacturing the stand-up packaging pouch. FIG. 8(*e*) is a perspective view of a flattened tube formed with a pair of folded-in side gussets and a rib used for manufacturing the stand-up packaging pouch.

Similarly to the stand-up packaging pouch shown in FIG. 4(*a*), this stand-up packaging pouch is manufactured as a flattened pouch.

The constitution of this stand-up packaging pouch is characterized in comprising the pleats 9, 15 and the four ribs 14*a*, 14*b*, 14*c*, 14*d*.

This stand-up packaging pouch differs from the stand-up packaging pouch shown in FIG. 7(*a*) only in the presence of the four ribs 14*a*, 14*b*, 14*c*, 14*d*.

As a modified example of this stand-up packaging pouch, the pouch may be formed identically to the stand-up packaging pouch having the same bottom portion as shown in FIG. 6(*b*) by heat sealing the two corners of the part below the pleat 9 at substantially 45 degrees, as shown in the stand-up packaging pouch in FIG. 6, and cutting out triangular corner edges.

A stand-up packaging pouch according to an eighth embodiment of the present invention will now be described with reference to FIG. 9.

This embodiment comprises the stand-up packaging pouch described in (6) and the package body described in (7).

Figure 9:
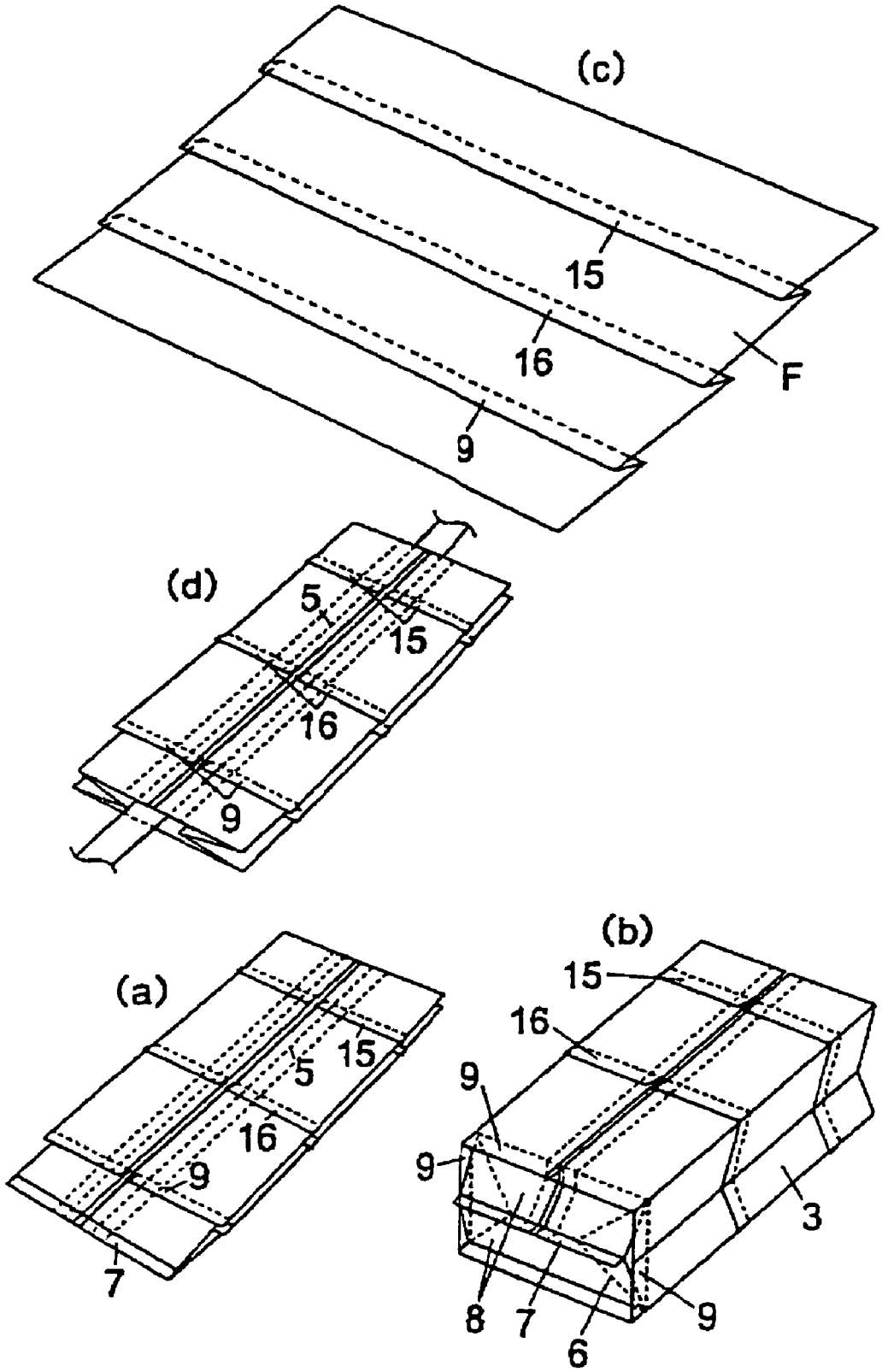
FIG. 9 shows a stand-up packaging pouch according to an eighth embodiment of the present invention.

FIG. 9(*a*) shows a perspective view of the stand-up packaging pouch, and FIG. 9(*b*) shows a perspective view of the stand-up packaging pouch opened out into three dimensions.

Similarly to the stand-up packaging pouch shown in FIG. 4(*a*), this stand-up packaging pouch is manufactured as a flattened pouch.

This stand-up packaging pouch differs from the stand-up packaging pouch shown in FIG. 4(*a*) in that pleats 9, 16, 15 are provided on the lower portion, in an intermediate position, and on the upper portion.

FIG. 9(*c*) is a perspective view of pleated packaging material which is used for manufacturing the stand-up packaging pouch. The constitution of this material is characterized in comprising the pleats 9, 16, 15. The pleats 9, 16, 15 are inclined downward. FIG. 9(*d*) is a perspective view of a flattened tube formed with a pair of folded-in side gussets used for manufacturing the stand-up packaging pouch.

To manufacture this stand-up packaging pouch, the packaging material F with the pleats 9, 16, 15 shown in FIG. 9(*c*) is used to form a prismatic tube as shown in FIG. 1(*e*). Folds are then inserted into the two side faces to form a pair of side gussets and to flatten the tube, thus forming the flattened tube shown in FIG. 9(*d*). The bottom heat seal 7 is then applied as shown in FIG. 9(*a*) to form a flattened pouch.

To seal the pouch, the flattened pouch is opened out in three dimensions as shown in FIG. 9(*b*), the pouch is filled with a packaged product (not shown), and the hipped upper face portion 12 with a top gusset is formed as shown in FIG. 1(*g*). The pleat 9 and the pleat 15 are formed as extending edges of the peripheral surface, and therefore clearly define the bottom face portion from the peripheral face portion and the top face portion from the peripheral face portion, giving an impression of tight folding.

The pleat 16 adds accent and variation to the sealed form. By providing a notch (a slit indicating a tearing start-point) on the pleat 16, the pouch may be opened at an intermediate point.

As a modified example of this stand-up packaging pouch, the pouch may be formed having the same bottom form as that of the stand-up packaging pouch shown in FIG. 6(*b*) by heat sealing the two corners of the part below the pleat 9 at substantially 45 degrees and cutting out triangular corner edges.

A stand-up packaging pouch according to a ninth embodiment of the present invention will now be described with reference to FIG. 10.

This embodiment comprises the stand-up packaging pouch described in (4) and the package body described in (7).

Figure 10:
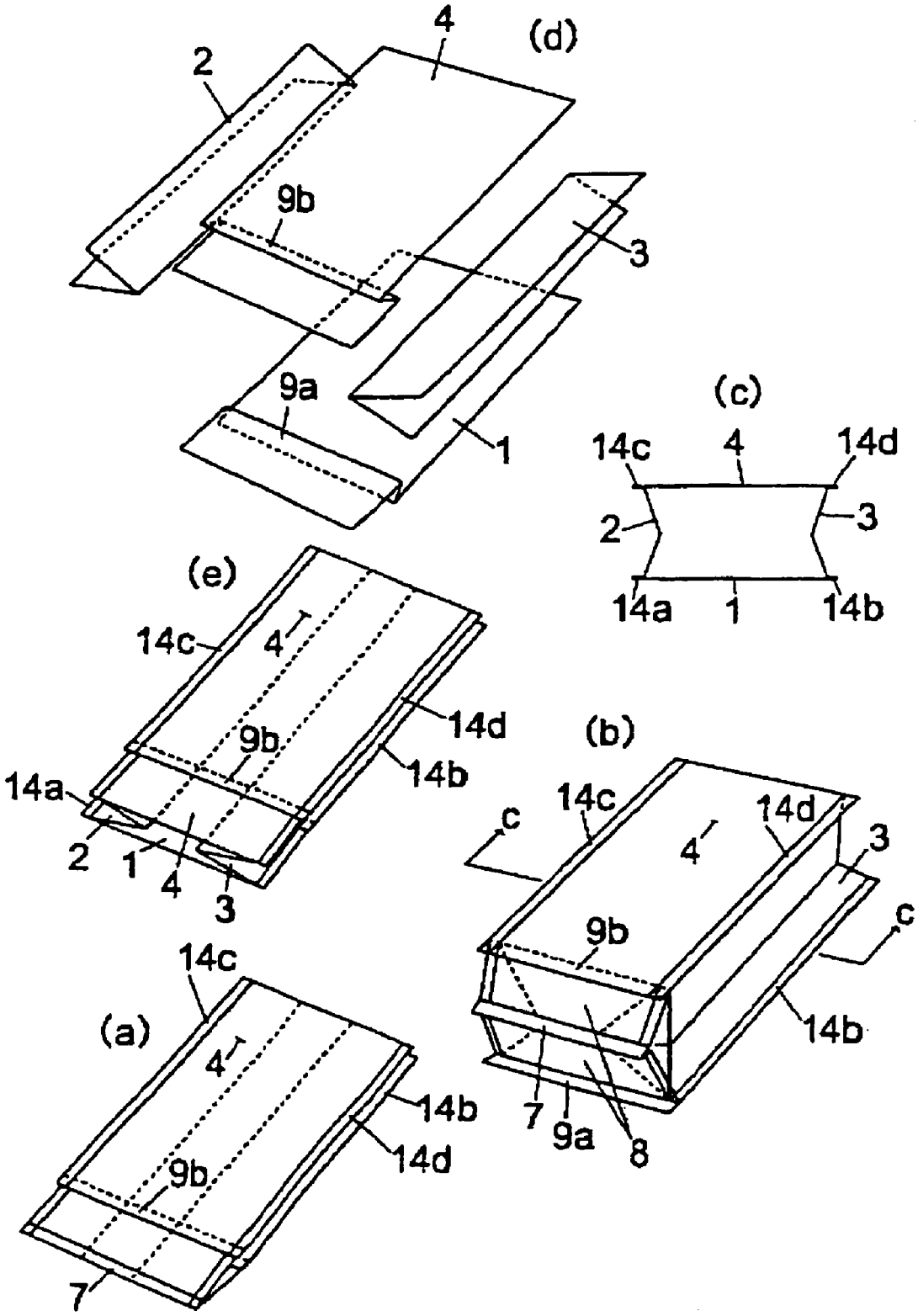
FIG. 10 shows a stand-up packaging pouch according to a ninth embodiment of the present invention.

FIG. 10(*a*) shows a perspective view of the stand-up packaging pouch, and FIG. 10(*b*) shows a perspective view of the stand-up packaging pouch opened out into three dimensions. FIG. 10(*c*) is a horizontal section of the stand-up packaging pouch when opened out into three dimensions (a cross section along the c—c line in FIG. 10(*b*)). FIG. 10(*d*) is a perspective view showing an exploded state of the disposal of each of the webs constituting the stand-up packaging pouch. FIG. 10(*e*) is a perspective view showing a flattened tube having side gussets.

The stand-up packaging pouch of this embodiment is manufactured as a flattened pouch and opened out into three dimensions when sealed.

This stand-up packaging pouch is not manufactured by folding a single sheet of packaging material, but rather is manufactured by overlapping four sheets of packaging material, a front face portion 1 formed with a pleat 9*a*, a rear face portion 4 formed with a pleat 9*b*, a right side face portion 2 with a gusset folded therein, and a left side face portion 3 with a gusset folded therein, as shown in FIG. 10(*d*), applying pinch type side seals as shown in FIG. 10(*e*), and applying a bottom seal to the resultant flattened tube with inserted side gussets which are formed with ribs 14*a*, 14*b*, 14*c*, 14*d* as shown in FIG. 10(*a*).

The right side face portion 2 and left side face portion 3 of this stand-up packaging pouch have no pleats, and connecting tape is not used.

It is preferable that a single sheet of packaging material cut in half along its width following the insertion of a pleat be used as the front face portion 1 formed with the pleat 9*a* and the rear face portion 4 formed with the pleat 9*b* to prevent the pleats 9*a*, 9*b* from being misaligned.

As a modified example of this stand-up packaging pouch, the pouch may be formed having the same bottom form as that of the stand-up packaging pouch shown in FIG. 6(*b*) by heat sealing the two corners of the part below the pleats 9*a*, 9*b* at substantially 45 degrees and cutting out triangular corner edges. The pouch may also be manufactured by providing pleats in the right side face portion 2 and the left side face portion 3 corresponding to the pleats 9*a*, 9*b*.

A stand-up packaging pouch according to a tenth embodiment of the present invention will now be described with reference to FIG. 11.

This embodiment comprises the stand-up packaging pouch described in (5) and the package body described in (7).

Figure 11:
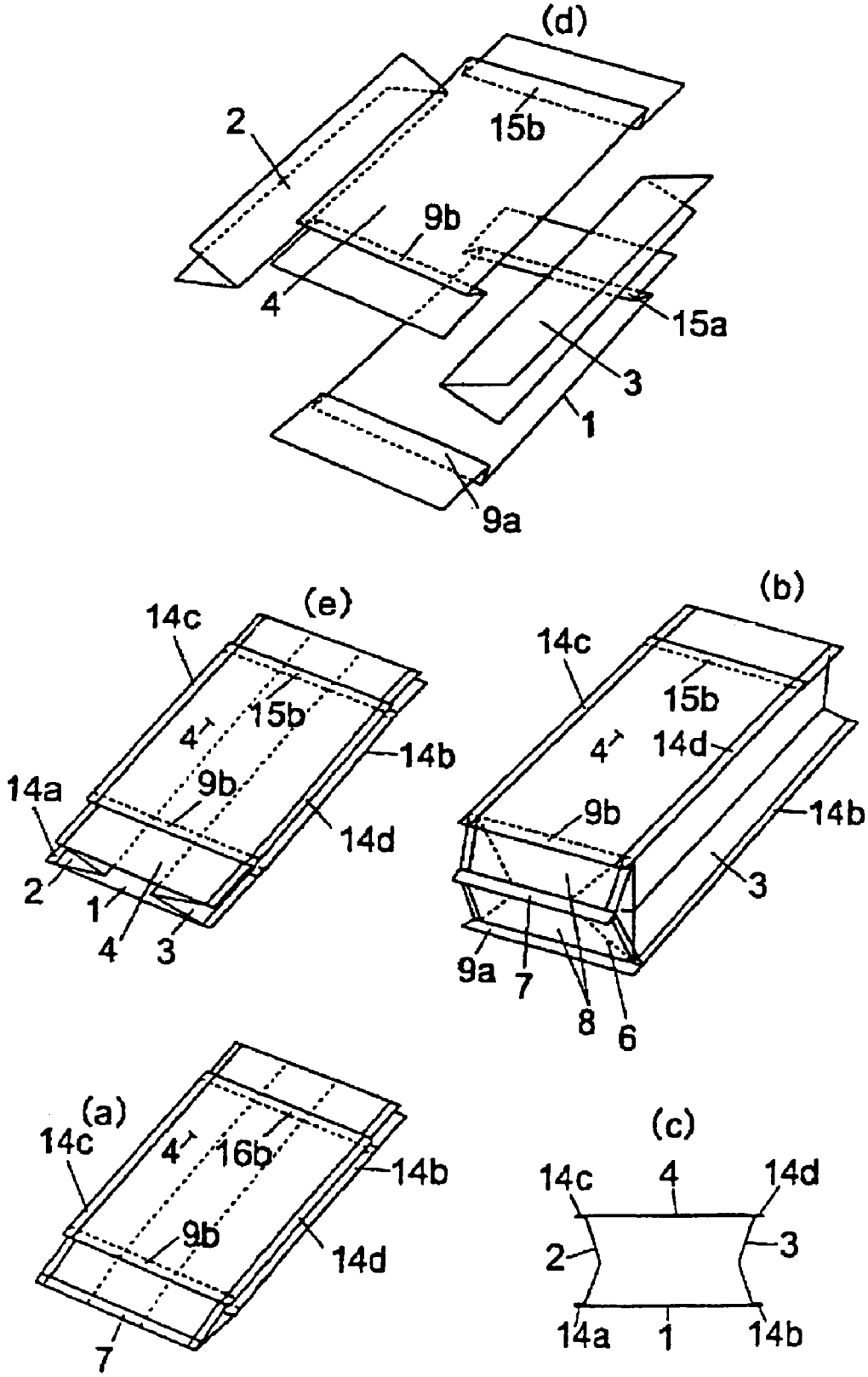
FIG. 11 shows a stand-up packaging pouch according to a tenth embodiment of the present invention.

FIG. 11(*a*) shows a perspective view of the stand-up packaging pouch, and FIG. 11(*b*) shows a perspective view of the stand-up packaging pouch opened out into three dimensions. FIG. 11(*c*) is a horizontal section of the stand-up packaging pouch when opened out into three dimensions. FIG. 11(*d*) is a perspective view showing an exploded state of the disposal of each of the webs constituting the stand-up packaging pouch. FIG. 11(*e*) is a perspective view showing a flattened tube having side gussets.

The stand-up packaging pouch of this embodiment is manufactured as a flattened pouch and opened out into three dimensions when being filled with a product to be packaged.

This stand-up packaging pouch is not manufactured by folding a single sheet of packaging material, but rather is manufactured by overlapping separate sheets of packaging material, a front face portion 1 formed with pleats 9*a*, 15*a*, a rear face portion 4 formed with pleats 9*b*, 15*b*, a right side face portion 2 with a gusset folded therein, and a left side face portion 3 with a gusset folded therein, as shown in FIG. 11(*d*), applying pinch type side seals as shown in FIG. 11(*e*), and applying a bottom seal to the resultant flattened tube with inserted side gussets which are formed with ribs 14*a*, 14*b*, 14*c*, 14*d* as shown in FIG. 11(*a*). The pleats 9*a*, 9*b* are inclined downward, and the pleats 15*a*, 15*b* are inclined upward.

This stand-up packaging pouch differs from the stand-up packaging pouch shown in FIG. 10 only in the presence of the pleats 15*a*, 15*b*.

As a modified example of this stand-up packaging pouch, the pouch may be formed having the same bottom form as that of the stand-up packaging pouch shown in FIG. 6(*b*) by heat sealing the two corners of the part below the pleats 9*a*, 9*b* at substantially 45 degrees and cutting out triangular corner edges. The pouch may also be manufactured by providing pleats in the right side face portion 2 and the left side face portion 3 corresponding to the pleats 15*a*, 15*b*.

A stand-up packaging pouch according to an eleventh embodiment of the present invention will now be described with reference to FIG. 12.

This embodiment comprises the stand-up packaging pouch described in (6) and the package body described in (7).

Figure 12:
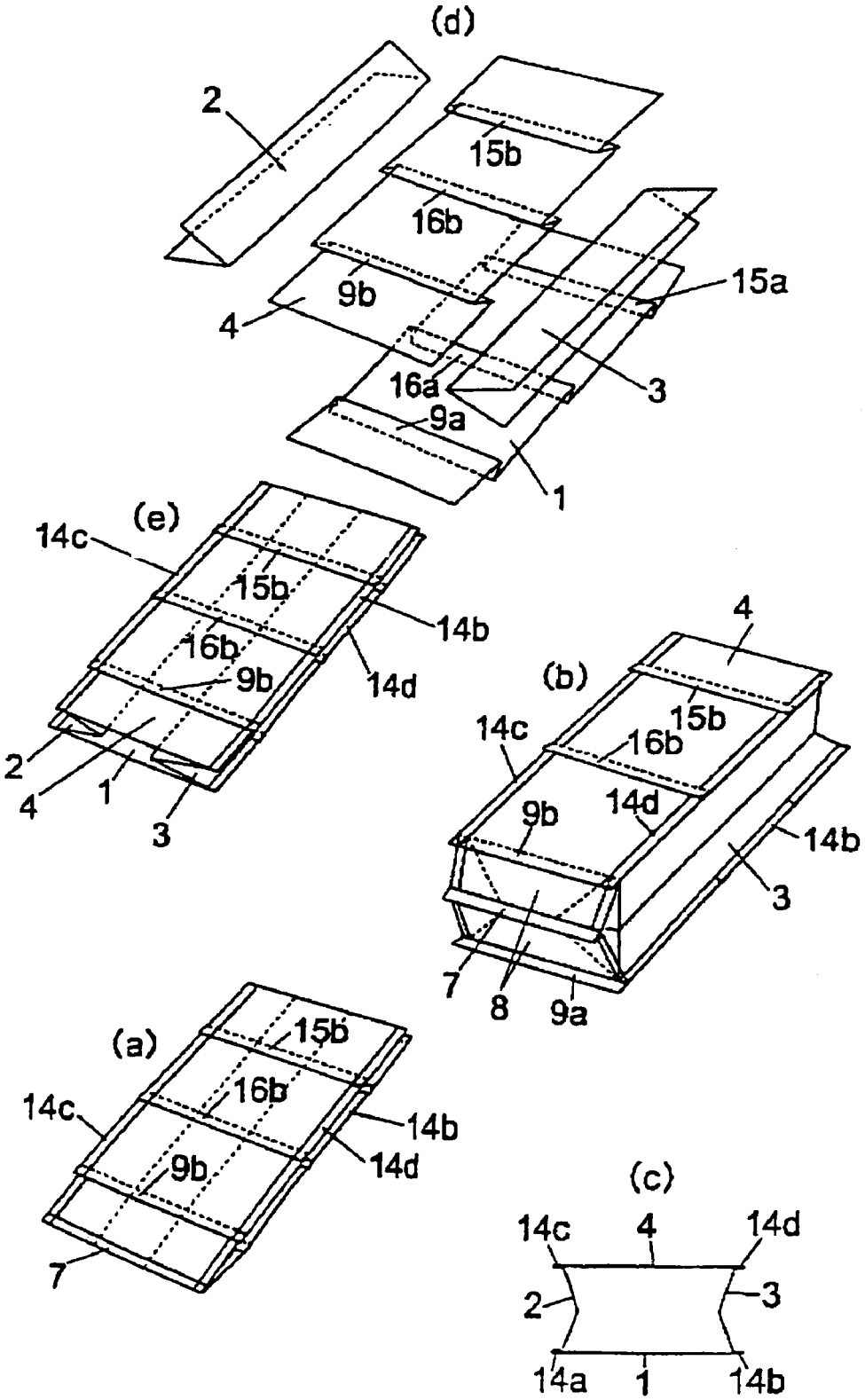
FIG. 12 shows a stand-up packaging pouch according to an eleventh embodiment of the present invention.

FIG. 12(*a*) shows a perspective view of the stand-up packaging pouch, and FIG. 12(*b*) shows a perspective view of the stand-up packaging pouch opened out into three dimensions. FIG. 12(*c*) is a horizontal section of the stand-up packaging pouch when opened out into three dimensions. FIG. 12(*d*) is a perspective view showing an exploded state of the disposal of each of the webs constituting the stand-up packaging pouch. FIG. 12(*e*) is a perspective view showing a flattened tube having side gussets.

The stand-up packaging pouch of this embodiment is manufactured as a flattened pouch and opened out into three dimensions when being filled with a product to be packaged.

This stand-up packaging pouch is not manufactured by folding a single sheet of packaging material, but rather is manufactured by overlapping separate sheets of packaging material, a front face portion 1 formed with pleat 9*a*, 16*a*, 15*a*, a rear face portion 4 formed with pleats 9*b*, 16*b*, 15*b*, a right side face portion 2 with a gusset folded therein, and a left side face portion 3 with a gusset folded therein, as shown in FIG. 12(*d*), applying pinch type side seals as shown in FIG. 12(*e*), and applying a bottom seal to the resultant flattened tube with inserted side gussets which are formed with ribs 14*a*, 14*b*, 14*c*, 14*d* as shown in FIG. 12(*a*).

This stand-up packaging pouch differs from the stand-up packaging pouch shown in FIG. 10 only in the presence of the pleats 16*a*, 16*b*, 15*a*, 15*b*. The pleats 9*a*, 9*b*, 16*a*, 16*b*, 15*a*, 15*b* are all inclined downward.

As a modified example of this stand-up packaging pouch, the pouch may be formed having the same bottom form as that of the stand-up packaging pouch shown in FIG. 6(*b*) by heat sealing the two corners of the part below the pleats 9*a*, 9*b* at substantially 45 degrees and cutting out triangular corner edges. The pouch may also be manufactured by providing pleats in the right side face portion 2 and the left side face portion 3 corresponding to the pleats 15*a*, 15*b*. The pleats 16*a*, 16*b*, 15*a*, 15*b* may be inclined upward.

A stand-up packaging pouch according to a twelfth embodiment of the present invention will now be described with reference to FIG. 13.

This embodiment comprises the stand-up packaging pouch described in (3) and the package body described in (7).

Figure 13:
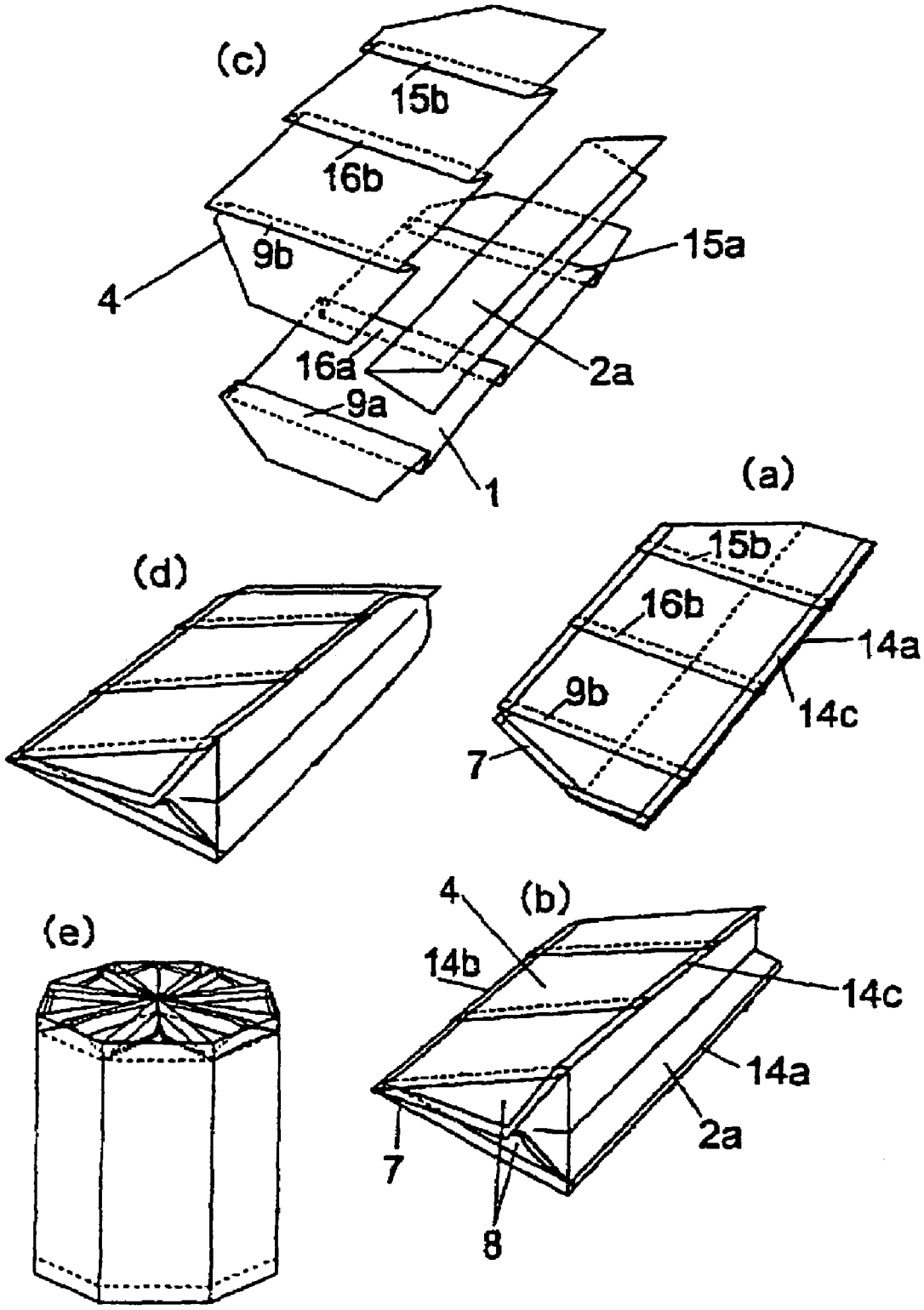
FIG. 13 shows a stand-up packaging pouch according to a twelfth embodiment of the present invention.

FIG. 13(*a*) shows a perspective view of the stand-up packaging pouch. FIG. 13(*b*) shows a perspective view of the stand-up packaging pouch opened out into three dimensions. FIG. 13(*c*) is a perspective view showing an exploded state of the disposal of each of the webs constituting the stand-up packaging pouch. FIG. 13(*d*) is a perspective view showing the stand-up packaging pouch opened out into three dimensions, filled with a product to be packaged, with the opening thereof closed, and thus formed into a package body.

The stand-up packaging pouch of this embodiment is manufactured as a flattened pouch and opened out into a triangular prism form when sealed.

This stand-up packaging pouch is not manufactured by folding a single sheet of packaging material, but rather is manufactured by overlapping three separate sheets of packaging material, a front face portion 1 formed with pleats 9*a*, 15*a*, 16*a*, a rear face portion 4 formed with pleats 9*b*, 15*b*, 16*b*, and a side face portion 2*a* with a gusset folded therein, as shown in FIG. 13(*c*), and applying a bottom heat seal 7 to the resultant flattened tube with an inserted side gusset and formed with ribs 14*a*, 14*b*, 14*c*, as shown in FIG. 13(*a*).

This stand-up packaging pouch differs from the stand-up packaging pouch shown in FIG. 12 in that a gusseted side face portion is provided on only one side rather than a pair of gusseted side face portions on the left and right sides. When this stand-up packaging pouch is opened out into three dimensions, a triangular prism is formed and thus, as shown in FIG. 13(*e*) for example, six packaging bodies may be gathered and displayed as a hexagonal prism or packed in hexagonal prism form, whereas the stand-up packaging pouch shown in FIG. 12 forms a quadratic prism and may be stacked and displayed as shown in FIG. 2.

A stand-up packaging pouch and package body according to a thirteenth embodiment of the present invention will now be described with reference to FIG. 14.

This embodiment comprises the stand-up packaging pouch described in (8) and the package body described in (9).

Figure 14:
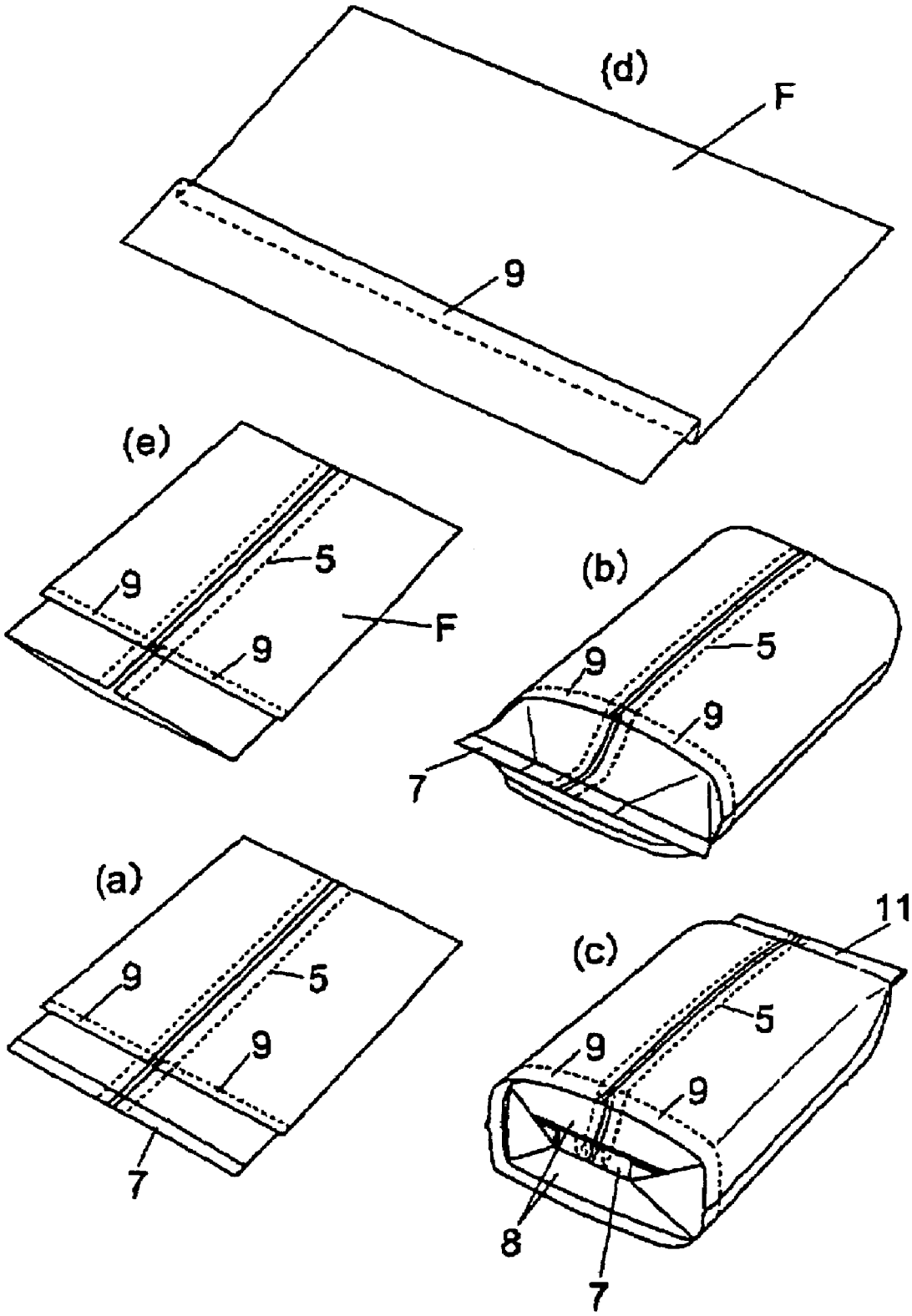
FIG. 14 shows a stand-up packaging pouch according to a thirteenth embodiment of the present invention.

FIG. 14(*a*) shows a perspective view of the stand-up packaging pouch. FIG. 14(*b*) shows a perspective view of the stand-up packaging pouch opened out into three dimensions. FIG. 14(*c*) is a perspective view of the stand-up packaging pouch filled with a packaged product and with the opening thereof closed to form a package body. FIG. 14(*d*) is a perspective view of packaging material provided with a pleat. FIG. 14(*e*) is a perspective view showing the packaging material with the two edges thereof connected with a connecting tape to form a flattened tube.

The stand-up packaging pouch of this embodiment is manufactured as a flattened pouch as shown in FIG. 14(*a*).

This stand-up packaging pouch is manufactured by folding the packaging material F having a pleat 9 as shown in FIG. 14(*d*) into a flattened tube form as shown in FIG. 14(*e*), abutting the two edges in the direction of breadth, overlapping the connecting tape 5 over the inside seam and connecting the seam using a heat seal, and then applying a bottom heat seal 7 as shown in FIG. 14(*a*).

To seal the pouch, the upper portion of the stand-up packaging pouch is opened, the pouch is filled with a packaged product, and a top heat seal 11 is applied. When the pouch is filled with a packaged product, the part below the pleat 9 opens out laterally. When the two edge parts of the bottom heat seal 7 are folded inside to form parallel triangular ears, a bottom face portion 8 with both ears folded in is formed as shown in FIG. 14(*c*) and concealed inside the pleat 9. The pleat 9 forms an extension of the peripheral face and is positioned at a substantial right angle from the top edge of the pleat rear surface relative to the bottom face portion 8 to thereby conceal the bottom face portion.

Note that the bottom face portion 8 may be formed as shown in FIG. 4(*c*).

A stand-up packaging pouch and package body according to a fourteenth embodiment of the present invention will now be described with reference to FIG. 15.

This embodiment comprises the stand-up packaging pouch described in (8) and the package body described in (9).

Figure 15:
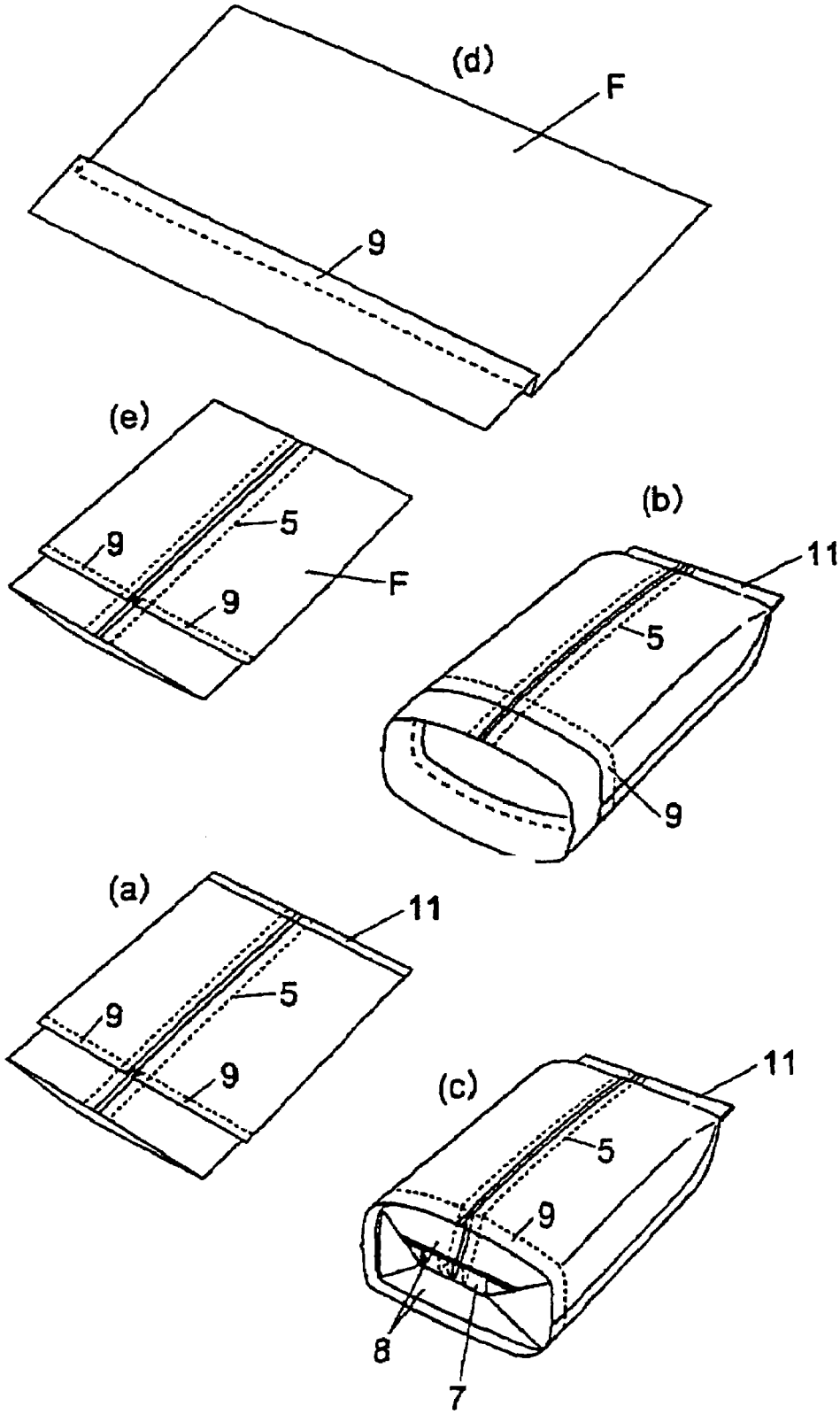
FIG. 15 shows a stand-up packaging pouch according to a fourteenth embodiment of the present invention.

FIG. 15(*a*) shows a perspective view of the stand-up packaging pouch. FIG. 15(*b*) shows a perspective view of the stand-up packaging pouch opened out into three dimensions. FIG. 15(*c*) is a perspective view of the stand-up packaging pouch filled with a packaged product and with the opening thereof closed to form a package body. FIG. 15(*d*) is a perspective view of pleated packaging material. FIG. 15(*e*) is a perspective view showing the packaging material with the two edges thereof connected with a connecting tape to form a flattened tube.

As shown in FIG. 15(*a*), the stand-up packaging pouch of this embodiment has the pleat 9 but no side gussets, and is manufactured as a flattened pouch with a top heat seal 11 applied.

This stand-up packaging pouch is manufactured by folding the packaging material F having a pleat 9 as shown in FIG. 15(*d*) into a flattened tube form as shown in FIG. 15(*e*), abutting the two edges in the direction of breadth, overlapping a connecting tape 5 over the inside seam and connecting the seam using a heat seal, and then applying a top heat seal 11 as shown in FIG. 15(*a*).

To seal the pouch, the stand-up packaging pouch is turned over, and the bottom portion which faces upward is opened and filled with a product to be packaged. The part below the pleat 9 is then closed laterally and a bottom heat seal 7 is applied to form the bottom face portion 8. When the surplus portions of the two edge parts of the bottom heat seal 7 are folded inside to form parallel triangular ears, a bottom face portion 8 with both ears folded in is formed as shown in FIG. 15(*c*) and concealed inside the pleat 9.

A stand-up packaging pouch and package body according to a fifteenth embodiment of the present invention will now be described with reference to FIG. 16.

This embodiment comprises the stand-up packaging pouch described in (8) and the package body described in (9).

Figure 16:
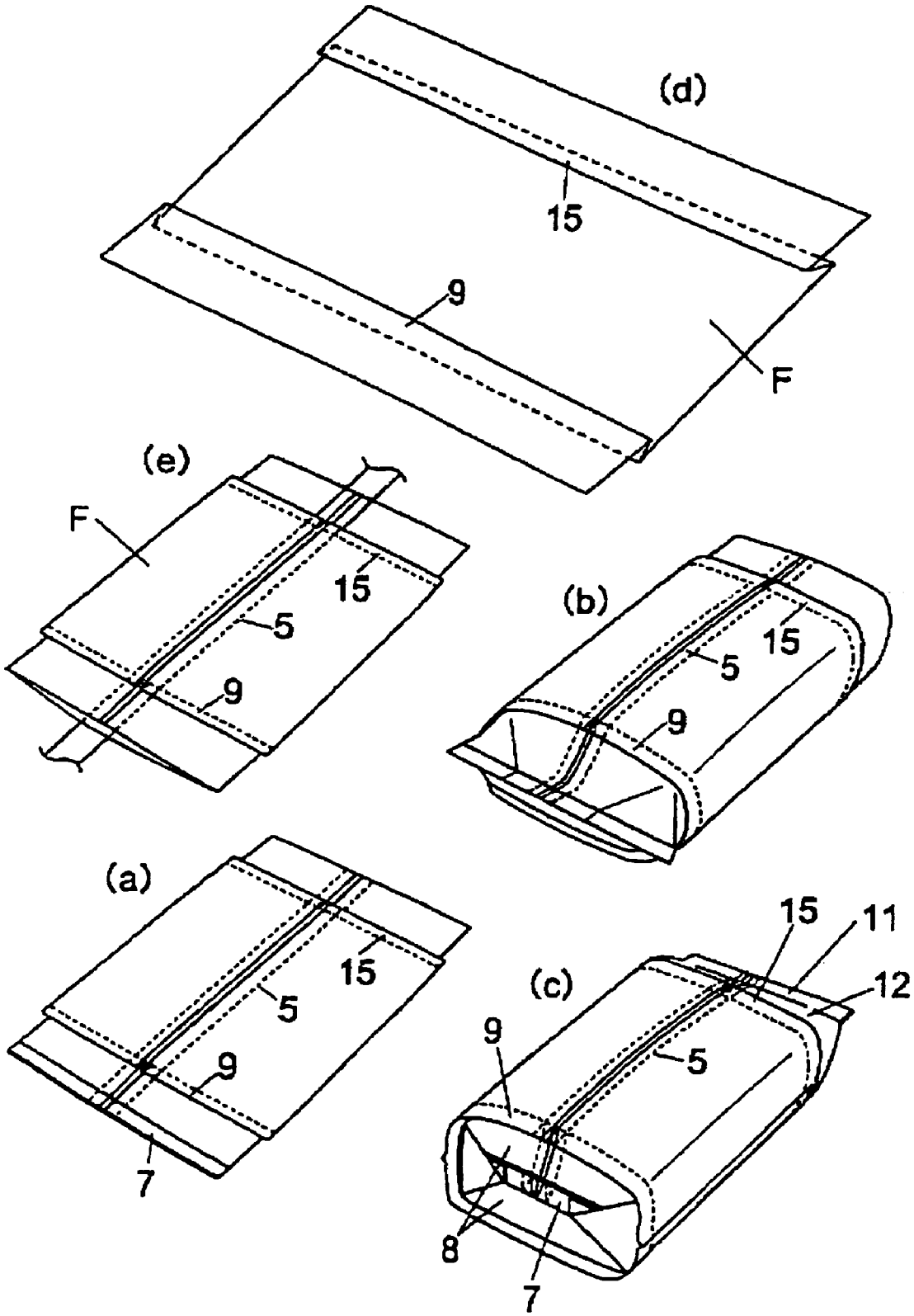
FIG. 16 shows a stand-up packaging pouch according to a fifteenth embodiment of the present invention.

FIG. 16(*a*) shows a perspective view of the stand-up packaging pouch. FIG. 16(*b*) shows a perspective view of the stand-up packaging pouch opened out into three dimensions. FIG. 16(*c*) is a perspective view of the stand-up packaging pouch filled with a packaged product and with the opening thereof closed to form a package body. FIG. 16(*d*) is a perspective view of pleated packaging material. FIG. 16(*e*) is a perspective view showing the packaging material with the two edges thereof connected with a connecting tape to form a flattened tube.

As shown in FIG. 16(*a*), the stand-up packaging pouch of this embodiment is manufactured as a flattened pouch.

This stand-up packaging pouch is manufactured by folding the packaging material F having pleats 9, 15 as shown in FIG. 16(*d*) into a flattened tube form as shown in FIG. 16(*e*), abutting the two edges in the direction of breadth in the center of the width of the rear face, overlapping a connecting tape 5 over the inside seam and connecting the seam using a heat seal to thereby form a flattened tube, and then applying a bottom heat seal 7 as shown in FIG. 16(*a*).

To seal the pouch, the upper portion of the stand-up packaging pouch is opened, the pouch is filled with a packaged product, and a top heat seal 11 is applied to thereby form the upper face portion 12. When the pouch is filled with a packaged product, the part below the pleat 9 opens out laterally. When the two edge parts of the bottom heat seal 7 are folded inside to form parallel triangular ears, a bottom face portion 8 with both ears folded in is formed as shown in FIG. 14(*c*) and concealed inside the pleat 9.

As shown in FIG. 14(*c*), when the pouch is filled with a product to be packaged, the bottom face portion below the pleat 9 is stretched in front and rear directions to form triangular ears on both edges and opens laterally so as to be concealed within the pleat 9. By closing the opening and applying a top seal, the upper face portion which is the part above the pleat 15 is processed similarly to the bottom face portion and concealed within the pleat 15.

This stand-up packaging pouch differs from the stand-up packaging pouch shown in FIG. 14 in the presence of the pleat 15. The upper face portion 12 is defined and formed by the provision of the pleat 15.

A package body according to a sixteenth embodiment of the present invention will now be described with reference to FIG. 17. This embodiment comprises the package body described above in (9).

Figure 17:
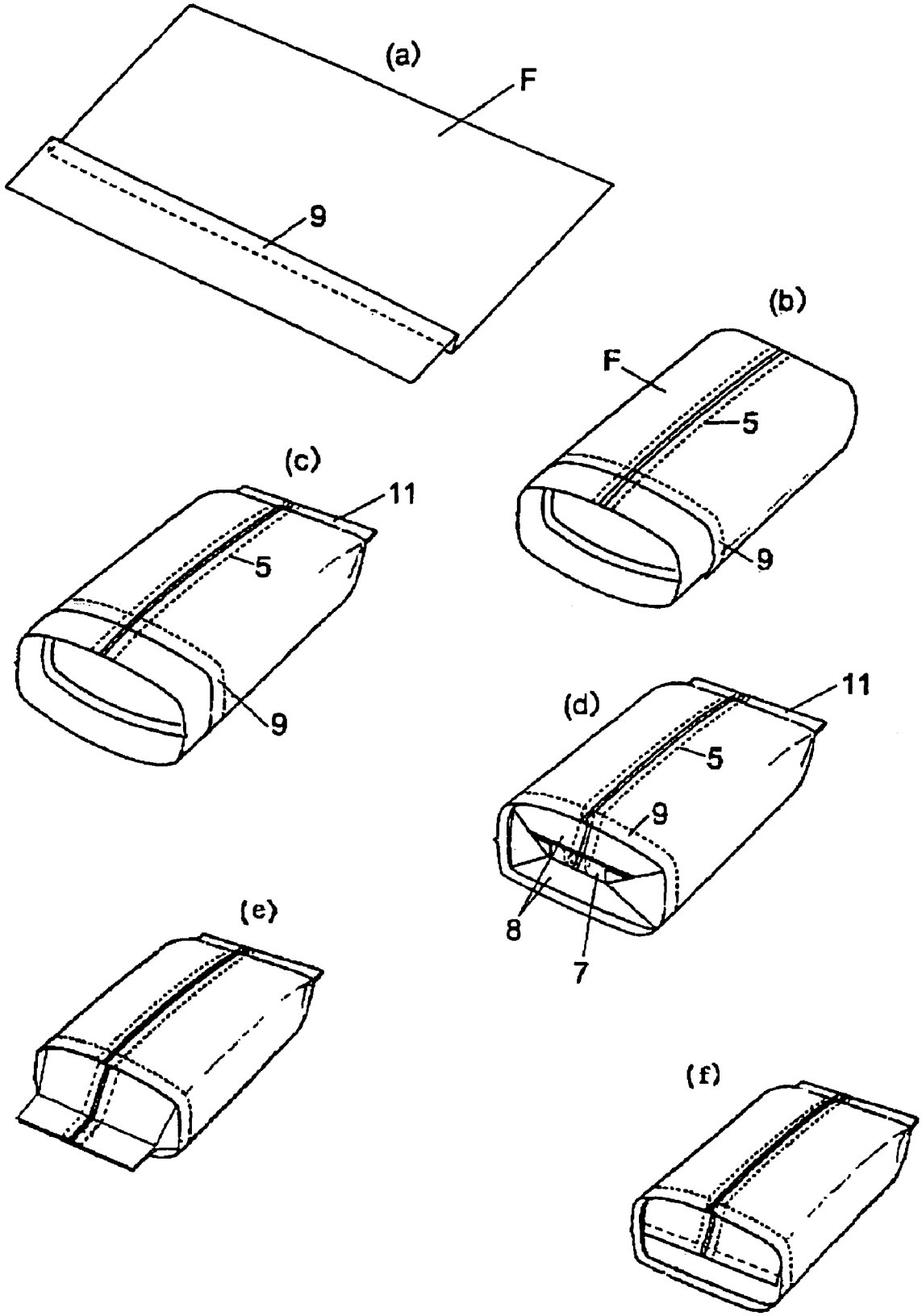
FIG. 17 shows a stand-up packaging pouch according to a sixteenth embodiment of the present invention.

FIG. 17(*a*) is a perspective view of pleated packaging material. FIG. 17(*b*) is a perspective view showing the packaging material with the two edges thereof connected with a connecting tape to form an elliptical tube. FIG. 17(*c*) is a perspective view of the stand-up packaging pouch formed with the application of a top heat seal to the elliptical tube. FIG. 17(*d*) is a perspective view of the stand-up packaging pouch filled with a packaged product and with the opening thereof closed to form a package body.

As shown in FIG. 17(*b*), the stand-up packaging pouch of this embodiment is manufactured as a pouch opened out in three dimensions in a cylindrical form and elliptical form.

This stand-up packaging pouch is, as shown in FIG. (b), manufactured by wrapping packaging material F formed with a pleat 9 as shown in FIG. 17(*a*) once around an elliptical mandrel, not shown, so as to fold the packaging material F into a loop form, abutting the two edges in the direction of breadth, overlapping a connecting tape 5 over the inside seam and connecting the seam using a heat seal to thereby form an elliptical tube, and then applying a top heat seal 11 as shown in FIG. 17(*c*).

To fill the pouch with a product to be packaged, the stand-up packaging pouch is turned over, and the bottom portion which faces upward is opened and filled with the packaged product. The part below the pleat 9 is then closed laterally and a bottom heat seal 7 is applied to form the bottom face portion 8. When the surplus portions of the two edge parts of the bottom heat seal 7 are folded inside to form parallel triangular ears, a bottom face portion 8 with both ears folded in is formed as shown in FIG. 17(*d*) and concealed inside the pleat 9.

The package body of (9) may be formed by applying either the bottom heat seal or the top heat seal first and applying the remaining top heat seal or bottom heat seal following filling of the packaged product. The package body of (9) also includes a package body which is filled with the product by a form-fill-seal machine. When the pouch shown in FIG. 17(*c*) is manufactured using a pillow packaging machine, the pouch is manufactured upside down such that the pleat 9 faces upward in order to prevent the pleat 9 from catching on the gap between a former and a drop-down filling pipe. Then, a bottom heat seal and a top heat seal are applied simultaneously to the upper side pouch and lower side pouch respectively of a packaging tube formed in cylindrical form under the drop-down filling pipe, whereupon the tube is cut between the double heat seal and the severed lower side pouch is turned upside down and transported on a conveyor. The pouch and package body shown in FIG. 17 are substantially equal to a package body which is manufactured and filled using a form-fill-seal machine. A package body which is formed, filled and sealed by a form-fill-seal machine may be formed with a bottom gusset inserted as shown in FIG. 17(*e*). In this case, the bottom face portion is formed as shown in FIG. 17(*f*). Ribs may also be formed.

Next, a manufacturing method for a feed roll of packaging material having pleats will be described with reference to FIG. 18.

In this manufacturing method for a feed roll of packaging material having pleats, a feed roll R1 of packaging material having an inner layer which is to become the inner surface of the pouch and is constituted by a sealant film, for example packaging material constituted by a laminated film of OPP and CPP, is mounted on an unwinder. The packaging material F1 which is issued from this feed roll R1 is hooked onto a guide roll 21, passed between a packaging material issuing roll 22 and a freely rotating nip roll 23, hooked onto a first dancer roller 24 and guide rolls 25, 26 successively, and then passed through a pleat forming device 27 where a pleat h is formed. Then, the packaging material F2 having pleats is passed through pleat inclining means 28 where the pleat h is inclined upstream, passed between a packaging material transferring roll 29 and a freely rotating nip roll 30 so as to be pressured from both sides, and successively hooked onto a second dancer roller 32 and guide rolls 33, 34. The packaging material F2 having pleats is then rewound as a feed roll R2 onto a core which is attached to a winder.

This manufacturing device for pleated packaging material is designed such that the packaging material issuing roll 22 is driven at increasing and decreasing speeds by a servo motor 35 whereby the first dancer roller 24 rises and falls within the upper limit and lower limit of a longitudinal range and the packaging material F1 is continuously issued from the feed roll R1. The packaging material transferring roll 29 is intermittently driven by a servo motor 36 so as to intermittently issue the packaging material F1 at an equal pitch to the length of a pouch. The winding shaft of the winder which axially supports the core is driven at increasing and decreasing speeds by a servo motor 37 such that the second dancer roller 32 rises and falls within the upper limit and lower limit of a longitudinal range and the pleated packaging material F2 is wound onto the core.

The pleat forming device 27 is constituted by upstream side and downstream side gap forming plates 27*a*, 27*b* adhered to the lower face (outer face) of the packaging material F1, pleat forming heat sealers 27*c*, 27*d* which correspond to the lower side of the gap forming plates 27*a*, 27*b*, packaging material pushing plates 27*e*, 27*f* which are provided in correspondence with the upper side of the gap forming plates 27*a*, 27*b* and which hold down the packaging material F1 toward the gap forming plates 27*a*, 27*b*, and a pleat folding plate 27*g* which is provided above the packaging material F1 in correspondence with the gap between the gap forming plates 27*a*, 27*b* and which folds a pleat by descending through the gap.

In this embodiment, the pleat h is formed during a stoppage in the intermittent motion of the packaging material F1. First, the packaging material pushing plate 27*f* descends to hold down the packaging material F1 toward the gap forming plate 27*b*, then the pleat folding plate 27*g* forms a pleat by descending to push the packaging material F1 into the gap between the gap forming plates 27*a* and 27*b*, then the packaging material pushing plate 27*e* descends to hold down the packaging material F1 toward the gap forming plate 27*a*, whereby the pleat folding plate 27*g* returns to its original raised position, then the pleat forming heat sealers 27*c*, 27*d* are closed to apply a heat seal to the pinch-pleated portion of the packaging material F1 and thereby form the pleat h, and finally the pleat forming heat sealers 27*c*, 27*d* are opened, the packaging material pushing plates 27*e*, 27*f* return to their original raised position and the packaging material F1 can continue to move.

Note that an operating sequence in which the pleat folding plate 27*g* descends and performs pleat folding initially, whereupon the packaging material pushing plates 27*e*, 27*f* descend to hold down the packaging material F1 and the pleat folding plate 27*g* rises may also be implemented. Also note that the heat seal may be an impulse heat seal.

As means for forming pleats, a means comprising a plate having a plurality of air nozzles arranged facing downward in series in the direction of the packaging material width, is suspended facing downward on the packaging material roll at the gap part such that a folded pleat is formed by blowing out high pressure air, or a means which is provided with aspiration means on the lower portion of the gap which aspirate the packaging material by adsorbing and holding the packaging material on the gap portion and reducing the pressure in the space formed by the gap plate and the packaging material to thereby form a folded pleat, may be employed in place of the pleat folding plate described above.

In the pleat inclining means 28, an upper and lower pair of flat plates is provided such that a gap of 1.5 mm to 3.0 mm, for example, is formed, and the pleat h is inclined upstream by means of friction resistance. This means is not limited thereto, however, and alternatively the pleat h may pass between a pair of rotary free rolls which contact one another, for example. Even without the pleat inclining means 28, the pleat h is inclined in the opposite direction to the direction of motion, but if the pleat h were to be inclined in the direction of motion, the location of the pleat may cause a defect in the manufactured pouch, and therefore the pleat inclining means 28 is provided to ensure that the pleats are inclined in the same direction.

Figure 18:
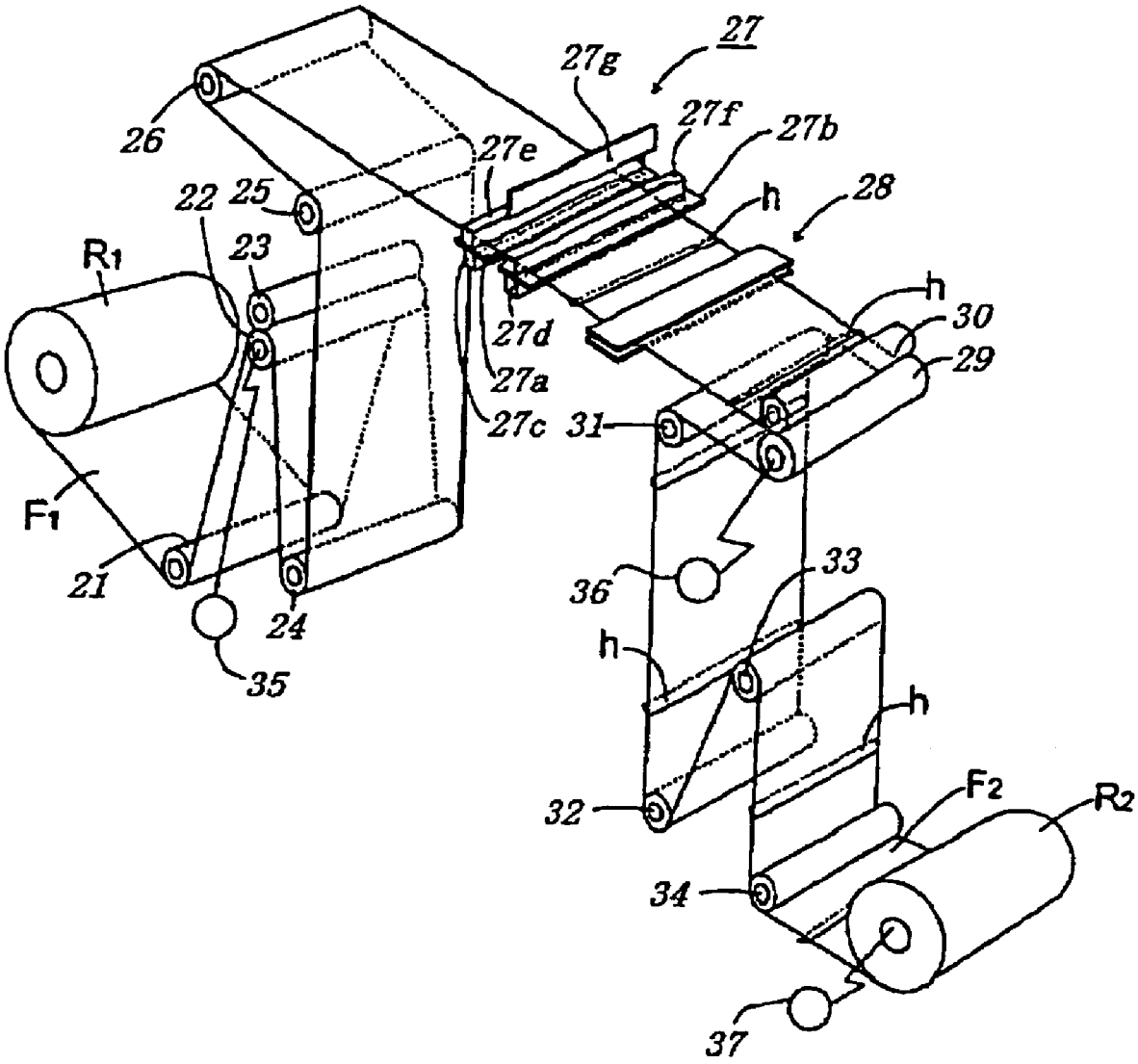
FIG. 18 is a schematic overall perspective view of a device for manufacturing a pleated packaging material which is used in the implementation of a manufacturing method for a pleated packaging material feed roll according to an embodiment of the present invention.
Figure 19:
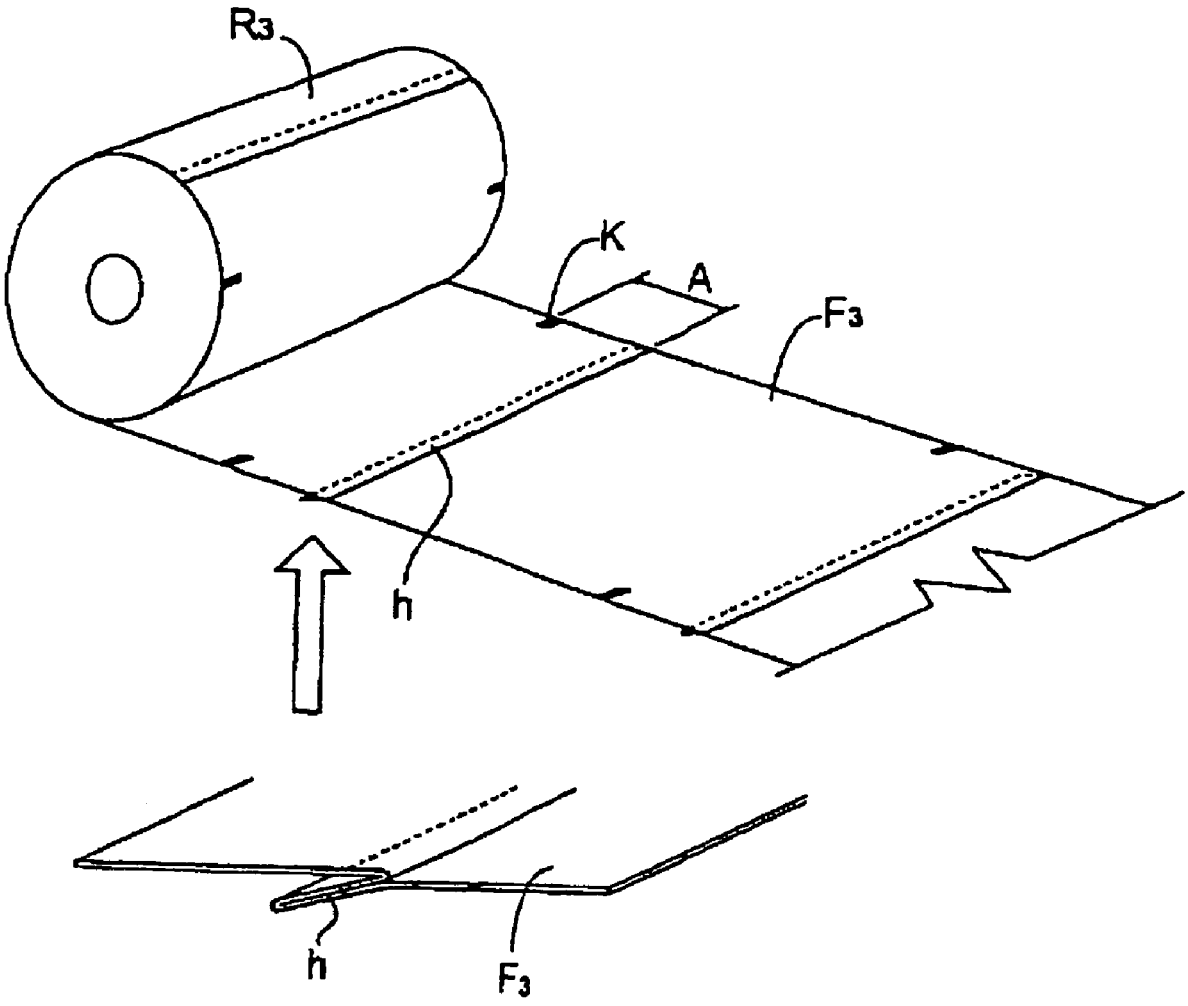
FIG. 19 is a perspective view of the pleated packaging material feed roll according to the present invention.

When the manufacturing method for a pleated packaging material feed roll shown in FIG. 18 is used, there is a large possibility that when the feed roll R2 of wrapped packaging material F2 having pleats is hooked onto an unwinder of a pouch manufacturing machine or a form-fill-seal machine in order to issue the pleated packaging material F2, the direction of inclination of the pleat h will turn to the issuing direction such that the pleat h is caught on the former. In such a case, it is necessary to rewind the wound feed roll R2 of pleated packaging material F2 so that the direction of inclination of the pleat h returns to the opposite direction to the issuing direction using the manufacturing method for a pleated packaging material feed roll shown in FIG. 18. A feed roll R3 shown in FIG. 19 shows the feed roll R2, shown in FIG. 18, which is rewound such that the direction of inclination of the pleat h faces the opposite direction to the issuing direction. In particular, the symbol F3 indicates packaging material having a pleat h which is inclined in the opposite direction to the issuing direction of packaging material from the feed roll.

In the feed roll R3, the formation position of the pleat h is removed from cut marks K by a dimension A. This dimension A is required for forming the bottom face portion of a polygonal bottom pouch. Note that the cut marks K are elements which may be arbitrarily provided.

Figure 20:
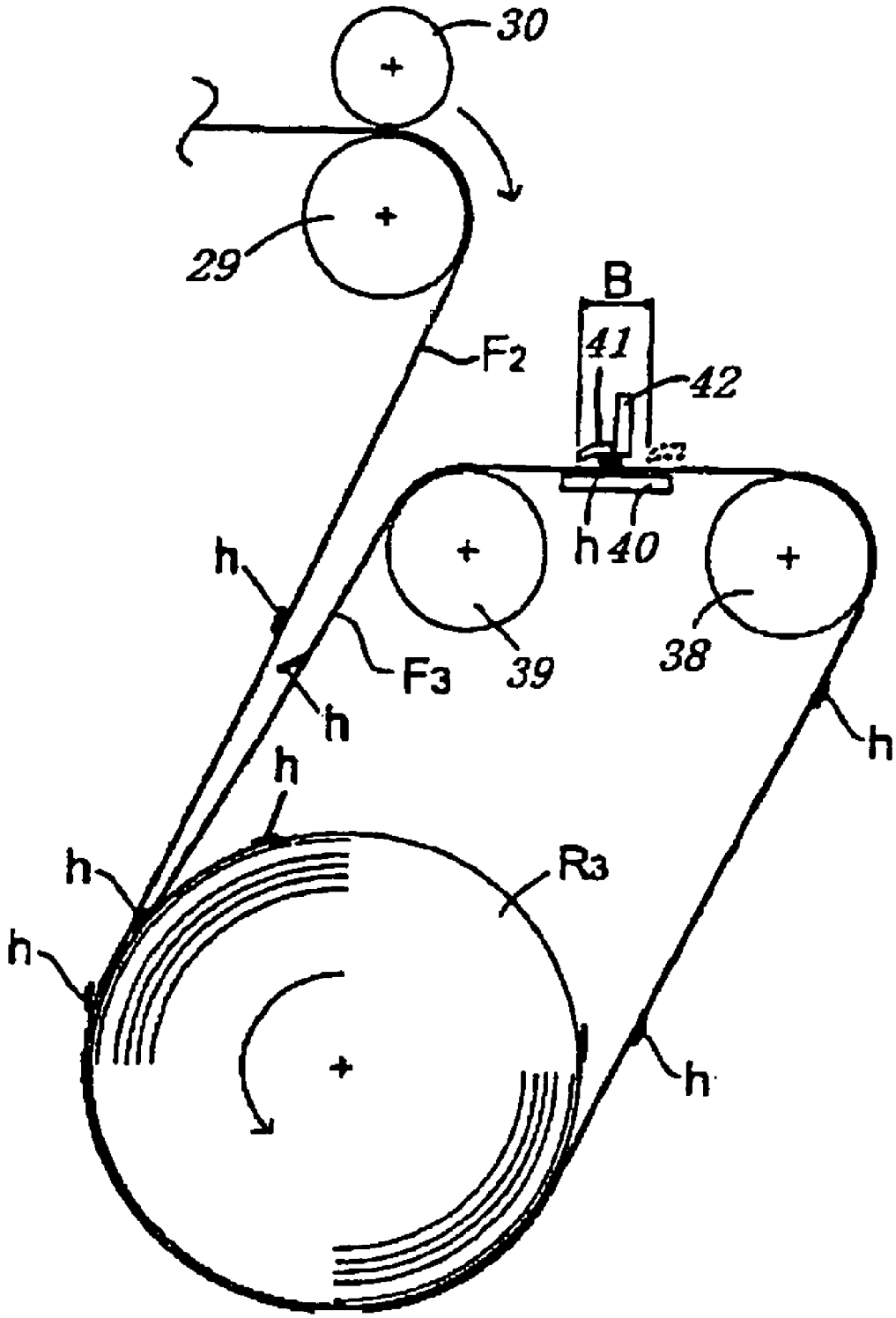
FIG. 20 is a front view of a device for changing the inclination of pleats to the opposite direction.

FIG. 20 shows a device for folding back the inclination direction of a pleat. The figure illustrates the main parts of a device which produces a pleated packaging material F3 in which the inclination of the pleat h is folded back in the winding direction without winding a packaging material F2 with pleats h and winds this packaging material F3 as a feed roll R3 so that rewinding is not required.

More specifically, the pleated packaging material F2 passes between the packaging material transferring roll 29 and the freely rotating nip roll 30 and then, in order to wind the feed roll R3, hooked onto guide rolls 38, 39 and wound as the feed roll R3. A support plate 40 which contacts the inner surface side of the pleated packaging material F2 is provided between the guide rolls 38, 39, and when the pleat h arrives at a predetermined position on the support plate 40, winding of the feed roll R3 is briefly halted and a lifting plate 41 is caused to slide by a dimension B along the upper face of the support plate 40 in the direction of movement of the packaging material to thereby lift the pleat h and incline the pleat h in the opposite direction. The base portion of the inclined pleat h is then pressed down by a heater 42 heated to between 80 and 100° C., for example, such that the packaging material can maintain the pleat h inclined in the opposite direction, whereupon the packaging material is wound as packaging material F3 having a pleat h which is inclined in the direction of winding. The lifting plate 41 performs a box motion, rising and then returning to its original position.

It is further preferable to cool the pleat h in a cooling device after inclining the pleat h in the direction of motion in order to prevent the pleat from standing up.

When the device for folding back the inclination direction of a pleat is used, the pleat inclining means 28 is unnecessary.

Figure 21:
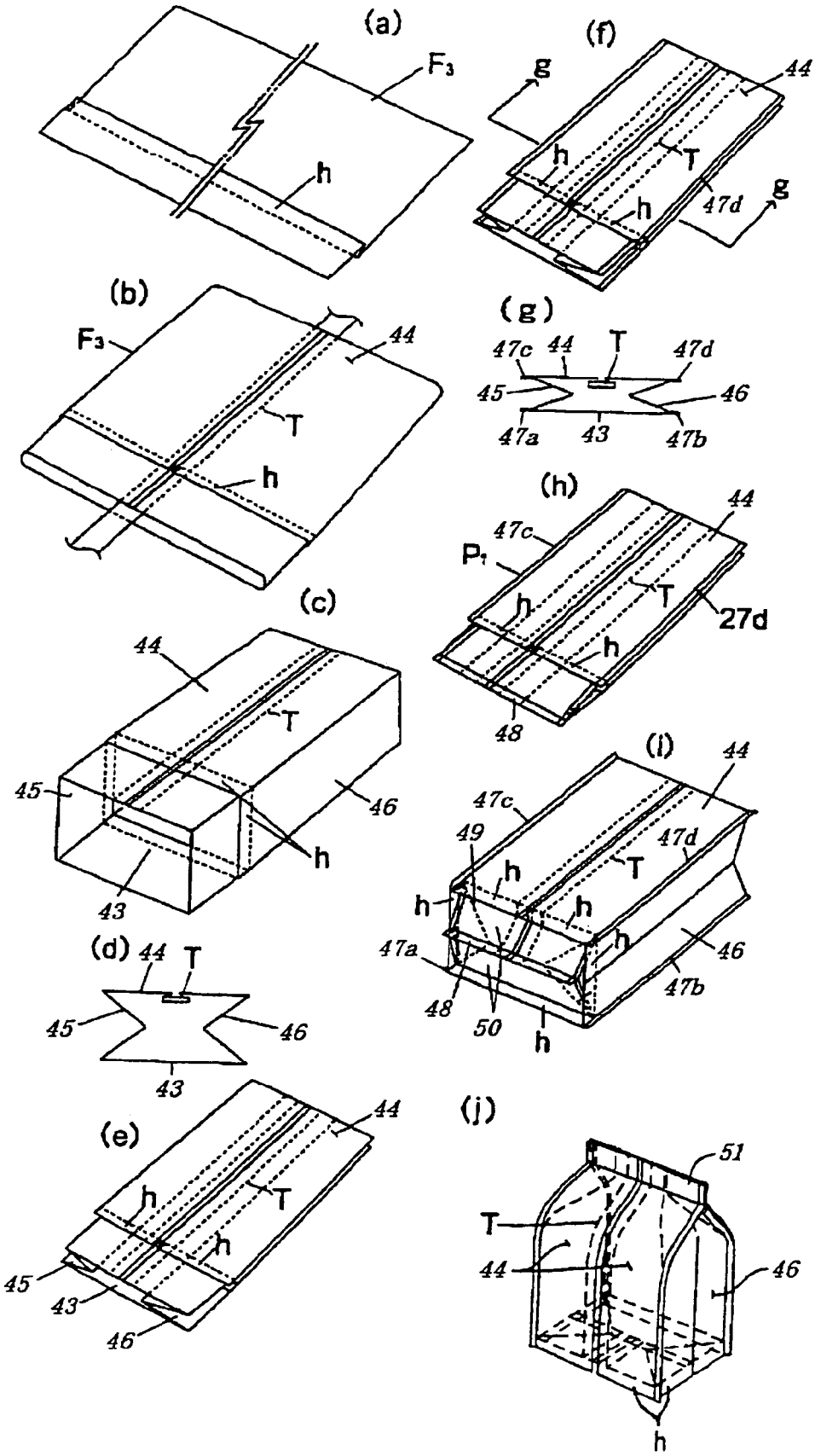
FIG. 21 is a pouch manufacturing and packaging process diagram for illustrating a process of manufacturing a pleated flattened pouch using the pleated packaging material according to the present invention shown in FIG. 19 and then forming a package body using the pouch.

Next, a process for manufacturing a pleated flattened pouch in pouch units from a pleated packaging material according to the present invention will be described with reference to FIG. 21. FIG. 21(*a*) is a perspective view of a packaging material formed with pleats. FIG. 21(*b*) is a perspective view showing the packaging material formed into a flattened tube having pleats.

FIG. 21(*c*) is a perspective view showing the tube opened into a prismatic tubular form. FIG. 21(*d*) is a view seen from the tubular direction of side gussets being formed. FIG. 21(*e*) is a perspective view showing the flattened tube with side gussets. FIG. 21(*f*) is a perspective view showing the side-gusseted flattened tube with ribs attached to both sides. FIG. 21(*g*) is a cross section along the g—g line in FIG. 21(*f*). FIG. 21(*h*) is a perspective view of a flattened pouch having pleats. FIG. 21(*i*) is a perspective view showing the pleated flattened pouch opened out into three dimensions. FIG. 21(*j*) is a perspective view showing the opened out pouch filled with a packaged product and sealed at the opening.

A flattened pouch P1 with a pleat as shown in FIG. 21(*h*) is manufactured by wrapping a packaging material F3 formed with a pleat h as shown in FIG. 21(*a*) substantially once into a flattened tubular form without sharp folds, as shown in FIG. 21(*b*), abutting the two edges of the packaging material F3 at the center of the width of the rear face portion 44 so as to leave no gaps therebetween, applying a three-ply connecting tape T having sealant layers on both sides so as to form a seam on the inner side of the flattened tubular form, applying a heat seal to the connecting tape T on the two edges of the packaging material F3, and thus forming a flattened tube without hems. Then, as shown in FIG. 21(*c*), the tubular form is opened into a prismatic tube form, the right side face portion 45 and left side face portion 46 are folded inward twofold as shown in FIG. 21(*d*) to form a pair of side gussets interposed between the front face portion 43 and rear face portion 44 and thereby produce a flattened pouch having hems and side gussets as shown in FIG. 21(*e*). Then, as shown in FIGS. 21(*f*), (*g*), rib-forming heat seals are applied to the two four-ply side edges to form four ribs 47*a*, 47*b*, 47*c*, 47*d*, and finally a bottom heat seal 48 is applied to the lower edge as shown in FIG. 21(*h*) such that the upper edge becomes the pouch opening.

When the pleated flattened pouch P1 shown in FIG. 21(*h*) is opened out into three dimensions, as shown in FIG. 21(*i*), the part below the pleat h is opened flat to form a bottom face portion 50 while a bottom gusset 49 with triangular pockets on either side is inserted therein. The pleat h is suspended around the periphery of the bottom face portion 50 and shares an identical plane with the front face portion 43, right side face portion 45, left side face portion 46, and rear face portion 44, and thus does not appear to be independent therefrom. As a result, an impression of a tightly sealed package is obtained, the bottom face portion 50 is concealed by the pleat h, and a stable self-standing pouch is obtained.

The pouch is filled with a packaged product, and a top heat seal 51 is applied to form a hipped upper face portion with a top gusset as shown in FIG. 21(*j*). Note that this embodiment is not limited to the formation of a top gusset.

Figure 22:
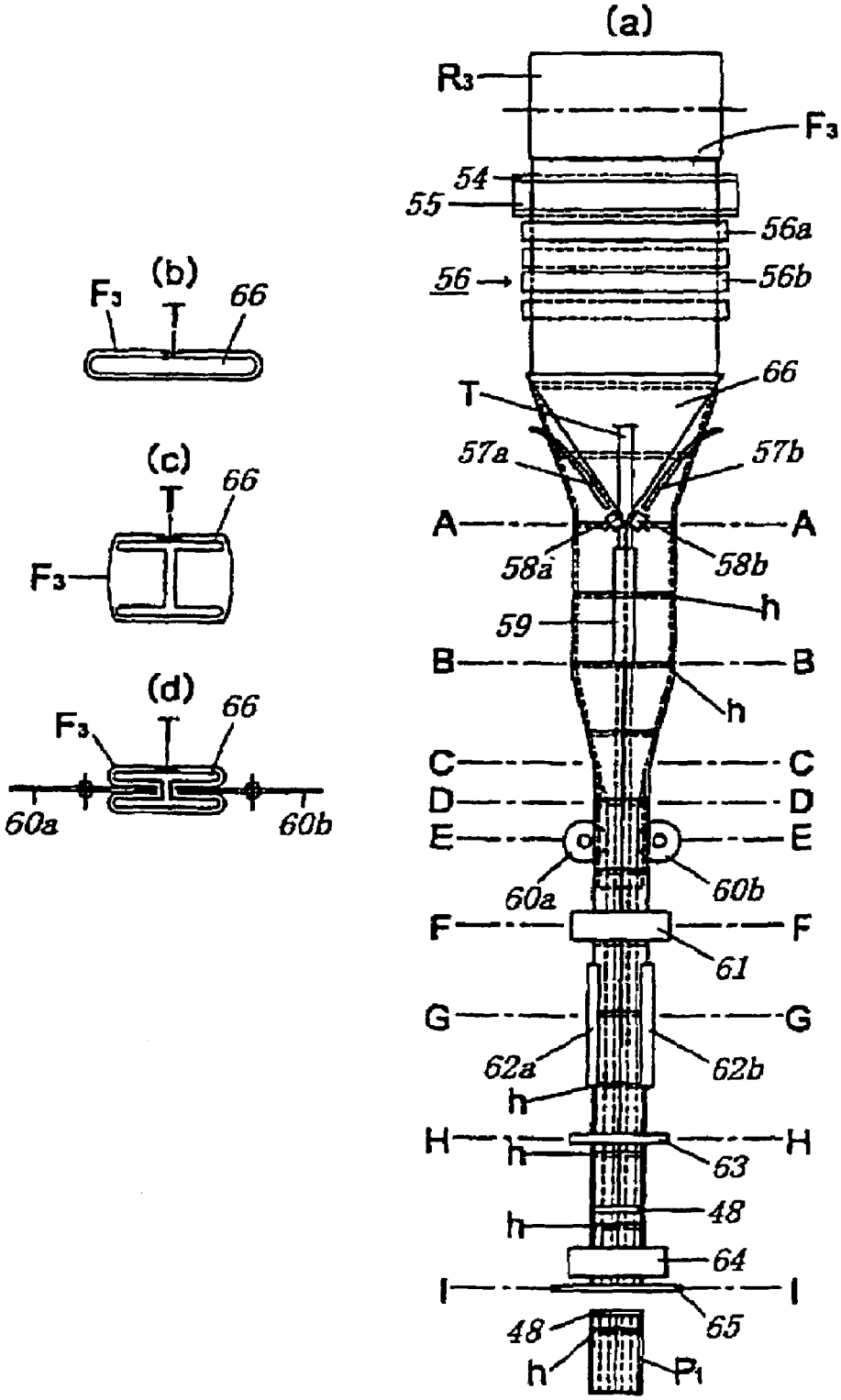
FIG. 22 shows a method for manufacturing a feed roll of a pleated packaging material according to the present invention.

As shown in FIG. 22, the pleated packaging material according to the present invention makes it possible to continuously mass produce pleated flattened pouches on a pouch manufacturing device. FIG. 22 shows a schematic overall plan view of a pouch manufacturing device for implementing a manufacturing method for a pleated flattened pouch and which is capable of mass-producing the pleated flattened pouch P1 shown in FIG. 21(*h*).

The symbol R3 indicates a feed roll for the packaging material F3 having pleats. The symbol 54 indicates a packaging material issuing roll which is driven at increasing and decreasing speeds by a servo motor, not shown, in order to feed the pleated packaging material F3 from the feed roll R3 in conjunction with a freely rotating nip roll 55. The pleats h which are formed in the packaging material F3 are inclined in the direction of issuance (see FIG. 19).

The symbol 56 is an accumulator which functions to reduce the issuing resistance against the pull of the downstream side packaging material F3 by placing two integrally connected dancer rollers 56*a*, 56*b* on the packaging material F3 that is issued from the packaging material issuing roll 54 such that the packaging material F3 meanders past these dancer rollers 56*a*, 56*b* vertically as seen from the side, thereby stably feeding the packaging material F3.

The symbol 66 indicates a former, the symbols 57*a*, 57*b* indicate bending guides, the symbols 58*a*, 58*b* indicate film guide rollers, the symbol 59 indicates a bar-type back-sealing heat sealer, and the symbols 60*a*, 60*b* indicate freely rotating side gusset-inserted folding rolls. The symbol 61 indicates a packaging material retracting roll which is provided in an upper and lower pair and is designed to grasp the side gusseted flattened tube part and pull the tube part downstream by feeding the packaging material at an equal arrangement pitch to the pleats. The symbols 62*a*, 62*b* are rib-forming heat sealers. The symbol 63 is a bottom heat sealer which is provided in an upper and lower pair so as to grasp the side gusseted flattened tube part and apply a bottom heat seal. The symbol 64 indicates a packaging material retracting roll which is provided in an upper and lower pair and is designed to grasp the side gusset inserted flattened tube part and pull the tube part downstream so as to intermittently feed the packaging material at an equal arrangement pitch to the pleats in synchronization with the aforementioned packaging material retracting roll 61. The symbol 65 is a cutter. A connecting tape T which is issued from a connecting tape feed roll, not shown, is mounted on a former 66 so as to seal the edges of the packaging material F3 together from the inside thereof.

Next, a manufacturing method for a pleated flattened pouch will be described.

The packaging material issuing roll 54 issues the pleated packaging material F3 from the packaging material feed roll R3, and the packaging material retracting rolls 61, 64 issue the packaging material intermittently in lengths equal to the total dimension of the pouch height, the dimension required to form the bottom face portion from the pleat to the bottom heat seal (which is preferably a substantially equal dimension to the dimension of the side gusset fold), and the required dimension for the bottom heat seal. The pitch of the pleat h which is formed in the pleated packaging material F3 is equal to the total dimension of the pouch height, the dimension required to form the bottom face portion from the pleat to the bottom heat seal, and the required dimension for the bottom heat seal.

Next, the pleated packaging material F3 is folded into a flattened tube by the former 66, and the edges of the packaging material F3 are connected by heat sealing using the bar-type back-sealing heat sealer 59 and via the connecting tape T. In the section from A—A to B—B in FIG. 22(*a*), the former 66 has a horizontal thick plate cross sectional form as shown in FIG. 22(*b*) such that the pleated packaging material F3 is formed into a flattened tube as shown in FIG. 21(*b*). In the section from C—C to D—D in FIG. 22(*a*), the former 66 has a cross section in the form of a sideways "H" as shown in FIG. 22(*c*), and thus the pleated packaging material F3 is formed into a prismatic tube as shown in FIG. 21(*c*). At E—E in FIG. 22(*a*), the former 66 has across-section in the form of a sideways "H" in which the dimension between the upper and lower faces is reduced, as shown in FIG. 22(*d*), and the freely rotating side-gusset folding rolls 60*a*, 60*b* are inserted into the two sides thereof to form side gussets as shown in FIG. 21(*d*). At F—F in FIG. 22(*a*), folding of the side gusseted flattened pouch is completed by the packaging material retracting roll 61 as shown in FIG. 21(*e*).

Next, at G—G in FIG. 22(*a*), the four ribs 47*a*, 47*b*, 47*c*, 47*d* are provided by applying a rib-forming heat seal to the two four-ply edges as shown in FIGS. 21(*f*), 21(*g*) using the rib-forming heat sealers 62*a*, 62*b*. At H—H in FIG. 21(*a*), the bottom heat seal 48 is applied as shown in FIG. 21(*h*) using a bottom heat sealer 63.

In FIG. 22(*a*), the position of the bottom heat sealer 63 is upstream of the second pleat h from the side of the cutter 65 by a substantially equal dimension to the dimension of the fold in the gusset, and therefore the bottom heat seal is applied upstream by a substantially equal dimension to the dimension of the fold in the gusset apart from the pleat.

At I—I in FIG. 22(*a*), the upstream side of the bottom heat seal 48 is cut by the cutter 65 and the pleated flattened pouch P1 of the upper edge opening type as shown in FIG. 21(*h*) is cut off to thereby complete pouch manufacturing.

Figure 23:
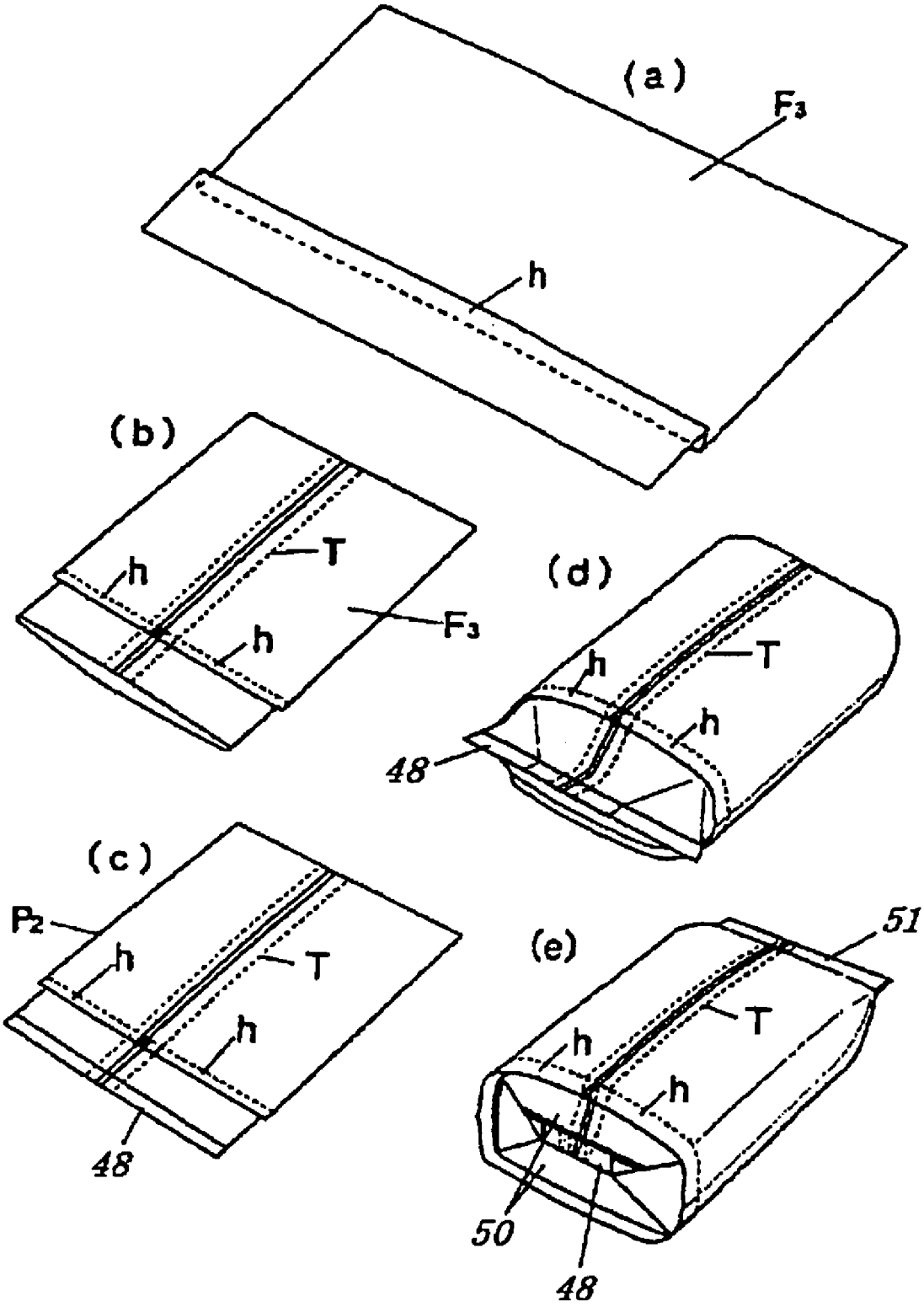
FIG. 23 is a manufacturing process diagram illustrating the manufacture of pillow type pleated flattened pouches which are manufactured in pouch units using the pleated packaging material feed roll of the present invention.

By omitting the folding step of side gussets and the heat sealing step of forming the ribs in the pouch manufacturing device of FIG. 22, the pillow type pleated flattened pouch shown in FIG. 23(*c*) can be mass-produced and manufactured. In this case, the side gusset folding rolls 60*a*, 60*b* and the rib forming heat sealers 62*a*, 62*b* in the pouch manufacturing device shown in FIG. 22 become unnecessary.

Further, it is assumed that former 66 is constituted by a plate in which the downstream side is square and the upstream side is trapezoid.

The pleated flattened pouch P2 shown in FIG. 23(*c*) can be manufactured into an upper end opening type flattened pouch by hooking the packaging material F3 formed with pleats h to the former 66 shown in FIG. 22 and wrapping the packaging material F3 substantially once into a flattened tubular form without sharp folds (hems), as shown in FIG. 23(*b*), abutting the two edges of the packaging material F at the center of the width of the rear face portion so as to leave no gaps therebetween, applying a three-ply connecting tape T constituted by a double-sided sealant film so as to form a seam on the inner side of the flattened tubular form, heat sealing the edges of the packaging material F3 through the connecting tape T using the bar-type back-sealing heat sealer 59 to form the packaging material F3 into a flattened tube without hems, applying a bottom heat seal 48 to the lower end as shown in FIG. 23(*c*) using the bottom heat sealer 63, cutting the packaging material F3 at the upstream side of the end of each bottom heat seal, and severing the packaging material F3 to form an upper end opening type pleated flattened pouch.

In this case, the distance from the pleat h to the bottom heat seal 48 may be determined freely.

To fill the pouch with a product to be packaged, as shown in FIG. 23(*d*), the upper portion of the pleated flattened pouch is opened and the pouch is filled with the product. Then, as shown in FIG. 23(*e*), a top heat seal 51 is applied to form a hipped upper face portion with a top gusset. When the pouch is filled with the product, the part below the pleat h opens out laterally. When the two end parts of the bottom heat seal 48 are folded inward as parallel triangular ears, as shown in FIG. 23(*e*), the two ears form a folded bottom face portion 50 which is concealed inside the pleat h. The pleat h forms an extension of the peripheral surface such that the rear face upper end of the pleat lies substantially at a right angle to the bottom face portion 50, and thus the bottom face portion is concealed.

Note that it is not absolutely necessary to form a top gusset.

In this pleated flattened pouch and the package body thereof, since the pleat h is suspended from the peripheral edge of the bottom face portion 50 and the pleat h forms an extension of the peripheral surface portion on an identical plane thereto, the pleat alone does not appear to be independent and thus an impression of a tightly sealed package is obtained. Further, since the pleat h conceals the bottom face portion 50, the pleated flattened pouch achieves a stable self-standing quality.

A manufacturing process for a pleated flattened pouch P3 shown in FIG. 24(*a*) will now be described. A pleated packaging material F3 is issued from the feed roll R3 for the pleated packaging material shown in FIG. 19, cut in half and separated into upper and lower pieces to be continuously forwarded as a front face portion and a rear face portion along the horizontal plane. A packaging material to be used as side faces is then folded in two along the center of width to form side gussets and inserted between the above upper and lower pieces of the pleated packaging material, whereupon a rib-forming heat seal is applied to the two four-ply edges to form a flattened tube. A bottom heat seal is then applied to the upstream side of each pleat at a substantially identical dimension to the dimension of the fold in the side gussets, whereupon the packaging material is cut the upstream side of the end of each bottom heat seal.

Figure 24:
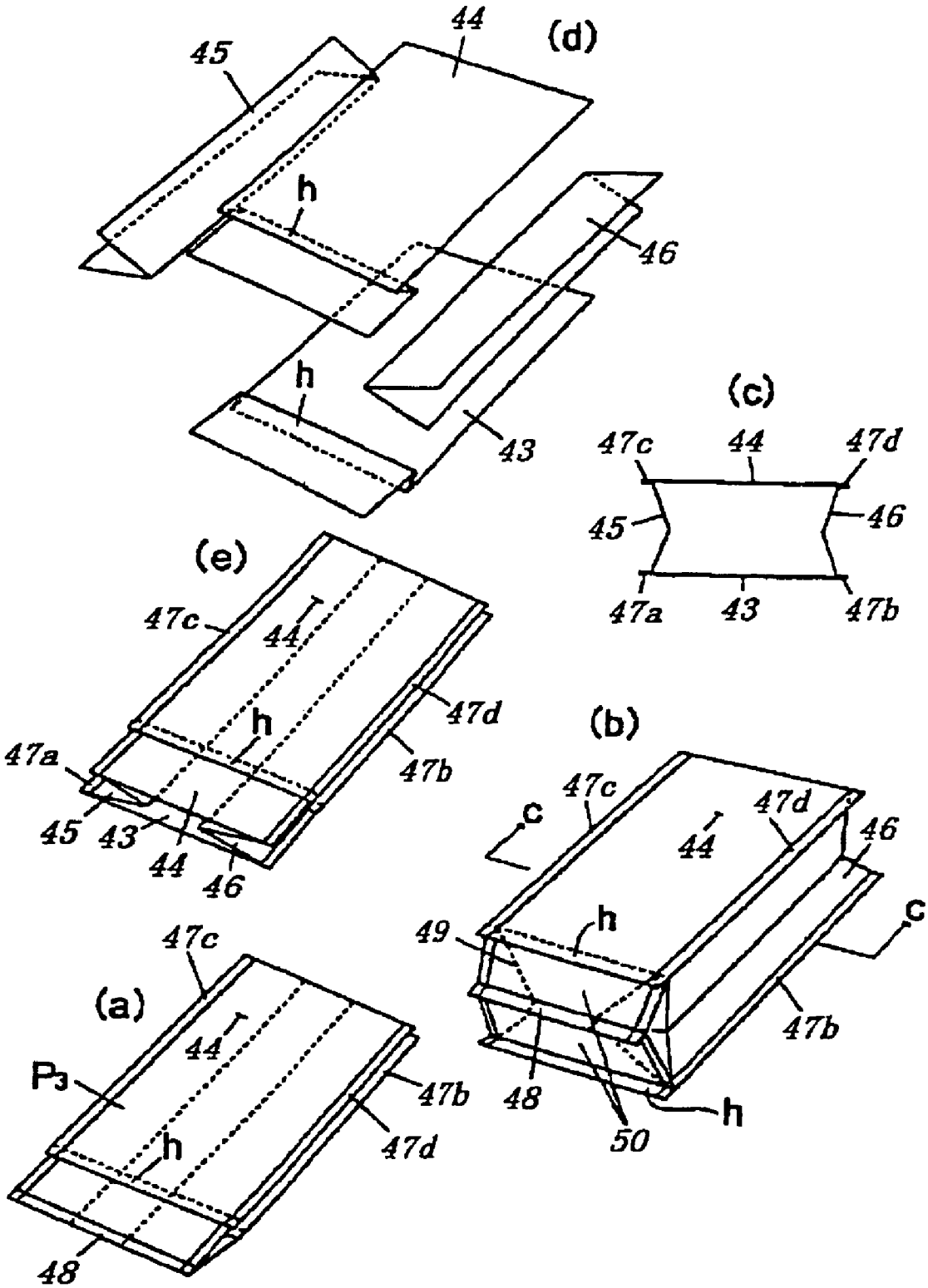
FIG. 24 is a manufacturing process diagram illustrating the manufacture of pleated flattened pouches which are manufactured in pouch units using a pleated packaging material feed roll of the present invention.

As shown in FIG. 24(*d*), this pleated flattened pouch P3 is manufactured by superposing packaging materials 43 and 44 formed with a pleat h, inserting side gussets, i.e., packaging materials 45 and 46 folded in two without a pleat to form side face portions, between the packaging material 43 and 44, applying a rib-forming heat seal to the two four-ply edges as shown in FIG. 24(*e*) to form a side-gusseted and ribbed flattened tube, and applying a bottom heat seal 48 to the lower end as shown in FIG. 24(*a*) such that the upper end becomes the pouch opening. The distance from the pleat h to the bottom heat seal 68 is substantially the same as the dimension of the fold in the side gussets.

To fill the pouch with a product to be packaged, the upper portion of the pleated flattened pouch is opened as shown in FIG. 24(*b*). Pleats h are provided on the lower edge of the front face portion and the lower edge of the rear face portion of the pouch, thereby concealing the bottom heat seal 48 when seen from a front or rear face direction. As can be understood from a comparison of FIGS. 24(*b*) and 21(*i*), the pleated flattened pouch P3 shown in FIG. 24(*a*) differs from the pleated flattened pouch P1 shown in FIG. 21(*h*) in that pleats h are provided on the lower edge of the front face portion and the lower edge of the rear face portion rather than on the four lower edges of the bottom face portion. The pleat h is substantially right-angled to the bottom face portion 50 from the upper end of the pleat rear surface and thereby conceals the bottom face portion.

In this pleated flattened pouch, the pleat h lies in the same plane as the front face portion 43 and the rear face portion 44 and therefore the pleat alone does not appear to be independent therefrom. As a result, the bottom face portion 50 is concealed and a stable, stand-up prismatic pouch with a polygonal bottom is obtained.

The packaging material F1 used for manufacturing the pleated packaging material F3 of the present invention is constituted by a similar laminated film or the like as the packaging material F used in the description of the first embodiment, for example.

In order to form the pleat h using a heat seal, the packaging material F1 has an inner surface constituted by a sealant film, as is understood from the aforementioned examples of laminated film. Note that the packaging material may be constituted-solely by sealant film.

A reinforced pleat h is comprised in the feed roll for the pleated packaging material according to the present invention. More specifically, the pleat is formed by folding the inner surface of the packaging material into a pinch form and applying a heat seal, but a strip-form or twofold reinforcing material may be interposed between the twofold pinch pleat to form a three-ply, four-ply or greater pleat. The reinforcing material has a double-sided heat sealing quality and is therefore integrated with the pleat h formed in the packaging material F1 upon lamination.

As a method for attaching the reinforcing material, the reinforcing material is issued from a reinforcing material feed roll on the upstream side of the pleat-forming device shown in FIG. 18 and to the side of the packaging material F1, whereupon the reinforcing material is laid on the upper surface of the packaging material F1 in alignment with the width of the packaging material F1 and cut. The cut reinforcing material is then point sealed to the packaging material F1, and at the following intermittent stop in the intermittent motion of the packaging material, or several stops later, the cut reinforcing material is brought to the pleat-forming device 27 shown in FIG. 18, and when the pleat h is formed, the reinforcing material is inserted into the pinch pleat portion of the packaging material F1 at a substantially equal width to the width of the fold in the pinch pleat without being folded into a pinch form. Alternatively, the reinforcing material may be folded into a pinch form integrally with the packaging material F1 at a width substantially twice the width of the fold in the pinch fold. Note that although doing so lengthens the intermittent stoppage period of the packaging material F1 at the pinch portion of the packaging material F1, the reinforcing material may be issued from the reinforcing material feed roll, laid on the upper surface of the packaging material F1 in alignment with the width of the packaging material F1, cut, and heat sealed to the packaging material F1 at the location of the pleat-forming device 27.

When reinforcing material is used, an anti-buckling force can be attained even if the packaging material F1 is thin, and thus a stable standing quality is achieved.

A single layer packaging material or laminated packaging material having a double-sided heat sealing property may be used as the reinforcing material. For example, LDPE, LLDPE, CPP, double-sided heat seal type OPP, OPP or paper coated with a heat sealing agent on both sides thereof, PE/PET/PE, PE/OPP/PE, PE/paper/PE, CPP/PET/CPP, CPP/OPP/CPP, CPP/paper/CPP, and so on may be used.

The pleat-forming device shown in FIG. 18 may be constituted with a box motion function. In this case, the packaging material F1 may be issued from the packaging material issuing roll 29 shown in FIG. 18 continuously rather than intermittently.

To describe a specific constitution for ensuring a box motion, when the pleat folding location of the packaging material F1 corresponds to the gap between the gap forming plates 27*a*, 27*b* which are in an upstream standby position, all of the constitutional elements of the pleat-forming device 27 are set in motion synchronously with the running of the packaging material F1, and during this synchronous motion the pleat is formed and the pleat-forming heat seal is applied. Once the pleat has been formed, the gap forming plates 27*a*, 27*b* return to the upstream standby position.

FIG. 22 illustrates an embodiment of a method for manufacturing a pleated flattened pouch using the pleated packaging material of the present invention. However, the pleated packaging material of the present invention may be manufactured into a pleated pillow package body using a vertical form-fill-seal machine or a horizontal form-fill-seal machine. The pleat is issued inclined in the opposite direction to the direction of issuance, and can therefore be smoothly folded into a tubular form without catching on the former. In the case of a vertical pillow package body, the packaging material is turned upside down such that the pleat is at the lower end. In the case of a horizontal pillow package body, the packaging material is rotated by 90 degrees such that the end heat seal on the front side of the direction of motion faces upward and the pleat is at the lower end. Further, the manufacturing method for a feed roll for pleated packaging material of the present invention may also be applied to a pouch with a pleat in an intermediate position or on the upper end, rather than solely on the lower end.

When a packaging pouch or package body is produced by a pouch forming machine or a form-fill-seal machine using the pleated packaging material feed roll of the present invention, the pleat of the pleated packaging material which is issued from the feed roll must be attached to the former of the pouch forming machine or form-fill-seal machine in the inclined state in an opposite direction to the direction of issuance so that the pleat does not catch upon the former. When the pleat of the pleated packaging material issued from the feed roll is inclined in the direction of issuance, as is the pleat in the pleated packaging material feed roll manufactured by the device shown in FIG. 18, the pleated packaging material feed roll may simply be rewound such that the pleat is inclined in the opposite direction, and hence it is not a required constitutional condition of the pleated packaging material feed roll of the present invention that the pleat be wound in the inclined state in an opposite direction to the direction of issuance.

Next, the vertical form-fill-seal machine illustrated in FIGS. 25 and 26 will be described.

Packaging material F4 which is issued from a packaging material feed roll R is hooked onto a guide roll 71 and then drawn through a packaging material issuing roll 72 which is driven at increasing and decreasing speeds by a servo motor, not shown, and a freely rotating nip roll 73. The packaging material F4 is then hooked onto a dancer roller 74 and then hooked onto guide rolls 75, 76.

The dancer roller 74 functions to lightly and fixedly maintain issuing resistance against the pull of the downstream side packaging material F4. When the dancer roller 74 falls to the lower limit position, the packaging material issuing roll 72 reduces the amount of film issued, and when the dancer roller 74 rises to the upper limit position, the packaging material issuing roll 72 increases the amount of film issued.

The packaging material F4 then passes through a pleat-forming device 77 where the inner surface thereof is heat sealed into a pinch form to thereby form a pleat h which extends in an orthogonal direction to the running direction of the packaging material F4. The packaging material F4 then passes through pleat inclining means 78 which incline the pleat h rearward of the direction of motion.

The pleat-inserting device 77 is constituted by upstream side and downstream side gap forming plates 77*a*, 77*b* adhered to the lower face (outer face) of the packaging material F4, pleat forming heat sealers 77*c*, 77*d* which correspond to the lower side of the gap forming plates 77*a*, 77*b*, packaging material pushing plates 77*e*, 77*f* which are provided in correspondence with the upper side of the gap forming plates 77*a*, 77*b* and which hold down the packaging material F4 toward the gap forming plates 77*a*, 77*b*, and a pleat forming plate 77*g* which is provided on the upper side of the packaging material F4 between the gap of the gap forming plates 77*a*, 77*b* and which forms a pleat by descending through the gap.

The pleat h is formed during a stoppage in the intermittent motion of the packaging material F4. First, the packaging material pushing plate 77*f* descends to hold down the packaging material F4 toward the gap forming plate 77*b*, then the pleat forming plate 77*g* forms a pleat by descending to push the packaging material F4 between the gap in the gap forming plates 77*a*, 77*b*, then the packaging material pushing plate 77*e* descends to hold down the packaging material F4 toward the gap forming plate 77*a*, whereby the pleat forming plate 77*g* returns to its original raised position, then the pleat forming heat sealers 77*c*, 77*d* are closed to apply a heat seal to the pleated pinch portion of the packaging material F4 and thereby form the pleat h, and finally the pleat forming heat sealers 77*c*, 77*d* are opened, the packaging material pushing plates 77*e*, 77*f* return to their original raised position and the packaging material F4 can continue to move.

Note that an operating sequence in which the pleat forming plate 77*g* descends and performs pleat folding initially, whereupon the packaging material pushing plates 77*e*, 77*f* descend to hold down the packaging material F4 and the pleat forming plate 77*g* rises may also be implemented.

In the drawing, a pair of freely rotating rolls are used as the pleat inclining means 78, but these means are not limited thereto, and instead an upper and lower pair of flat plates may be provided such that a gap of 1.5 mm to 3.0 mm, for example, is formed to allow the passage of the packaging material F4 while inclining the pleat h toward the upstream side.

Figure 26:
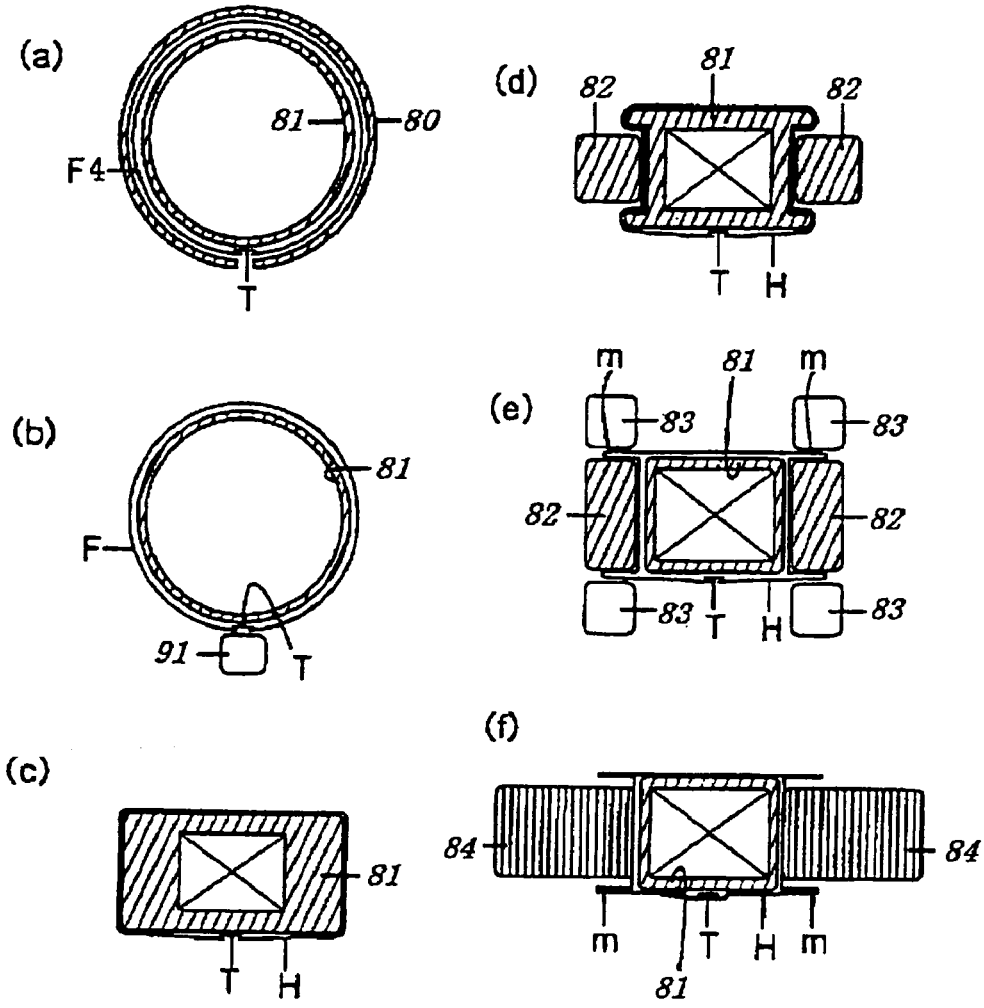
FIGS. 26(*a*)–(*f*) show horizontal sections of certain locations of the vertical form-fill-seal machine required for describing the manufacturing process.

Next, the packaging material F4 is hooked onto a guide roll 79 and then hooked onto a collar portion 80*a* of a former 80, passed through a gap between a tubular portion 80*b* with a C-shaped cross section which is opened at the front side of the former 80 and a packaged product filling tube (i.e., a tube for filling a product to be packaged) 81 which extends through the inside of the tubular portion 80*b* as shown in FIG. 26(*a*), and wrapped substantially once around the packaged product filling tube 81. The packaging material F4 is then bent such that the two edges thereof abut at the front side of the packaged product filling tube 81, and three-ply connecting tape T which is constituted by double-sided sealant film and which is issued from a reel W around which the connecting tape is wound passes through the front side of the packaged product filling tube 81 so as to seal the inside of the two edges of the packaging material F4. Then, with the packaged product filling tube 81 as a pedestal, a central heat seal bar 91 applies pressure between the two edges of the packaging material F4 and the connecting tape T to apply a heat seal as shown in FIG. 26(*b*), and thus the edges of the packaging material F4 are sealed together and a packaging tube H is formed.

Note that the pleat h in the packaging tube H is inclined upward, and is therefore able to pass through the gap between the tubular portion 80*b* of the former 80 and the packaged product filling tube 81.

Next, as shown in FIG. 26(*c*) to 26(*d*) to 26(*e*), the packaging tube H changes in accordance with changes in the cross sectional configuration of the packaged product filling tube 81. In FIG. 26(*c*), the packaging tube H becomes rectangular, in FIG. 26(*d*), the packaging tube H is provided with ribs 81*a* which form a groove on the two sides of the packaged product filling tube 81 and guides 82, 82 are pushed into this groove, and in FIG. 26(*e*) the ribs which form a groove on the two sides of the packaged product filling tube 81 are removed and the width of the guides 82, 82 is increased accordingly. The packaging tube H then intermittently passes through a gap between the guides 82 and rib-forming heat seal bars 83 in order for ribs to be folded, and during a stoppage period in the intermittent motion thereof, the rib-forming heat seal bars 83, 83 apply pressure to thereby heat seal the packaging tube H and form ribs m. Then, as shown in FIG. 26(*f*), the packaging tube H formed with ribs m is drawn by belts 84, 84 on a film transferring device to be suspended below the packaged product filling tube 81.

Each of the pleats h is inclined upward. The pitch with which the pleats h are provided is an equal length to the total dimension of the pouch height, the dimension required to form the bottom face portion from the pleat to the bottom heat seal (which is preferably a substantially equal dimension to the dimension of the side gusset fold), and the required dimension for the bottom heat seal. The film feeding device feeds film intermittently in equal lengths to the pitch with which the pleats h are provided.

Figure 25:
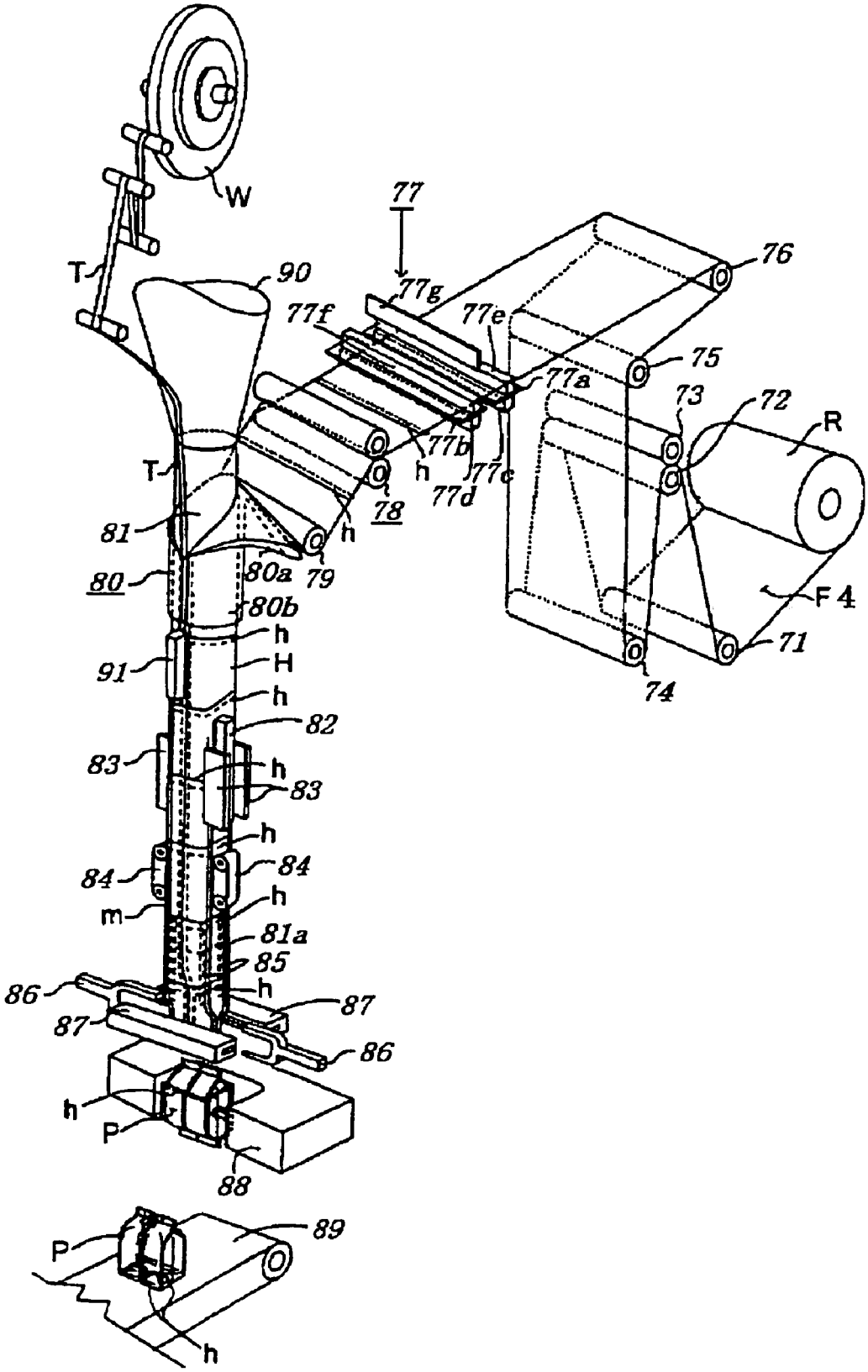
FIG. 25 is a schematic overall perspective view of a vertical form-fill-seal machine which is capable of manufacturing a vertical pillow package body having a pleat according to the present invention.

Next, as shown in FIG. 25, the packaging tube H which is suspended below the packaged product filling tube 81 is guided and maintained as a rectangular tube by four packaging tube interior corner guides 85 which are suspended from the lower end of the packaged product filling tube 81. Then, the centers of width of the right and left side faces in upper and lower positions sandwiching a cut mark position are pushed by a pair of bottom gusset forming butting rods 86 having a forked distal end to form a top gusset which will be folded inside the top heat seal of a lower vertical pillow package body which is to be subsequently heat sealed, cut, and severed, and a bottom gusset which will be folded inside the bottom heat seal of the subsequent upper vertical pillow package body P. A double heat seal (a top heat seal and a bottom heat seal) is then applied to the packaging tube H using horizontal heat sealers 87, 87, and a cut is inserted between the double heat seal by a cutter, not shown, which is installed on one of the horizontal heat sealers 87, to thereby sever the pouches.

While the double heat seal is being applied to the packaging tube H by the horizontal heat sealers 87, 87, a predetermined amount of a product to be packaged is poured into a hopper 90, descends through the packaged product filling tube 81, and is charged above the horizontal heat sealers 87, 87. When the horizontal heat sealers 87, 87 open, film feeding is performed by the belts 84, 84 on the film feeding device. The sealing cycle is repeated in this manner.

The severed vertical pillow package body P is formed with the pleat h at its upper end, and hence the two side faces of the vertical pillow package body are supported by a vacuum support and rotation means 88. Following severance, the package body is turned upside down such that the pleat h is provided on the lower end, and then placed on a conveyor 89 to be transported.

Note that since the severed vertical pillow package body P is turned upside down such that the pleat h is provided on the lower end, the top heat seal and bottom heat seal are reversed in the package body when compared with a normal vertical form-fill-seal method.

Figure 27:
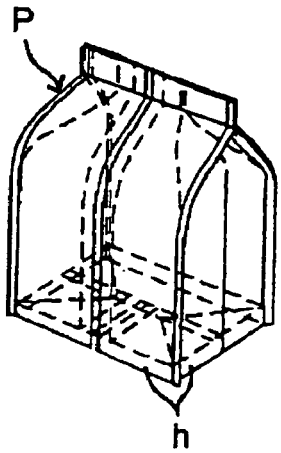
FIG. 27 shows a perspective view of a vertical pillow package body having a pleat manufactured by the vertical form-fill-seal machine of FIG. 25.

FIG. 27 shows a perspective view of a pleated vertical pillow package body which is manufactured by the vertical form-fill-seal machine described above.

In this pleated vertical pillow package body P, at the part below the pleat h, a bottom gusset is formed in triangular pocket form on both sides such that the part opens out laterally to form a bottom face portion. The pleat h is suspended substantially from the peripheral edge of the bottom face portion and the pleat h is formed in the plane of the front face portion, right side face portion, left side face portion, and rear face portion, and thus the pleat h does not appear to be independent therefrom. As a result, a stable stand-up pouch with a polygonal bottom with a bottom face portion concealed behind the pleat h, thus giving the impression of a tightly sealed package, is obtained.

The peripheral scope of the invention pertaining to a pleated vertical pillow package body will now be described.

In the vertical form-fill-seal machine shown in FIG. 25 which is capable of manufacturing a pleated vertical pillow package body, ribs do not have to be provided on the packaging tube H. In this case, the packaged product filling tube 81 may be formed as a cylinder with an equal diameter from the top end to the bottom end. Further, if the bottom gusset and top gusset are not provided, the packaging tube interior corner guides 85 do not have to be provided at the lower end of the packaged product filling tube 81. If ribs are not provided, then hems (creased edges) may be provided.

The closing of the two edges of the packaging material F4 at the front side of the packaged product filling tube 81 using the vertical form-fill-seal machine which is capable of manufacturing the pleated vertical pillow package body shown in FIG. 25 may be performed as a pinch type heat seal or as a so-called "envelope seal" in which the inner face of one of the edges is adhered to the outer face of the other edge.

In the case of an envelope seal, by cutting the outside part of the double edge of the inner side pleat h into the required form, cutting the inside part of the double edge of the outer side pleat h into the required form, and then overlapping and heat sealing these edge parts, the sealed parts of the inner side pleat h And the outer side pleat h is like a pleat of a single sheet form. Further, the position at which the two edges of the packaging material in the horizontal direction are closed together may be in the vicinity of the edge between the right side face and the rear face portion, for example, rather than in the center of the rear face portion. These examples of modification may be realized by slightly modifying the vertical form-fill-seal machine shown in FIG. 25. Further, pleats h may also be provided at the upper end and the center of the height of the pouch.

The feed roll R which is attached to the vertical form-fill-seal machine which is capable of manufacturing the pleated vertical pillow package body shown in FIG. 25 may be formed such that a packaging material is issued from a packaging material feed roll, the inner surface thereof is heat sealed into a pinch form, this pinch is inclined upstream, and the packaging material having pleats which extend along the direction of width of the packaging material and which are formed at an arrangement pitch of a predetermined dimension is wound onto the feed roll. In other words, the manufacturing method for a pleated vertical pillow package body according to the present invention may be performed in outline for the process of forming pleats in the packaging material. When pleat formation is performed in outline, the pleats are normally wound when inclined rearward of the running direction, and thus when the feed roll for the pleated packaging material is set onto a vertical pillow forming machine as is, the pleats become inclined toward the front of the running direction and catches on the former. It is therefore necessary to rewind the pleated packaging material feed roll or, following the formation of pleats in the packaging material, to use a device for inclining the pleats toward the front of the running direction and wind the pleated packaging material after using this device. In the manufacturing method for a pleated pillow package body according to the aforementioned (12) and (13), pleat formation may be performed using a different pleat-forming device to the device illustrated in the embodiments, and it is sufficient for the pleat-forming device to be able to form pleats which are heat sealed into a pinch form from the inner surface of the packaging material, which are inclined upstream, and which extend in the width direction of the packaging material.

The packaging material F4 used in the manufacture of the pleated vertical pillow package body is constituted similarly to the packaging material F4 used in the description of the first embodiment, for example, by a laminated film or the like.

In order to form the pleat h using a heat seal, the packaging material F4 has an inner surface constituted by sealant film, as is understood from the aforementioned examples of laminated film. Note that the packaging material may be constituted solely by sealant film.

Next, a manufacturing method for a pleated horizontal pillow package body according to the present invention will be described with reference to FIG. 28.

Figure 28:
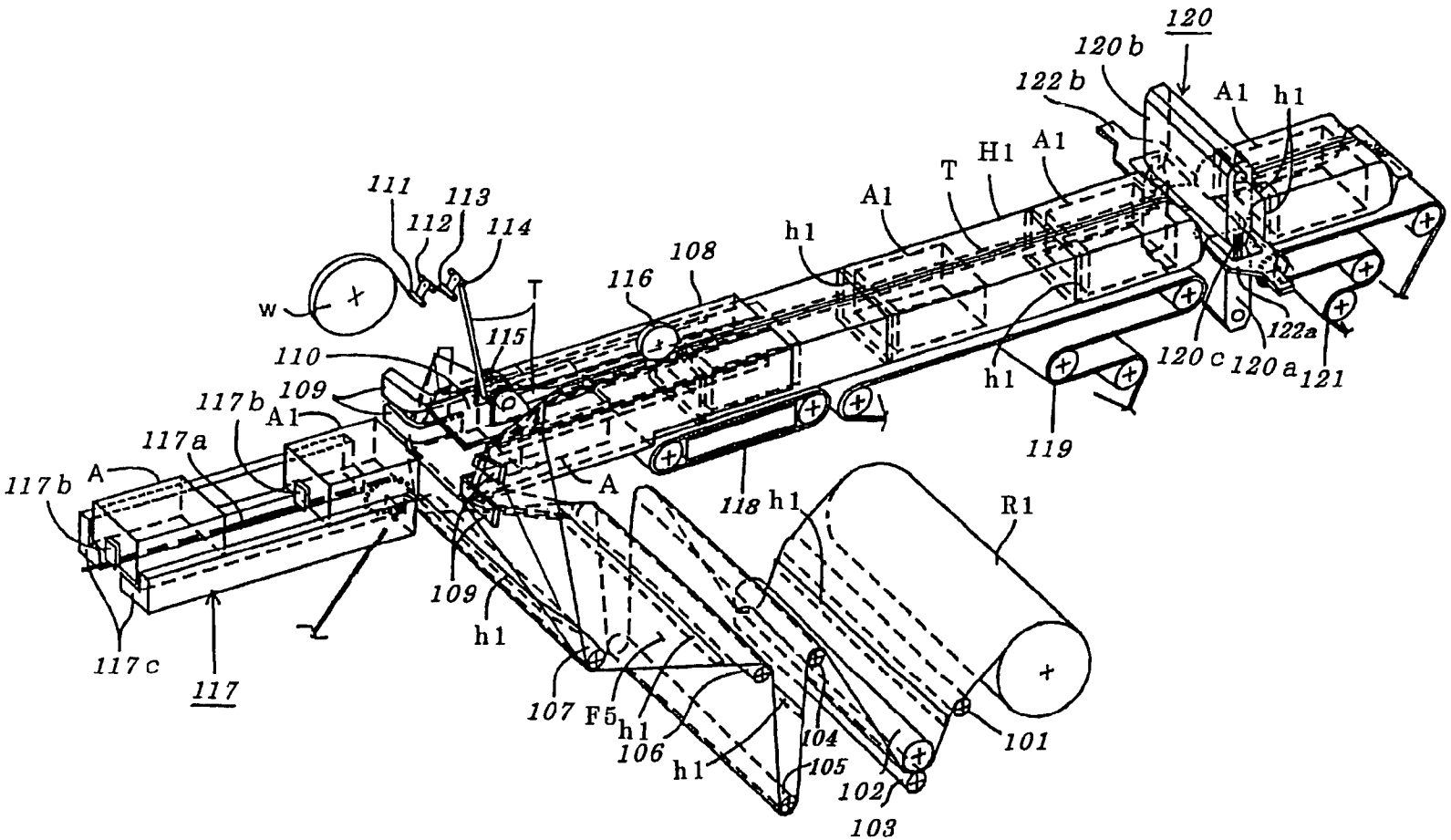
FIG. 28 is a schematic overall perspective view of a horizontal form-fill-seal machine which is capable of manufacturing a horizontal pillow package body having a pleat according to the present invention.

FIG. 28 illustrates a schematic overall perspective view of a reversed pillow type horizontal form-fill-seal machine which is capable of manufacturing a pleated horizontal pillow package body.

In FIG. 28, the feed roll R1 is a feed roll for pleated packaging material F5 which is constituted by packaging material having a heat sealing property at least on the inner surface thereof and which is formed at a predetermined pitch with pleats h1 extending in strip form in an orthogonal direction to the direction in which the packaging material is continuously issued. The pleats h1 are formed by folding the inner surface of the packaging material into a pinch form and applying a heat seal, inclined toward the upstream side of the direction of issuance, and provided in positions which are removed from planned cutting positions in an orthogonal direction to the direction in which the packaging material is continuously issued during pouch manufacture by a predetermined dimension required to form a pouch bottom face portion in the direction of packaging material issuance.

The feed roll R1 for the pleated packaging material F5 is hooked onto a guide roll 101 and then pressured between a packaging material issuing roll 102 which is driven at increasing and decreasing speeds by a servo motor, not shown, and a freely rotating nip roll 103 so as to be drawn therethrough. The packaging material F5 is then hooked onto a guide roll 104, a dancer roller 105, a guide roll 106 and a meandering correction roll 107.

The dancer roller 105 functions to lightly and fixedly maintain issuing resistance against the issuance of the downstream side pleated packaging material F5. The packaging material issuing roll 102 is rotated by a servo motor so as to reduce the amount of film issued when the dancer roller 105 falls to the lower limit position and to increase the amount of film issued when the dancer roller 105 rises to the upper limit position.

Next, the feed roll R1 of the pleated packaging material F5 which is hooked onto the meandering correction roll 107 is hooked onto a former 108 with a C-shaped cross section opened at the upper face so as to be covered thereby from bottom to top, is pushed by guide members 109, 109 to be folded into the inner face side of the former 108 at the inlet to the former 108, and moves without diverging from the inner face of the former 108. The two edges of the packaging material are abutted at the center of width by the upper face of an anvil plate 110 which is horizontally suspended so as to plug a slit in the inner surface of the former 108 from the inside, and a three-ply connecting tape T, which is constituted by a double-sided sealant film and is issued from a reel W wound with this connecting tape T, is led to the upper face of the anvil plate 110 via guide rolls 111, 112, 113, 114, 115 to underlay the two edges of the packaging material and seal the gap therebetween. A heat seal roll 116 then pressures the two edges of the packaging material F5 onto the connecting tape T with the anvil plate 110 as a pedestal to form a heat seal, whereby the edges of the packaging material F5 are sealed and a packaging tube H is formed.

Note that the pleat h1 of the pleated packaging material F5 is inclined rearward of the direction of motion, and therefore the packaging material F5 can be bent smoothly without the pleat h1 catching at the inlet of the former 108 when the packaging material F5 is folded. Inclining the pleat h1 of the pleated packaging material F5 rearward of the direction of motion is preferable but not necessary, since even if the pleats h1 incline towards the direction of forwarding of the packaging material F5, the packaging material F5 can be bent smoothly without being caught at the inlet of the former 108 when the packaging material 5 is folded.

As a rule, the pitch with which the pleats h1 are provided is an equal length to the total dimension of the pouch height, the dimension required to form the bottom face portion from the pleat to the bottom heat seal (which is preferably a substantially equal dimension to the dimension of the side gusset fold), and the required dimension for the bottom heat seal.

An import conveyor 117 on the upstream side of the former 108 moves products to be packaged A1, A1, . . . , which are placed on and supplied from a lane table 117*c* by applying pressure thereon using transportation claws 117*b* which are annexed at a constant pitch to an endless chain 117*a*, for example, such that the products to be packaged A1, A1, . . . , are transported to the inlet of the former 108 and fed into the packaging tubes H1 formed inside the former 108 at a predetermined pitch so that each product to be packaged is positioned in a required position between the pleats h1.

The packaging tubes H1 formed in the former 108 are then pulled and conveyed by a packaging material pulling belt conveyor 118 having a vacuum function which is provided on the lower side of the former 108 at a halfway point on the downstream side thereof, and then transported by a transporting shuttle conveyor 119, and are finally transported by a transporting shuttle conveyor 121 which is provided downstream of a box motion type end seal cutting device 120.

The end seal cutting device 120 is designed to perform a box motion in which heat sealers 120*a*, 120*b* gradually move closer to one another from an opened state correspondingly to the motion of the packaging tube H1 so as to be positioned between adjacent products. The heat sealers 120*a*, 120*b* mesh at the center of height of the packaging tube H1 to apply a double heat seal thereon. The heats sealers 120*a*, 120*b* then gradually move synchronously with the packaging tube H1 such that a cutter 120*c* installed in one of the heat sealers 120*b* cuts the center of the double heat seal, whereupon the heat sealers 120*a*, 120*b* separate from one another and return upstream.

The conveyors 119, 121 are constituted by shuttle conveyors in order to correspond to the box motion of the end seal cutting device 120. When the lower heat sealer 120*a* rises a gap is opened and the position of this gap varies synchronously with the movement of the heat sealer 120*a*, and when the end seal cutting operation is complete and the lower heat sealer 120*a* falls, the gap is closed. Note that the end seal cutting device may be of a rotary heat seal cutting type.

A pair of gusset forming butting claws 122*a*, 122*b* are provided to the end seal cutting device 120. When the aforementioned double heat seal is applied, this pair of gusset forming butting claws 122*a*, 122*b* butt the packaging tube H1 in the center of height on the two sides of the heat sealers 120*a*, 120*b* in the direction of delivery of the packaging material in advance of the closing operation of the heat sealers 120*a*, 120*b* to form a gusset.

Figure 29:
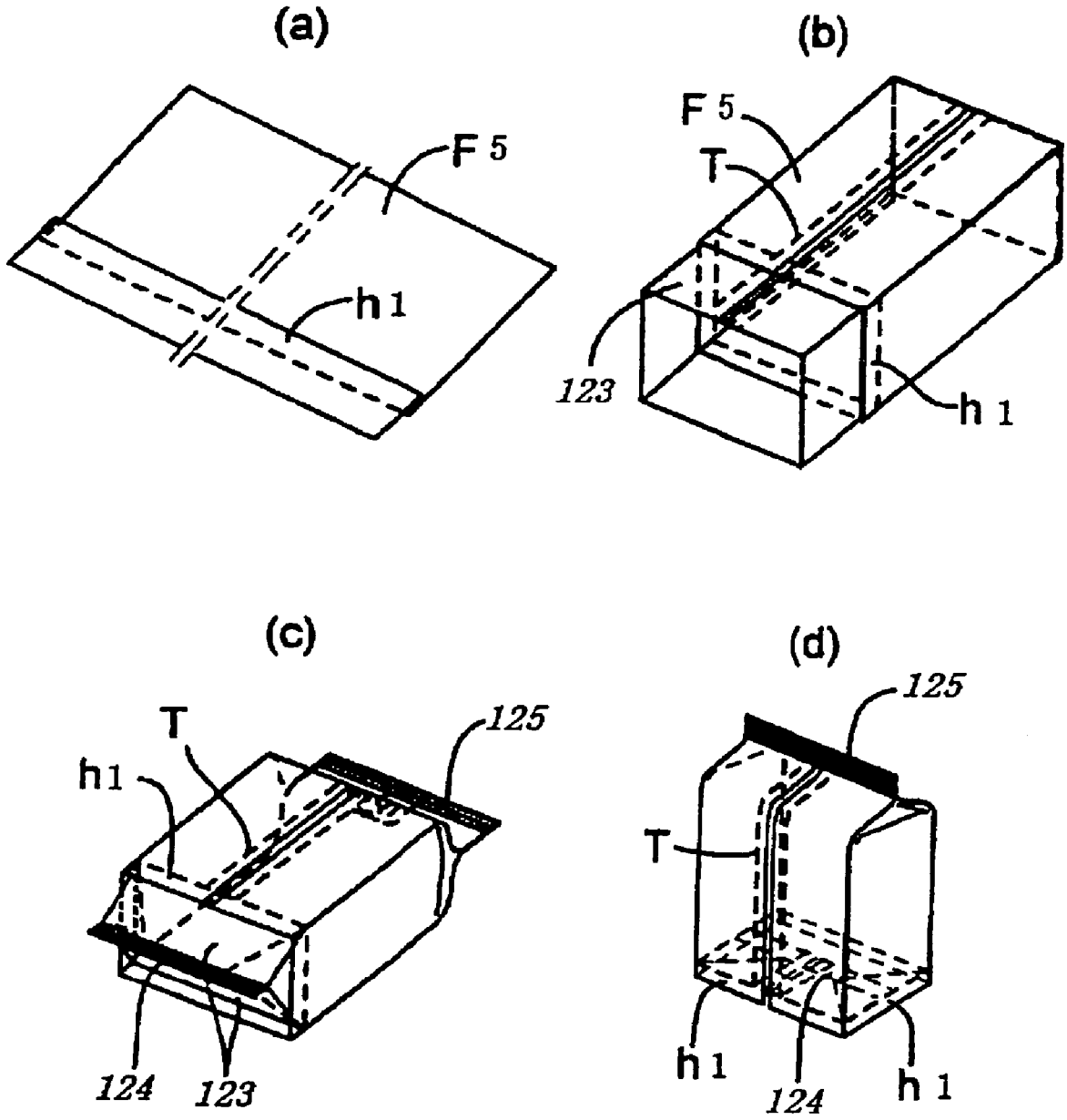
FIGS. 29(*a*)–(*d*) show a sealing process for horizontal pillow packaged bodies having a pleat.

By means of the aforementioned procedures, the packaging pouch is completed. When the severed package body is rotated 90 degrees, the pleat is suspended from the periphery of the bottom face portion, thereby concealing the bottom face portion to provide a pleated horizontal pillow package body with a stable self-standing quality and which gives the impression of a tightly sealed package. FIG. 29 is a view showing a sealing process for units of horizontal pillow packaged bodies having a pleat.

To describe this process briefly, the pleated packaging material F5 is used as shown in (a), this pleated packaging material F5 being formed by providing a packaging material having an inner surface constituted by a sealant film with a pleat h1 which extends in an orthogonal direction to the longitudinal direction of the pouch and is formed by folding a portion of the packaging material in a three-ply strip form and adhering the overlapping inner surfaces of this folded portion such that the outer face side of the pleat h1 hangs down. Then, as shown in (b), the pleated packaging material F5 is folded into a prismatic tube form having a front face portion, rear face portion, right side face portion, and left side face portion, whereupon the two edges of the packaging material are abutted in the center of the rear face portion, a three-ply connecting tape T constituted by a double-sided sealant film is applied to the inside of the abutted rear face portion to form a seal, and a heat seal is applied to the connecting tape T on the two edges of the packaging material to form a pleated prismatic tube. Once the prismatic tube has been filled with a product to be packaged (not shown), gussets are inserted into the side portions 123 below the pleat h1 while a bottom heat seal is applied thereto, as shown in (b), and similarly, gussets are inserted into the two side portions of the opposite side while a top heat seal is applied thereto, and thus a pleated gusseted-horizontal pillow packaging pouch formed with a bottom heat seal 124 and a top seal 125 is completed as shown in (c). By rotating this packaging pouch 90 degrees and forming the surface to which the bottom heat seal 124 has been applied into a bottom face portion as shown in (d), the pleat h1 is suspended around the entire periphery, thereby concealing the bottom face portion and the bottom heat seal such that a packaging pouch with a stable self-standing quality is obtained.

The peripheral scope of the present invention will now be described.

The embodiment described above illustrates forming, filling, and sealing of upside-down pillow type horizontal pouches, but this invention also includes horizontal forming, filling, and packaging of standard pillow type pouches. Further, in this embodiment a feed roll with a preformed pleat is used, but pleating may be performed in-line. Also in this embodiment, a heat seal is applied to a strip-form sealing tape along the inside of the two edges of packaging material to form a packaging tube in a prismatic tunnel form, but the packaging tube may be formed in a prismatic tunnel form by applying a pinch type heat seal to the two edges of the packaging material or by means of a direct heat seal in which the inner surface of one of the edges is adhered to the outer surface of the other edge to form a so-called "envelope seal". This embodiment illustrates an example in which gussets are formed, but gussets do not have to be formed since the part below the pleat may be concealed inside the pleat by folding without forming gussets. The width of the pleat (the length of the overlapping adhered part in the direction of issuance of the packaging material) may be increased or decreased. When a feed roll with wide pleats is used, the maximum width of the pleat is determined as a rule such that the length from the base end of the pleat to the end seal is kept shorter than half of the width of the side face portions. Thus when a feed roll with wide pleats is used, the inside of the pleat forms an empty raised bottom, allowing the completed horizontal pillow package body to be displayed on a shelf in a multi-level stacked form.

The pleated packaging material F5 is constituted by a similar laminated film to the packaging material F1 used in the first embodiment.

In order to form the pleat h1 using a heat seal, the packaging material F5 has an inner surface constituted by a sealant film, as is understood from the aforementioned examples of laminated film. Note that the packaging material F5 may be constituted solely by a sealant film.

INDUSTRIAL APPLICABILITY

As described above, the stand-up packaging pouch and package body of the present invention are constituted with a pleat which is provided at least on the lower end of a front face portion and a rear face portion or on the lower end of a peripheral face portion so as to conceal a bottom face portion and which is formed by folding a portion for the pleat of a packaging material in a three-ply strip form and adhering the inner surfaces of the folded portion. Since a flat packaging material is manufactured into a pouch following the formation of the pleat, there is no likelihood of the formation of creases in the pleat, and as a result a packaging pouch with a pleasing appearance is obtained. The pleat is positioned as an edge which extends from the front face portion or peripheral face portion, thereby being formed in the same plane as the front face and rear face portions or the entire peripheral face portion which does not appear independent therefrom, and as a result, a tight packaging form is produced so that a package body with a highly attractive appearance can be manufactured. Moreover, the sealing quality of the pleat is ensured, and therefore the package body may be favorably used as a container for liquids.

The pleated packaging material feed roll of the present invention is capable of continuously mass-producing pleated flattened pouches or pleated pillow packaging bodies by setting a pleated packaging material feed roll onto a pouch manufacturing machine or a form-fill-seal pouch machine. More specifically, the pleated packaging material feed roll of the present invention is provided with an inclined pleat, the inner surfaces of which are adhered in pinch form, and thus the feed roll can be set onto a pouch manufacturing machine or form-fill-seal machine no differently to a packaging material without a pleat. The pleated packaging material is then successfully bent and formed into a packaging tube and manufactured into a pouch no differently to packaging material without a pleat, and thus pleated flattened pouches or pleated pillow packaging bodies can be continuously mass-produced. In the pleated packaging material feed roll of the present invention, the width of the pleat can be determined arbitrarily, and if the width of the pleat is increased, the space which is surrounded by the pleat when a package body is formed can be increased such that a plurality of packaging bodies can be displayed in stacked form.

According to the manufacturing method for a pleated vertical pillow package body of the present invention, a pleat with no likelihood of creases and a pleasing appearance is obtained, and since the complete sealing quality of the pleat part is ensured, pleated vertical pillow packaging bodies can be continuously mass-produced for use as liquid containers.

Further, since the downstream side of the packaging material is not stretched when the pleat is formed, the dimension of the interval between pleats can be set accurately, and thus when the manufacturing method for a pleated vertical pillow package body is implemented, the packaging bodies are produced in a uniform size.

Moreover, the width of the pleat (the length of the pleat in the direction of motion of the packaging material) can be set at a desired dimension, and thus if a thick, strong packaging material is used to form a pouch and the width of the pleat is increased, vertical pillow packaging bodies which can be displayed in stacked form can be mass-produced.

Further, according to the manufacturing method for a pleated horizontal pillow package body of the present invention, pleated horizontal pillow packaging bodies may be continuously mass-produced using a pleated packaging material by a horizontal form-fill-seal process, and since the complete sealing quality of the pleat part is ensured, these packaging bodies may be applied as liquid containers.

The invention claimed is:

1. A stand-up packaging pouch provided in a flattened state in which at least a front face portion and a rear face portion are constituted by a packaging material having a pleat which extends in an orthogonal direction to the longitudinal direction of the pouch and is formed by folding a portion of the packaging material in a three-ply strip form and adhering inner surfaces of this folded portion, and which is provided with side gussets at both sides or one side thereof to form side face portions and has been subjected to a bottom heat seal or a top heat seal, wherein when the stand-up packaging pouch is opened out into a three dimensional state, filled with a product to be packaged, and an opening thereof is sealed, said pleat is provided at least at an edge between the front face portion and a bottom face portion and at an edge between the rear face portion and the bottom face portion in the same plane as the front face portion and rear face portion such that the bottom face portion and rear face portion of the pleat form a substantial right angle at an upper end of the rear face portion of the pleat, thereby concealing said bottom face portion when seen from the direction of the front face portion or rear face portion.

2. The stand-up packaging pouch according to claim 1, wherein ribs are formed on two side edges of said front face portion and two side edges of said rear face portion.

3. The stand-up packaging pouch according to claim 1, wherein the pouch is manufactured from a sheet of a packaging material having two pleats, the two pleats being positioned on the lower end and the upper end of at least the front face portion and rear face portion.

4. The stand-up packaging pouch according to claim 1, wherein the pouch is manufactured from a sheet of a packaging material having three pleats, the three pleats being positioned on the lower end, upper end, and in an intermediate position of at least the front face portion and rear face portion.

5. A package body which is formed by filling the stand-up packaging pouch according to claim 1 with a product to be packaged and sealing the stand-up packaging pouch.

6. A stand-up packaging pouch which is manufactured in a flattened state from a sheet of a packaging material having a pleat which extends in an orthogonal direction to the longitudinal direction of the pouch and which is formed by folding a portion of the packaging material in a three-ply strip form and adhering inner surfaces of this folded portion, and is formed by bending this packaging material such that a horizontal cross-section of the bent packaging material forms a loop, closing two edges of a rear face portion of the bent packaging material by applying a heat seal thereto to form a flattened tubular form, and applying a top heat seal or a bottom heat seal, wherein when the stand-up packaging pouch is opened into a three dimensional form, filled with a product to be packaged, and the opening thereof is sealed, said pleat is formed in the same curved plane as a peripheral face portion of the three-dimensional opened pouch such that said bottom face portion and the rear face portion of the pleat form a substantial right angle at the upper end of the rear face portion of the pleat, whereby the pleat conceals the bottom face portion, and the pouch has top gussets and bottom gussets.

7. A package body which is constituted by a sheet of a packaging material having a pleat which extends in an orthogonal direction to the longitudinal direction of a packaging pouch and which is formed by folding a portion of the packaging material in a three-ply strip form and adhering inner faces of this folded portion, and is formed by bending this packaging material into a loop such that the horizontal cross section forms a flattened circle, closing two edges in the width direction by applying a heat seal thereto to form a tubular pouch, filling the tubular pouch with a product to be packaged, and applying a bottom heat seal on the lower end and a top heat seal on the upper end such that said pleat is provided on at least the peripheral edge of the bottom face portion to thereby form a face which extends from the peripheral face portion such that the bottom face portion and rear face portion of the pleat form a substantial right angle at the upper end of the rear face portion of the pleat, whereby the pleat conceals the bottom face portion, and the pouch has top gussets and bottom gussets.

* * * * *